US005351112A

United States Patent [19]

Naito et al.

[11] Patent Number: 5,351,112

[45] Date of Patent: Sep. 27, 1994

[54] ORIGINAL FEEDING APPARATUS AND IMAGE FORMING SYSTEM WITH IT

[75] Inventors: Masataka Naito, Kawasaki; Yuji Takahashi, Tokyo; Masakazu Hiroi, Yokohama; Yoshinori Isobe, Tokyo; Akimaro Yoshida, Yokohama; Hitoshi Fujimoto, Kawasaki; Tomohito Nakagawa, Matsudo, all of Japan

[73] Assignee: Canon Kabushiki Kaisha, Tokyo, Japan

[21] Appl. No.: 2,135

[22] Filed: Jan. 8, 1993

[30] Foreign Application Priority Data

Jan. 13, 1992 [JP] Japan ..... 4-024615
Jan. 13, 1992 [JP] Japan ..... 4-024616

[51] Int. Cl.[5] ..... B65H 85/00; G03G 15/04; G03G 15/00

[52] U.S. Cl. ..... 355/233; 271/3.1

[58] Field of Search ..... 355/233, 235, 309, 313, 355/311, 47–51; 271/3.1, 9

[56] References Cited

U.S. PATENT DOCUMENTS 4,231,561 11/1980 Kaneko et al. ..... 271/3.1
4,561,765 12/1985 Masuda ..... 355/313
4,899,192 2/1990 Fujita ..... 355/51
5,017,971 5/1991 Yamada ..... 355/313
5,069,436 12/1991 Lubberts ..... 271/3.1

FOREIGN PATENT DOCUMENTS 0372401 6/1990 European Pat. Off. .
0427178 5/1991 European Pat. Off. .
0551862 7/1993 European Pat. Off. .

*Primary Examiner*—Joan H. Pendegrass
*Attorney, Agent, or Firm*—Fitzpatrick, Cella, Harper & Scinto

[57] ABSTRACT

An original feeding apparatus has a first original feeding means for directing an original to an original reading station from one side thereof in an original-stationary scanning mode in which the original is read while fixing the original at the original reading station, and a second original feeding means for directing then original to the original reading station from the other side thereof in an original-through scanning mode in which the original is read while shifting the original along the original reading station.

34 Claims, 50 Drawing Sheets

| FIG. 16A | FIG. 16B |
|---|---|

〈REJECT 3〉 BASED ON TRAIL END DETECTION OF FIRST ORIGINAL IT IS SET $v_2 > v_1$ TO ENLARGE SHEET INTERVAL, AND $v_2$ IS INCREASED TO TOP SPEED

〈REJECT 5〉 AT THIS TIME $v_2$ IS UNDER TOP SPEED, THEN IS DECREASED OR INCREASED TO SHEET DISCHARGE SPEED $v_3$

AT THIS TIME, $v_2$ IS DECREASED OR INCREASED FROM SHEET DISCHARGE SPEED TO SPEED EQUAL TO $v_1$
THEN, AT THE TIME WHEN SECOND ORIGINAL REACHES TO REVERSE ROTATION ROLLER, IT IS SET $v_2 = v_1$

ORIGINAL FEEDING APPARATUS AND IMAGE FORMING SYSTEM WITH IT

BACKGROUND OF THE INVENTION

1. Field of the Invention

The present invention relates to an original feeding apparatus and an image forming system having such original feeding apparatus, and more particularly, it relates to an image forming system, such as a copying machine, a laser beam printer and the like, having an original feeding apparatus for feeding a sheet original to a predetermined position such as an image reading station and for resting the sheet original thereon.

2. Related Background Art

In the past, as shown in FIGS. 10 and 21, original feeding apparatuses were divided into two groups.

FIG. 10 shows an original feeding apparatus of switch-back type wherein a sheet original is fed from a sheet tray 4 to an image reading station (platen 3) from an end B of the glass platen 3 and the sheet original is rested on the platen at a predetermined position. Thereafter, an image reading portion (optical system) of an image forming system is shifted to read the image, and, then, the sheet original is discharged from the end B of the glass platen and is stacked on the sheet tray again.

FIG. 21 shows an original feeding apparatus of a type wherein, similar to FIG. 10, a sheet original is fed to an image reading station (platen 3) from an end B of the glass platen 3 and the sheet original is rested on the platen at a predetermined position. After the image reading operation, the sheet original is discharged from the end B of the glass platen (switch-back type) or the sheet original is discharged from an opposite end C of the glass platen into a sheet path communicating with the sheet tray (closed-loop type). The closed-loop type or the switch-back type is selected in accordance with a size of the sheet original. In the original feeding apparatus of closed-loop type, after the image reading operation, the sheet tray was positioned horizontally or slightly inclined upwardly to facilitate the re-stacking of the sheet originals on the sheet tray 4.

In an original-through scanning mode in the conventional image forming system as shown in FIGS. 10 and 11, after the sheet original P from the sheet tray 4 has been rested on the glass platen 3 at any position, an optical system 213 was fixed, and the image reading was effected while discharging the sheet original P in a direction A.

However, there were the following drawbacks in performing the image formation by the aforementioned conventional techniques.

In the switch-back type shown in FIG. 10, since the next sheet original P was rested on the platen 3 after the first sheet original P has been discharged from the platen, a time (referred to as "original exchange time" hereinafter) required to discharge the first sheet original from the platen after the image reading operation and to set the next sheet original to be treated on the platen was long (corresponding to a time for feeding two sheet originals). In a high speed image forming system, since a copy sheet-to-copy sheet time (for example, a value obtained by dividing a distance between a trailing end of the first sheet and a leading end of the second sheet by a process speed) becomes shorter as the system is operated at higher speed, when "1 to 1" image formation (one image is formed on one sheet) is effected, if the sheet original exchange time is not smaller than the copy sheet-to-copy sheet time, it is impossible to make the productivity in the "1 to 1" image formation in the image forming system 100%. In the original feeding apparatus of the type shown in FIG. 10, since the sheet original exchange time was long, the productivity of 100% could not be achieved.

On the other hand, in the original feeding apparatus of the type shown in FIG. 21, although the sheet original can be fed by the switch-back mode as similar to FIG. 10 regarding a large size (for example, A3 size) sheet original, a half size (for example, A4 size and the like) sheet original is treated by the closed-loop mode. As shown in FIG. 22, in the closed-loop path, after the image reading operation regarding the first sheet original, the next sheet original is rested on the image reading station. In this closed loop type, since the sheet original exchange time is relatively short (a time required for feeding the sheet original by a distance corresponding to one sheet original plus a gap between two sheet originals), it is possible to exchange the sheet originals faster than the switch-back type shown in FIG. 10; but, if a further high speed operation is desired, since the feeding distance for the sheet original is already fixed or determined, the feeding speed must be increased. However, if the feeding speed is increased, the control for the stop position with high accuracy will become difficult, the damage of the sheet original will be increased when the sheet original is jammed, and the system will become large-sized and expensive and great noise will be generated because a large-sized motor must be for the higher speed operation.

To avoid this, in order to perform the high speed image formation without using the high speed sheet original feeding, it is known to fix the image reading portion of the image forming system and to read the image while shifting the sheet original. When the original-through scanning is effected in the types shown in FIGS. 10 and 21, unless the image reading is performed while the sheet original is being fed from the end C to the end B of the glass platen, the proper image cannot be obtained. In the type as shown in FIG. 11, when the original-through scanning is effected, since after the sheet original is once fed onto the glass platen, the sheet original must be shifted to the direction A meanwhile the image on the sheet original is read, the original exchange time is required to feed the sheet original to the platen without fail. In order to eliminate this long exchange time, as mentioned above, the higher speed sheet original feeding must be adopted, thus causing the aforementioned problems.

Further, in the apparatus shown in FIG. 10, a belt conveyor 7 is rotated in a direction E to feed the sheet original P onto the platen 3 and then is rotated reversely to return the sheet original to a direction D, thereby performing the switch-back feeding. Thus, a motor for driving the belt conveyor must be rotated normally and then reversely for a short time. However, generally, a motor has a building-up time for achieving a predetermined number of revolutions. If the building-up time of the motor is long, when the sheet original is read, discrepancy in a leading end portion of the image will occur during the reading of the sheet original. Further, with this arrangement, while the sheet original is being fed and read, the sheet original are stocked between inversion rollers 10, 12, with the result that the load to the belt drive motor is varied, thus causing the discrepancy in the image. In order to avoid such drawbacks, the image reading position of the image forming system may be shifted to a position 214 shown by the broken line in FIG. 11 not to reach the sheet original to the inversion rollers 10, 12 until the trailing end of the sheet original P is read; however, if do so, after the sheet original P is fed to the broken line position 215, the image must be read while switch-backing the sheet original, thus worsening the function of the image forming system considerably.

SUMMARY OF THE INVENTION

The present invention aims to eliminate the above-mentioned conventional drawbacks, and an object of the present invention is to provide an original feeding apparatus wherein an original can be read at a high speed, and more particularly, an original feeding apparatus wherein an original-stationary scanning mode and an original-through scanning mode can easily be selected.

More specifically, an object of the present invention is to provide an original feeding apparatus and an image forming system wherein two sheet original separating means are provided in the original feeding apparatus so that a sheet original can be fed to a reading position on a glass platen from both one end of the glass platen and the other end of the glass platen, thus achieving the high speed image formation.

To achieve the above object, according to the present invention, there is provided an original feeding apparatus comprising a sheet stacking means on which sheet originals to be treated are stacked, first sheet original separating means for feeding out the sheet original from the sheet stacking means one by one, a first sheet feeding path for directing the separated sheet original to an image reading station from one end of a glass platen, a sheet discharge path for returning the sheet original discharged from the image reading station to the sheet stacking means, second sheet original separating means disposed at an opposite side of the first sheet original separating means with respect to the sheet stacking means and adapted to feed out the sheet original from the sheet stacking means one by one, and a second sheet feeding path for directing the separated sheet original to the image reading station from the other end of the glass platen.

With this arrangement, since the two sheet original separating means are provided in the original feeding apparatus so that the sheet original can be fed to the image reading station from either one end of the glass platen or the other end of the platen and a control means is provided for switching between the original-stationary scanning mode and the original-through scanning mode, when the original-through scanning mode is selected, the original exchange time can be reduced to a time required for feeding the sheet original by a distance between two sheet originals or less. Thus, even when the original feeding apparatus is mounted on a high speed image forming system, the 100% productivity can be attained without reducing the copying speed and without feeding the sheet original at a high speed while maintaining the reliable sheet feeding because of the provision of the shortest sheet path.

Further, during the sheet original circulation, since the sheet originals re-stacked on the sheet stacking means are shifted toward the second sheet original separating means by a stack shifting means whenever the sheet original is discharged, the sheet original can be re-stacked in order and the sheet original can be fed onto the platen correctly without disordering the page sequence, and, by providing control means for protruding a leading end stopper at an upstream side of the second sheet original separating means at the end of the sheet original circulation before the last number of circulations to prevent the sheet original from entering into the second sheet original separating means and for disenergizing the stack shifting means during the last sheet original circulation to stop the trailing end of the sheet original at the first sheet original separating means, it is possible to return the sheet stacking means to an original position without damaging or tearing the sheet originals during the last sheet original circulation.

Further, in the original-through scanning mode, by providing control means for always rotating a belt conveyor constantly in one direction, and the image reading station of the image forming system at a position to which the sheet original can be fed only by the belt conveyor, the belt conveyor for feeding the sheet original can always be driven at a constant speed to feed the sheet original always at a constant speed, with the result that the stable image formation can be performed via an image reading means without distortion of the image.

Further, by setting an upper limit position of the sheet stacking means driven by a drive means pivoted upwardly and downwardly around the first sheet original separating means so that the sheet stacking means is positioned upwardly from a horizontal plane and a lower limit position of the sheet stacking means so that the sheet stacking means is positioned downwardly from the horizontal plane, the registration when the sheet originals are re-stacked on the sheet stacking means can be improved and the sheet original can easily be entered into the second sheet original separating means. Further, when the sheet stack on the sheet stacking means is shifted, the sheet stack can be shifted while maintaining the registration thereof, thereby reducing the load to the stack shifting means.

According to the present invention, more particularly, it is possible to provide a compact high speed image forming system which comprises first separating means for feeding out a sheet original to a glass platen one by one, second separating means for feeding out the sheet original toward a direction opposite to the first separating means, and control means for performing an original-through scanning mode and the like by causing the second separating means to feed the sheet original. Wherein, when "1 to 1" copying operation is effected regarding the sheet original of half size or less, by using the original-through scanning mode, an original exchange time can be reduced to a time required for feeding the sheet original by a distance between the sheet originals or less and which can feed the sheet original reliably with low noise.

Further, in a mode wherein the sheet original is fed by the second separating means, by providing a control means for shifting the stack shifting means whenever the sheet original is discharged onto the sheet stacking means to improve the re-stacking ability, and for protruding the stopper at the upstream side of the second separating means at the end of the sheet original circulation before the last number of circulations to prevent the sheet original from entering into the second separating means during the last circulation and for disenergizing the stack shifting means during the last sheet original circulation to stop the trailing end of the sheet original at the first separating means, it is possible to perform a plurality of circulations correctly, and to return the sheet stacking means to an original position where the sheet original can easily be picked up, without damaging the sheet original during the last sheet original circulation.

Further, by providing control means for always rotating a belt conveyor constantly in one direction and by setting the image reading station of the image forming system at a position to which the sheet original can be fed only by the belt conveyor, the belt conveyor can always be driven stably regardless of the building-up feature of a belt motor for driving the belt conveyor, and, since the sheet original is fed only by the belt conveyor, there is no variation in the feeding speed for the original sheet due to the shock generated when the sheet original enters into a nip between any rollers, with the result that the sheet original can always be fed by the belt conveyor at a constant speed until the image reading is completed, thus permitting the image formation without distortion, elongation and/or contraction of the image.

Further, by selecting an angle $\theta_1$ of the sheet stacking means (original tray) at the upper limit position thereof and an angle $\theta_2$ of the original tray at the lower limit position thereof to become $\theta_1>0$ and $\theta_2>0$ (FIG. 3), the sheet original or the sheet stack can easily be shifted toward the first separating means at the upper limit position and toward the second separating means at the lower limit position, thereby achieving the good registration of the originals and the reliable original feeding. Furthermore, it is also possible to surely shift the sheet stack on the original tray while maintaining the registration and to make a drive motor for shifting the sheet stack small-sized, thus reducing the installation space and cost.

BRIEF DESCRIPTION OF THE DRAWINGS

FIG. 52A shows I/O of FIG. 52B, and FIG. 52B shows a relation between a regist drive control means and a wide belt drive control means.

DETAILED DESCRIPTION OF THE PREFERRED EMBODIMENTS

The present invention will now be explained in connection with embodiments thereof with reference to the accompanying drawings.

Figure 1:
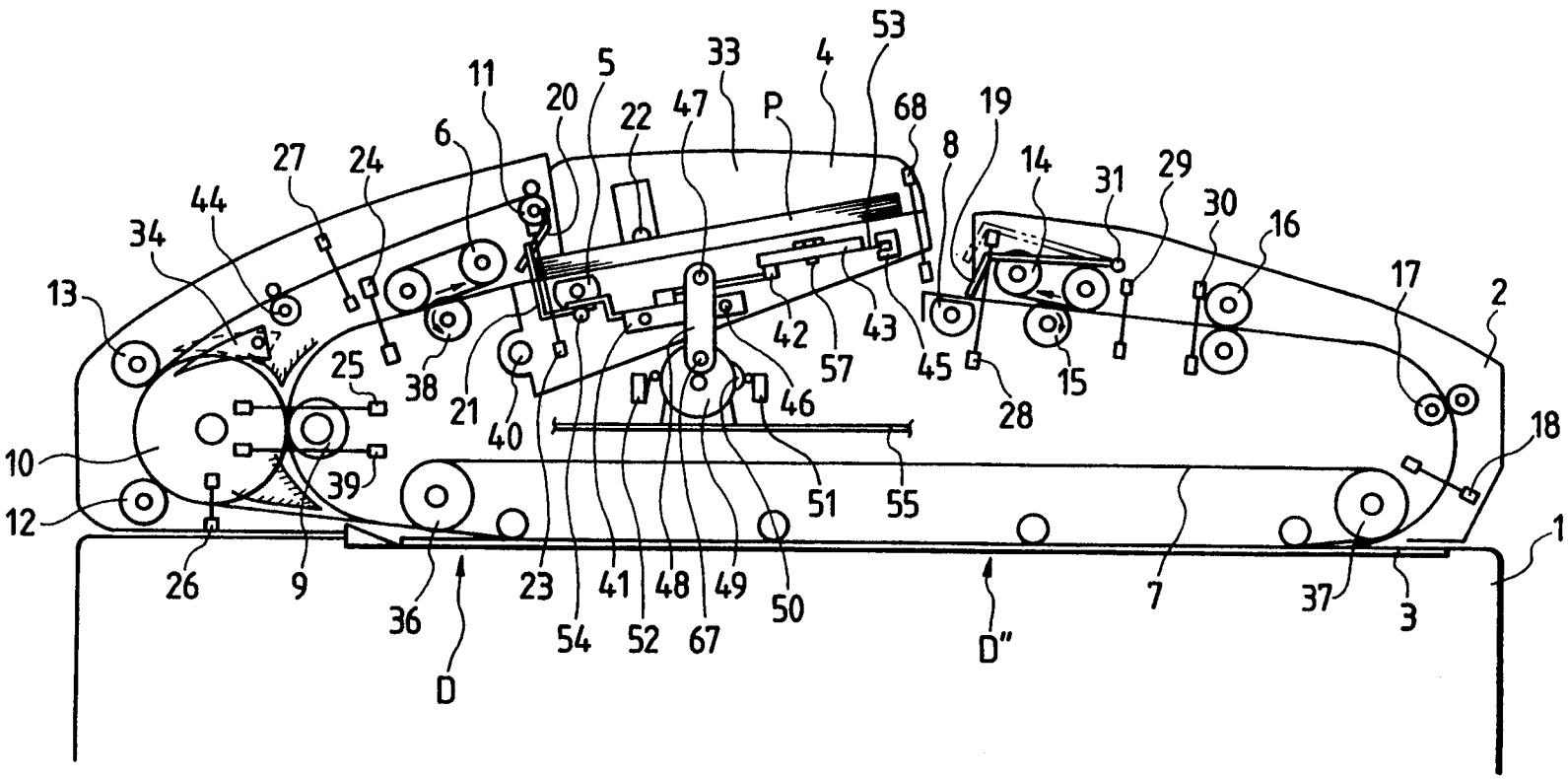
FIG. 1 is an elevational sectional view of an automatic original feeding apparatus according to a first embodiment of the present invention.

In FIG. 1, an RDF (recirculating document feeder according to the present invention) 2 which is a sheet original feeding apparatus has an upper original tray 4 below which a wide belt 7 would around a drive roller 36 and a turn roller 37 is disposed. The wide belt 7 is abutted against a platen 3 of a copying machine 1 and serves to feed a sheet original P onto the platen 3 and rest the sheet original on the platen at a predetermined position and to discharge the sheet original from the platen 3.

Further, a pair of widthwise direction regulating plates 33 are arranged on the original tray 4 for sliding movement in a widthwise direction of the sheet original P and serve to regulate the widthwise direction of the sheet originals P stacked on the original tray 4, thereby ensuring the stable sheet original feeding and the registration of the sheet originals to be re-stacked on the original tray 4. The widthwise direction regulating plates 33 includes a jogging mechanism (described later) therein, which jogging mechanism serves to urge the sheet original P discharged on the original tray 4 (after the reading operation) against the original reference guide 33 one by one, thereby further enhancing the registration of the sheet originals. Further, the original tray 4 can be rocked around a pivot point 40 between positions shown in FIGS. 1 and 2 by means of an original tray lifting/lowering mechanism which will be described later.

Adjacent to the original tray 4, there are disposed a semi-circular sheet supply roller 5, and a stopper 21 which can be shifted in an up-and-down direction by a stopper solenoid 108. The sheet originals P set on the original tray 4 cannot be moved toward the downstream side by the protruding stopper 21.

When a copy condition is inputted by an operation portion of the copying machine 1 and a start key (not shown) is depressed, the stopper 21 is retracted to open a path for the sheet original P, with the result that the sheet original P is fed toward the downstream side by the sheet supply roller 5. In this case, a partition plate 22 connected to a partition plate motor 105 (FIG. 5) incorporated in the original reference guide 33 on the original tray is rotated to ride on an uppermost sheet original P, thus dividing or separating the non-treated originals from the treated originals.

At a downstream side of the stopper 21, there are arranged a convey roller 38 and a separation belt 5 which constitute a first separation portion. These elements 38, 6 are rotated in directions shown by the arrows to separate the sheet originals P fed from the original tray 4 and to feed the separated sheet original toward the downstream side. Further, a weight 20 is disposed above the stopper 21. When the sheet originals P on the original tray 4 are decreased and the remaining sheet originals cannot be fed toward the separation portion 6, 38 only by the feeding of the sheet supply roller 5, the weight 20 is lowered by a weight solenoid 109 (FIG. 5) to urge the remaining sheet originals P against the sheet roller 5, thereby increasing the feeding force of the sheet supply roller 5.

An original feeding path (a), (b), (c) is provided between the separation portion 6, 38 and the platen 3 (see FIG. 4); this original feeding path (a), (b), (c) is curved and is connected to a convey path on the platen 3, and, thus, serves to direct the sheet original P to the platen 3. Further, in the vicinity of the sheet supply roller 5, there is disposed an inlet sensor (optical sensor of permeable type) 23*a*, 23*b* (FIG. 2) for detecting the presence/absence of the sheet original P on the original tray 4.

Figure 4:
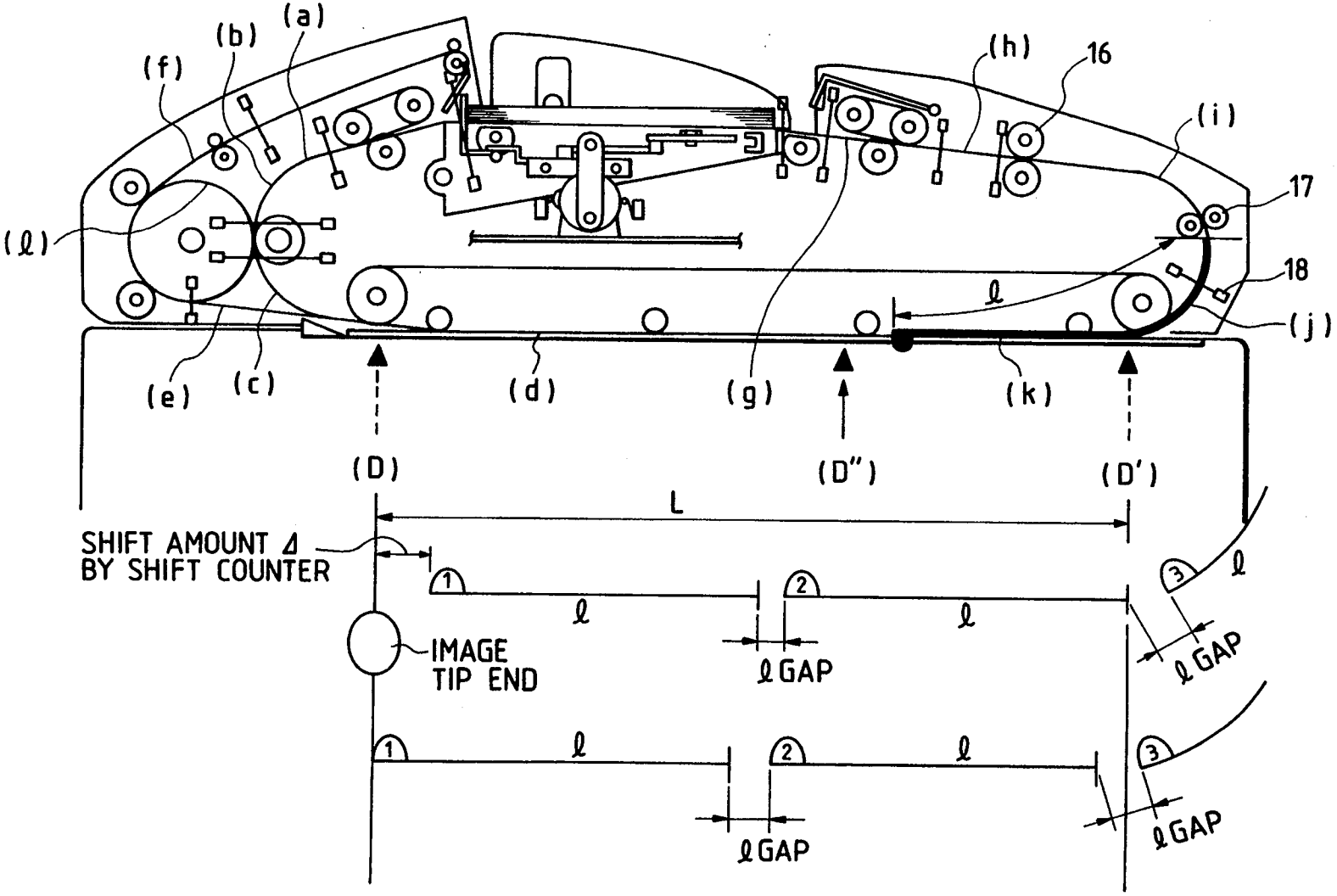
FIG. 4 is an elevational sectional view of the original feeding apparatus showing sheet original paths.

At the left of a body of the RDF 2, there is arranged a large roller (turn roller) 10, and an original discharge path (e), (f) extending upwardly from the platen 3 to the original tray 4 and passing around the large roller 10 is provided (FIG. 4). Further, above the large roller 10, an original inversion (reverse rotation) path (l) is branched from the original discharge path (e), (f), which original inversion path serves to invert the front and back surfaces of the both-sided original (FIG. 4). A downstream end of this original inversion path (l) is joined to the original feeding path (b). Relay rollers 44 and discharge rollers 11 are disposed at a downstream side of the original discharge path (f) so that the sheet original P passing through the original discharge path (e), (f) is discharged on the original stack (bundle) P on the original tray 4. The wide belt 7 disposed on the platen 3 serves to feed the sheet original P onto the platen 3 and rest the original on the platen at the predetermined position, and to discharge the sheet original from the platen 3 after the reading operation. At a junction between the original feeding path (a), (b), (c) and the original inversion path (l), there is disposed a feed roller 9 which is normally stopped to form a loop in the reached sheet original P, thereby correcting the skew-feed of the sheet original. In the vicinity of and at an upstream side of the feed roller 9, there is disposed a sheet supply sensor (optical sensor of permeable type) 25*a*, 25*b* to detect a leading end and a trailing end of the sheet original P. This sensor can detect the sheet original P passing through either the original feeding path (a), (b), (c) or the original inversion path (l). Further, at a downstream side of the feed roller 9, there is disposed a regist sensor (optical sensor of permeable type) 39*a*, 39*b* for detecting the trailing end of the sheet original P. In the original discharge path (e), (f) and below the large roller 10, a reverse rotation sensor (optical sensor of permeable type) 26*a*, 26*b* is disposed to detect the sheet original P discharged from the platen 3, and, further, in the original discharge path (f) between the large roller 10 and the discharge rollers 11, there is disposed sheet a discharge sensor (optical sensor of permeable type) 27*a*, 27*b* for detecting the sheet original P passing through the original discharge path (f) and discharge onto the original tray 4.

At a junction between the original discharge path (e), (f) and the original reverse rotation path (l), there is disposed a reverse rotation flapper 34 for switching the path, which flapper 34 is rocked between a position shown by the solid line and a position shown by the broken line (FIG. 5) by turning a reverse rotation flapper solenoid 110 (FIG. 5) ON or OFF, thereby switching the path.

Further, at the right of the body of the RDF 2, there is arranged a second original separating means for feeding the sheet original to the image reading station on the platen 3 from the right end of the glass platen, and a second original feeding path (h), (i), (j) (FIG. 4) is also provided.

Figure 2:
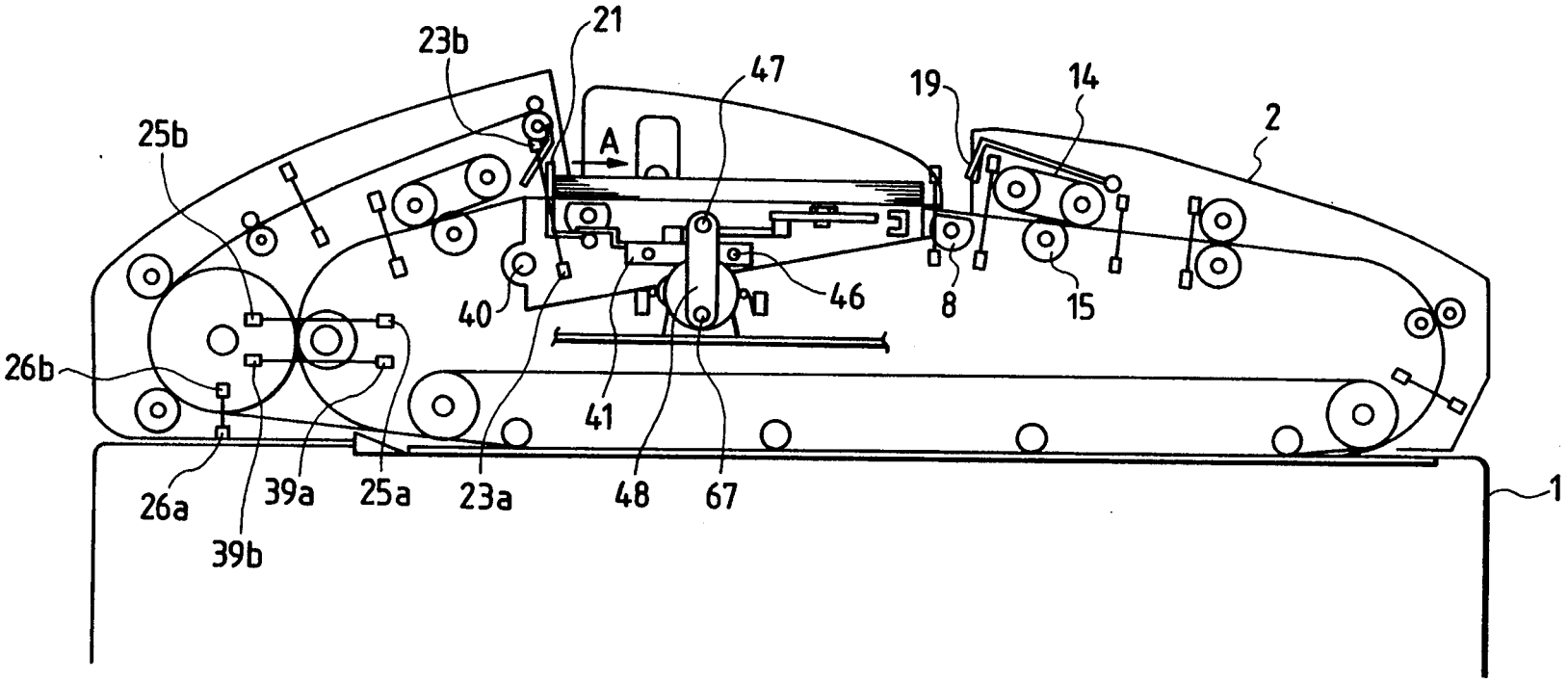
FIGS. 2 and 3 are elevational sectional views of the original feeding apparatus showing a condition that a sheet stack is shifted.

In response to an up-and-down rocking movement of the original tray 4 which will be described later, the original tray 4 is rocked between an upper limit position shown in FIG. 1 and a lower limit position shown in FIG. 2. As shown in FIG. 2, when the original tray 4 is in the lower limit position, the original tray 4 becomes contiguous to a second semi-circular sheet supply roller 8 and a second separation portion (constituted by a convey roller 15 and a separation belt 14) which are rotated in directions shown by the arrows, respectively, to separate the sheet originals P supplied from the original tray 4 one by one and to feed the separated sheet original toward the downstream side.

Figure 6:
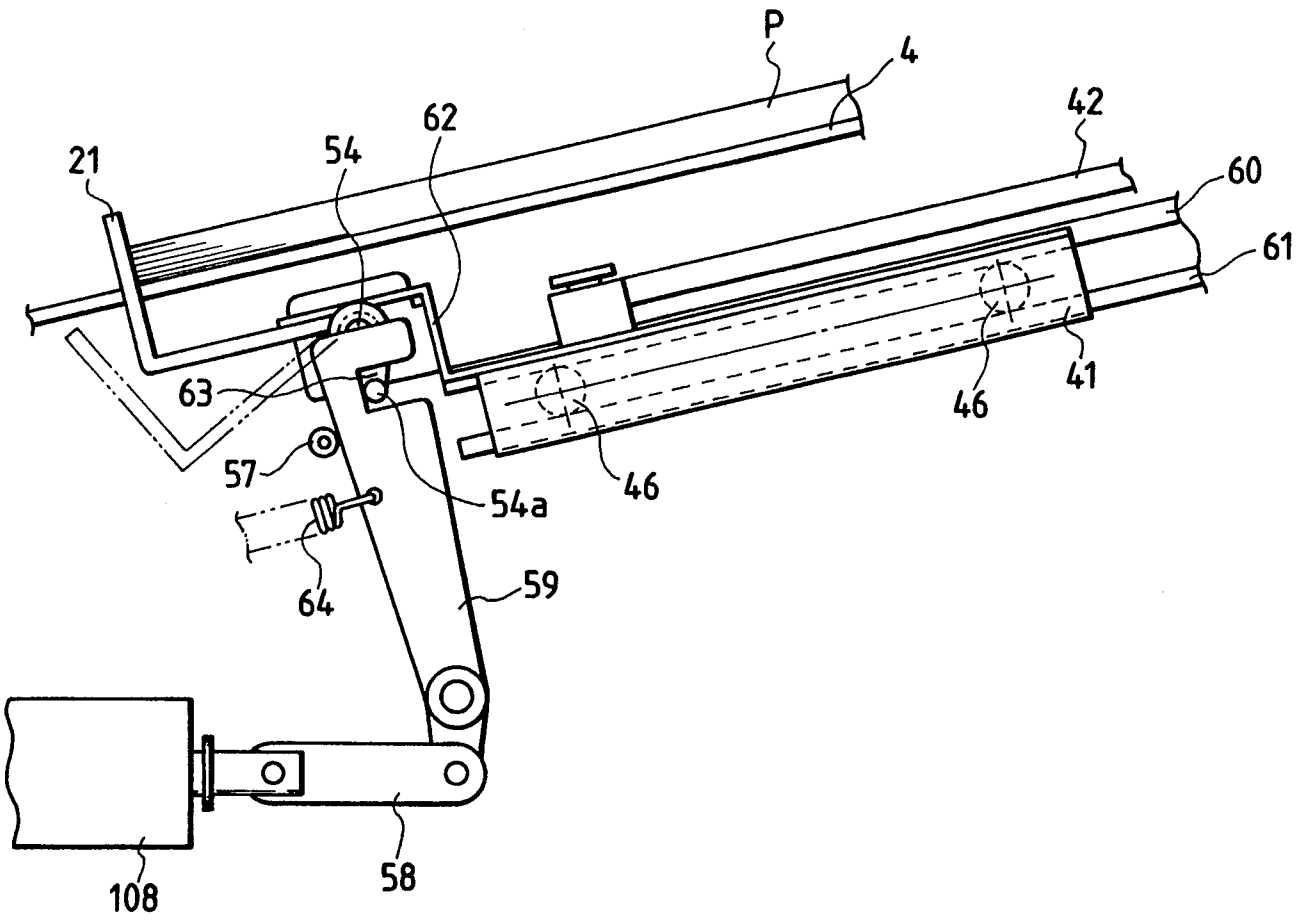
FIG. 6 is a partial elevational sectional view showing a main portion of an original tray.
Figure 7:
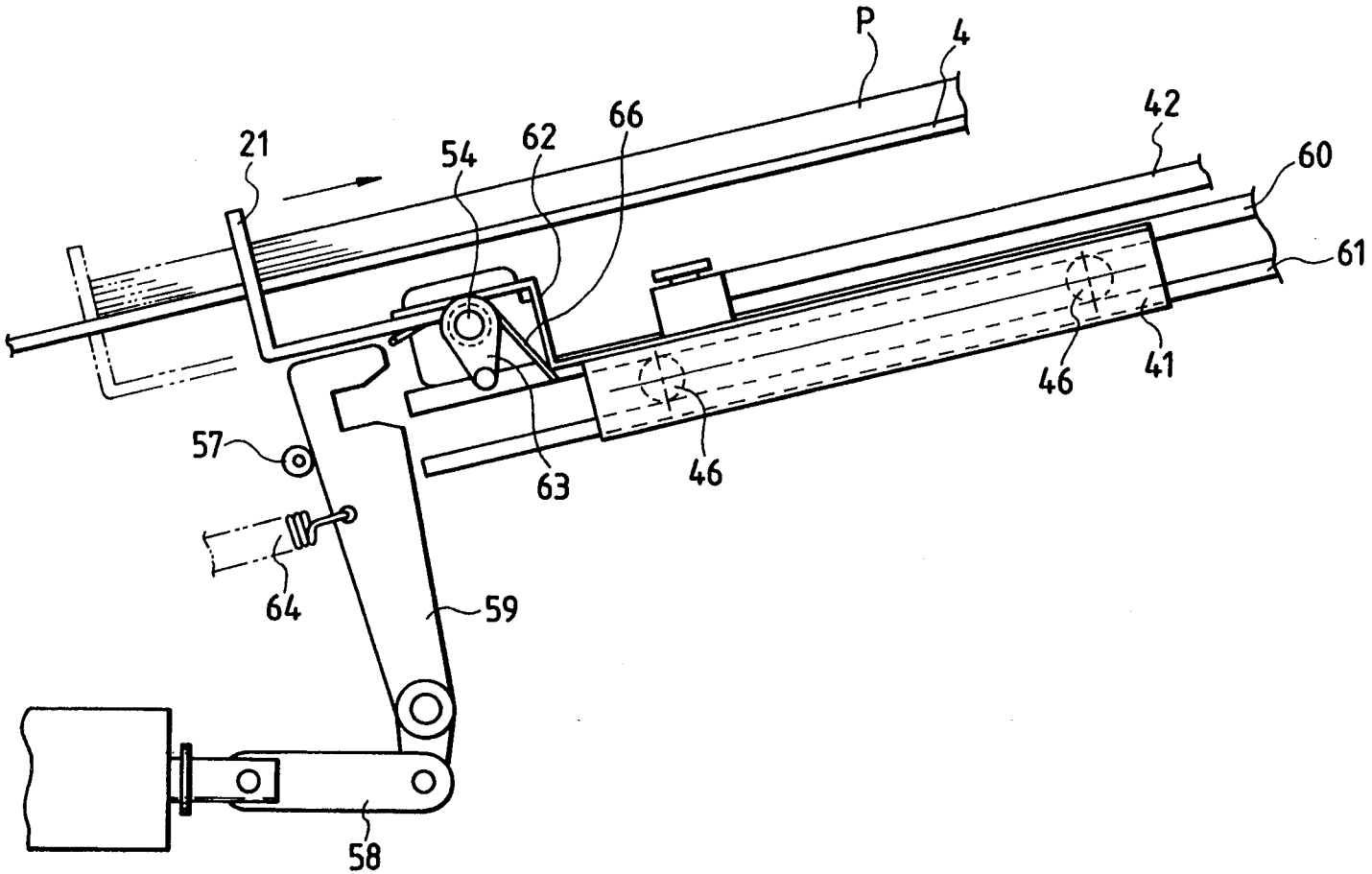
FIG. 7 is a partial elevational sectional view of the original tray showing the function thereof.

In FIG. 6, the stopper 21 and an integral short arm 63 are pivotally mounted on a pivot pin 54, and a pin 54*a* formed on the arm 63 is engaged by a recess of an operation member 59 so that the stopper 21 is rocked in a position shown by the phantom line when the operation member 59 is rotated in a clockwise direction. The operation member 59, an intermediate portion of which is pivotally mounted on a pin, is biased toward an anticlockwise direction by a tension spring 64 to abut against a stopper 57. A lower end of the operation member 59 is connected to the stopper solenoid 108 via a connection member 58.

Figure 3:
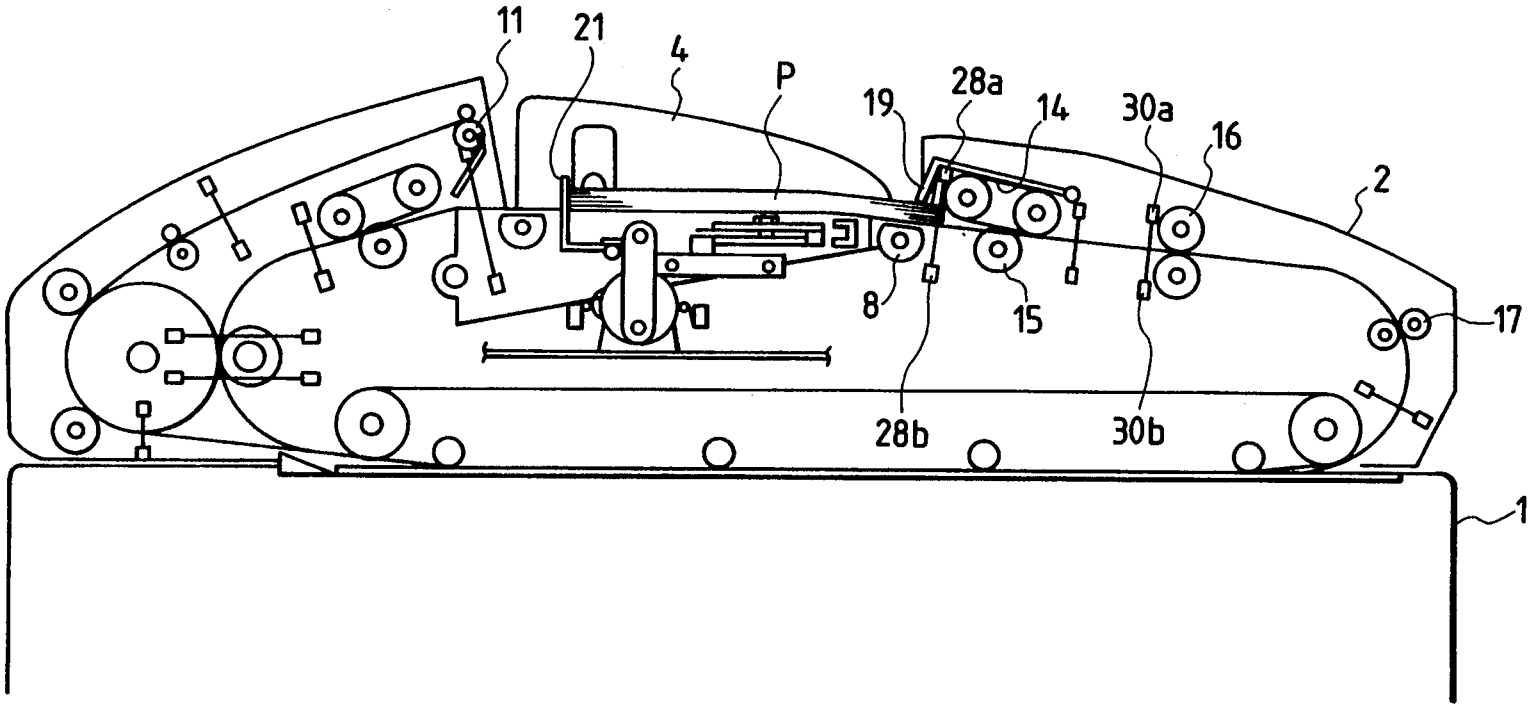
Figure 8B:
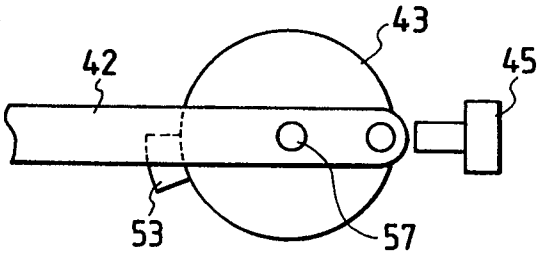
FIGS. 8A and 8B are plan views of a bundle feeding drive portion.
Figure 8A:
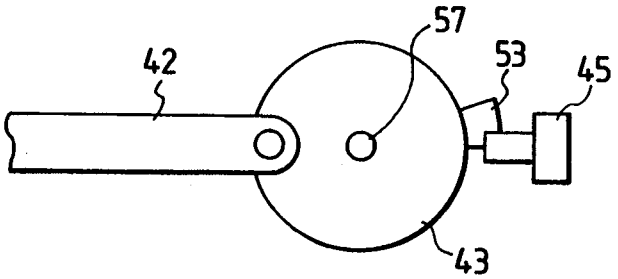

The original tray 4 assumes the upper limit position or the lower limit position in accordance with the size of the sheet originals rested on the tray and the input condition of the image forming system. When the tray 4 reaches the lower limit position, the above-mentioned stopped 21 boundle-feeds the sheet originals P stacked on the tray 4 toward the second separation portion 14, 15 by a predetermined distance. A stopper slide 41 is shifted along guides 60, 61 (FIG. 6) formed on the tray 4 via rollers 46 by the rotation of an eccentric cam 43 (FIGS. 8A and 8B) transmitted to the slide via a link 42. A flag 53 for detecting a home position (FIGS. 6, 8A and 8B) is formed on the eccentric cam 43 rotated around a support shaft 57, and a sensor 45 of permeable type is associated with the flag. When the original tray 4 reaches the lower limit position, a sheet original stopper 19 is rocked around a pivot pin 31 by an original stopper solenoid 111 (FIG. 5) to receive the sheet originals P bundle-fed by a bundle feeding means. The sheet originals P to be bundle-fed are conveyed to a position where they are detected by an optical sensor 28*a*, 28*b* of permeable type (for detecting the sheet original) arranged in the vicinity of the upstream of the second separation portion (FIG. 3). When the bundle feeding is finished, the solenoid 111 is turned OFF and the sheet original stopper 19 is rested on the sheet originals P. At a downstream side of the second separation portion 14, 15, there are disposed second feed rollers 16 which serve to form a loop in a reached sheet original P, thereby preventing the skew-feed of the sheet original P. At an upstream side of and in the vicinity of the second feed rollers 16, there is disposed a second sheet supply sensor (optical sensor of permeable type) 30*a*, 30*b* for detecting the leading end and the trailing end of the sheet original P. Relay rollers 17 are arranged at a downstream side of the second feed rollers, and an optical sensor 18*a*, 18*b* of permeable type for detecting an end tip position of the sheet original P is arranged in the second original feeding path (j). By this image tip end sensor 18*a*, 18*b*, the timing of a sheet on which an image is to be formed in the image forming system is controlled.

Incidentally, when the lowermost sheet original is separated and fed by the rotation of the second convey roller 15, the following operation occurs:

(1) When the number of the image formation cycles inputted by the input key of the image forming system is 1 (one), as shown in FIG. 3, the sheet original stopper 19 remains to be rested on the sheet originals P, so that the sheet original discharged by the discharge rollers 11 is prevented from entering into the second separation portion.

Figure 9:
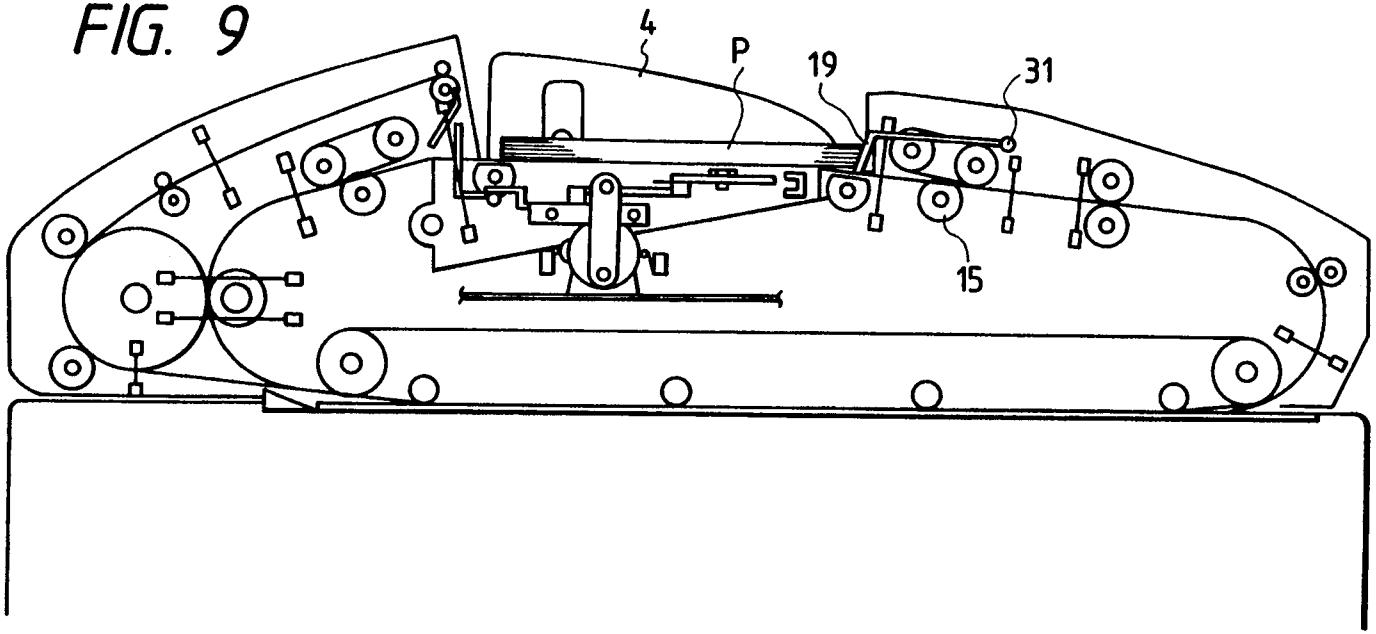
FIG. 9 is an elevational sectional view of the original feeding apparatus showing the function thereof.
Figure 10:
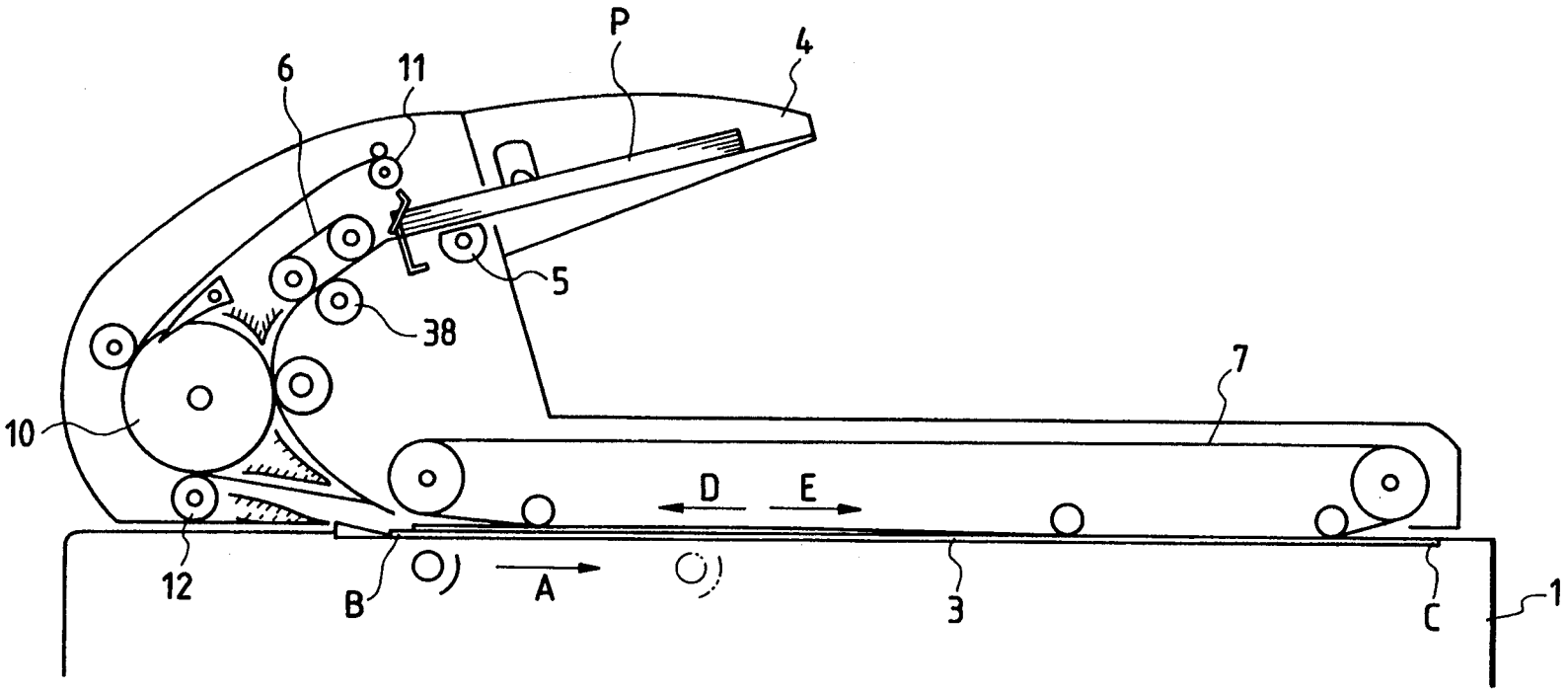
FIG. 10 PRIOR ART
FIG. 10 is an elevational sectional view of a conventional automatic original feeding apparatus.
Figure 11:
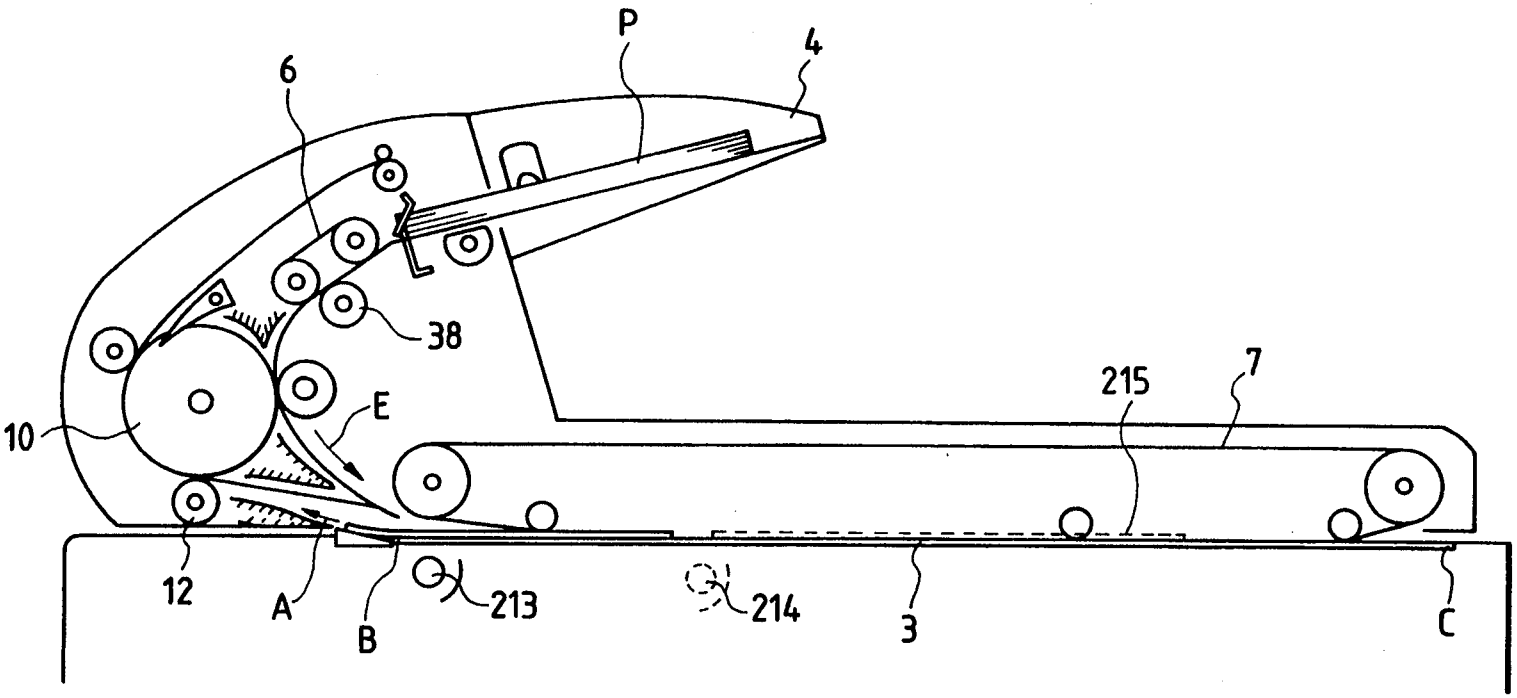
FIG. 11 PRIOR ART
FIG. 11 is an elevational sectional view of the apparatus of FIG. 10 showing the function thereof.
Figure 12:
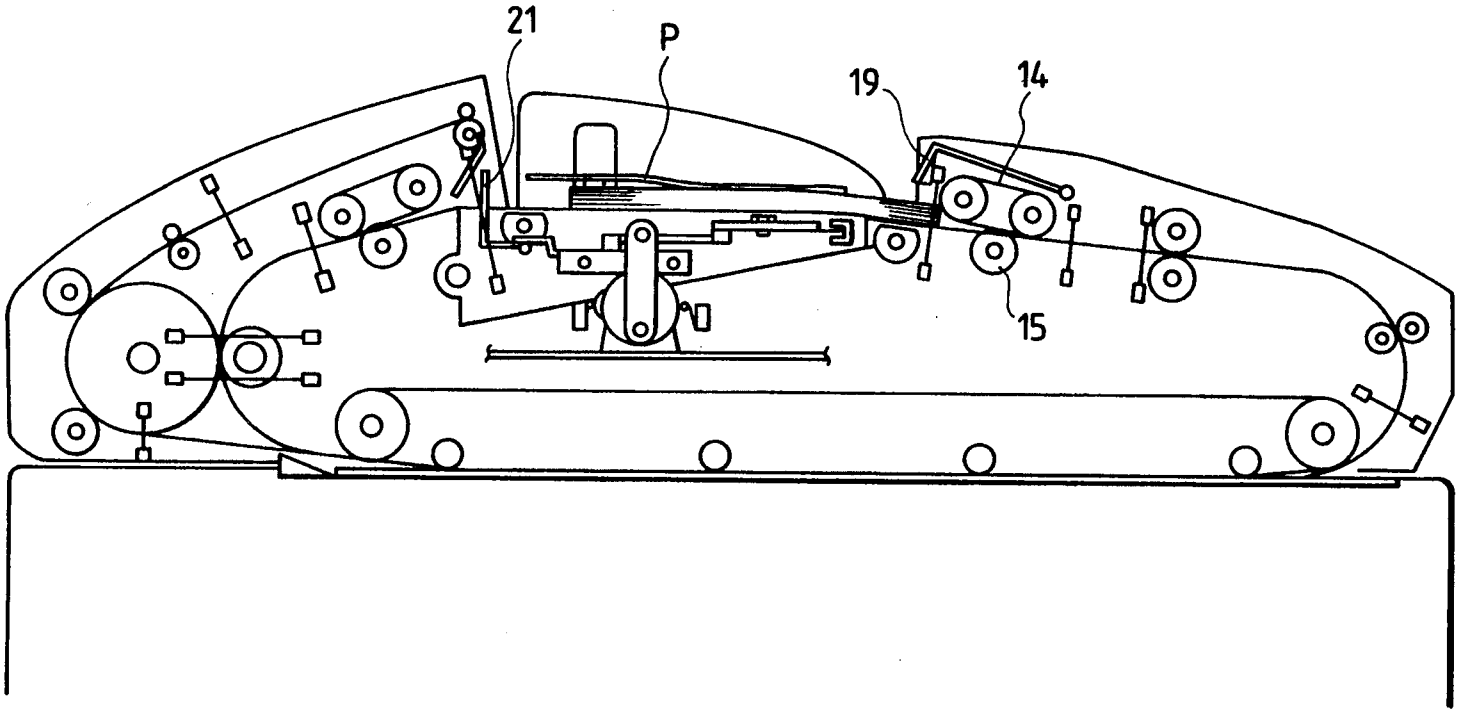
FIGS. 12 and 13 are elevational sectional views of the original feeding apparatus showing the function thereof.
Figure 13:
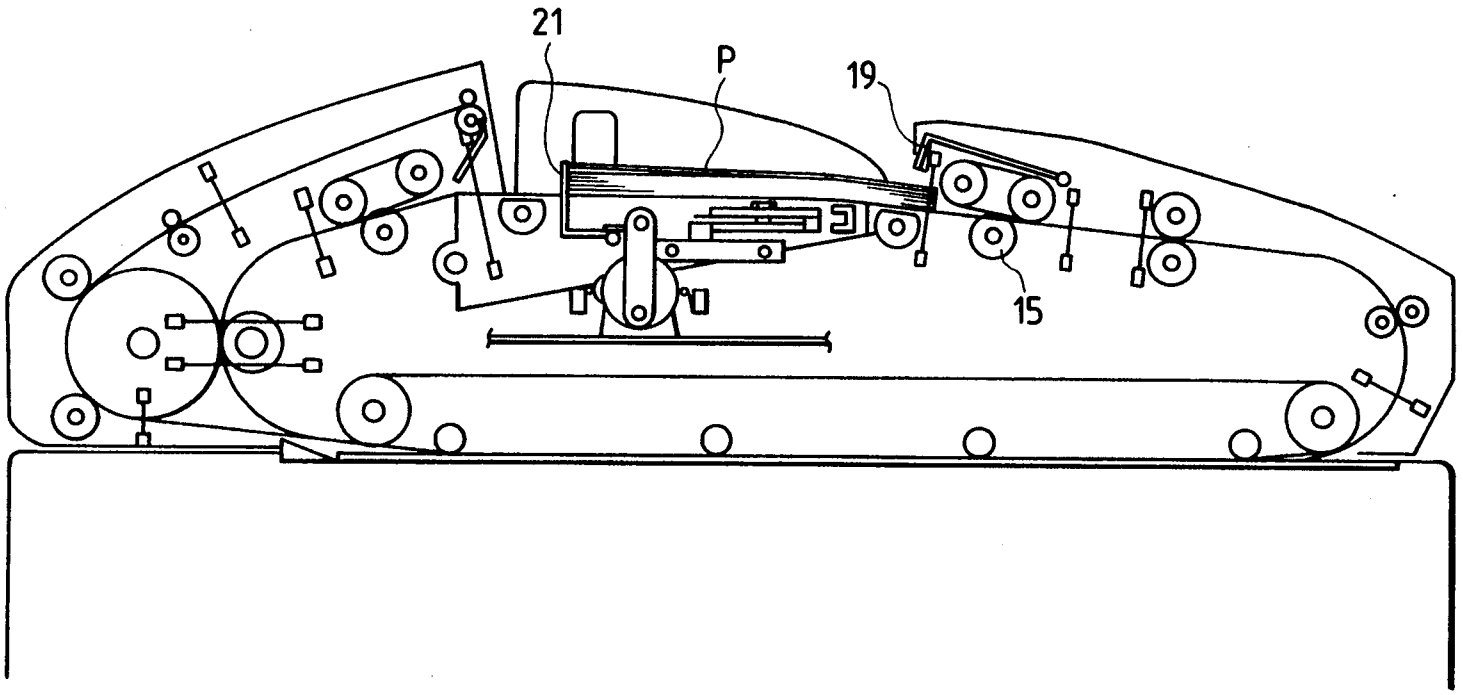

(2) When the number of the image formation cycles inputted by the input key of the image forming system is n (plural), as shown in FIGS. 12 and 13, the sheet original stopper 19 is retarded upwardly until the sheet originals are circulated by (n−1) times. And, before the first sheet original during the n-th circulatin is restacked on the original tray 4, the sheet original stopper 19 is rested on the sheet originals, thereby preventing this first sheet original from entering into the second separation portion. When the n-th circulation is completed, as shown in FIG. 9, the leading ends of the sheet originals P are regulated by the sheet original stopper 19. Thereafter, the original tray 4 is shifted upwardly to reach the upper limit position. Similarly, when the number of the image formation cycles is 1, the original tray 4 is also finally positioned as shown in FIG. 9.

Figure 5:
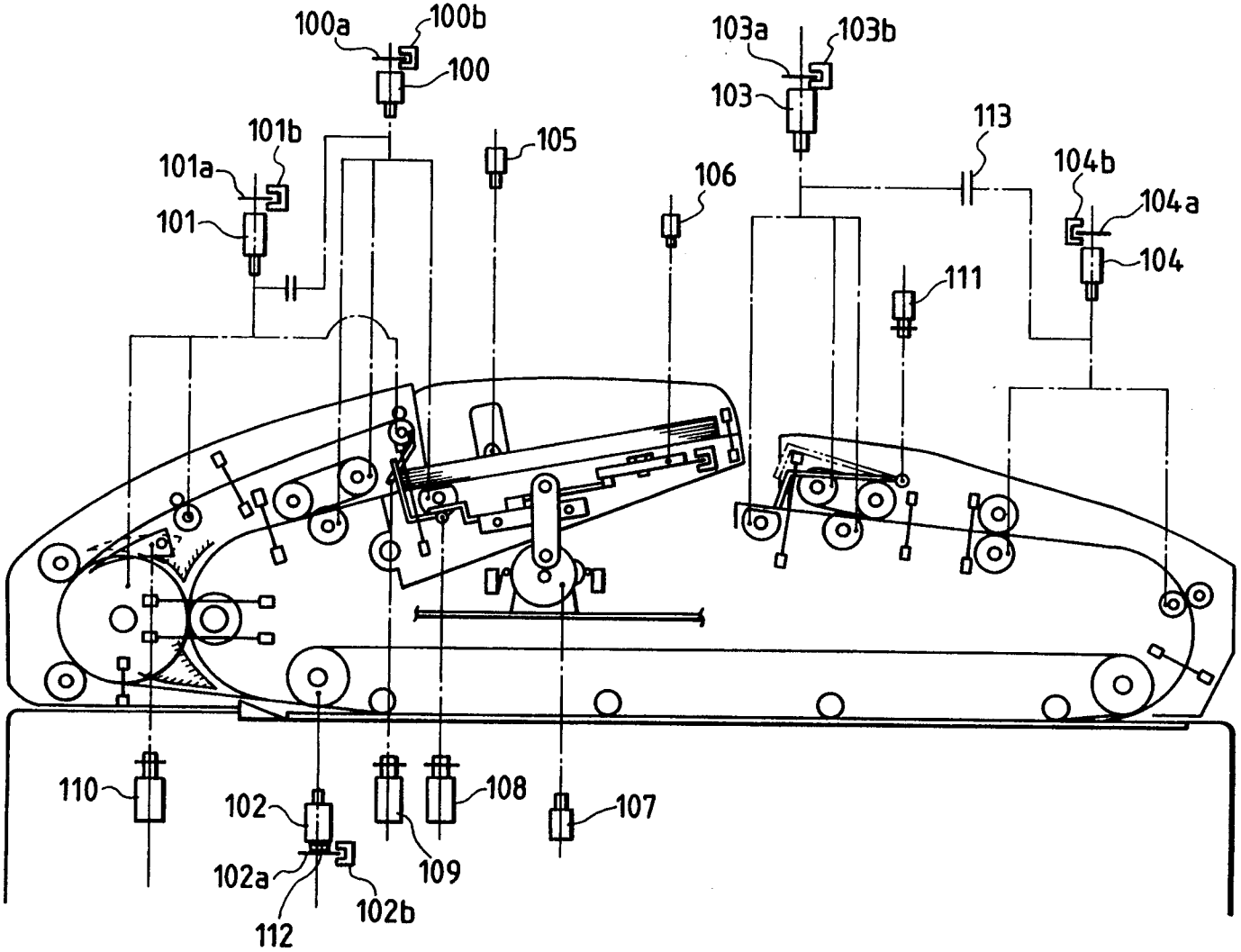
FIG. 5 is an elevational sectional view showing an arrangement of a drive system.

Next, a drive system of the RDF 2 will be explained with reference to FIG. 5 showing motors and solenoids for driving various rollers and flappers.

In FIG. 5, a first separation motor 100 serves to drive the convey roller 38 and the separation belt 6 which constitute the first separation portion in the direction shown by the arrows, respectively. A belt motor 102 drives the drive roller 36 for driving the wide belt 7, and the rotation of the drive roller 36 is transmitted to the turn roller 37 via the wide belt 7. Further, a brake 112 is provided on a motor shaft of the belt motor 102, thereby ensuring the stop position of the wide belt 7.

A reverse rotation motor 101 serves to drive the large roller 10 and the discharge rollers 11. A second separation motor 103 serves to drive the convey roller 15 and the separation belt 14 (second separation portion) in the directions shown by the arrows in FIG. 1. A motor 104 serves to drive the second feed rollers 16 and the relay rollers 17.

Clock disks 100*a*, 101*a*, 102*a*, 103*a*, 104*a* each having a plurality of slits are provided on motor shafts of the respective motors, and clock sensors 100*b*, 101*b*, 102*b*, 103*b*, 104*b* are associated with the corresponding clock disks to generate pulses by recognizing the slits by means of optical sensors of permeable type. By clock-counting the rotations of the respective motors by the clock sensors 100*b*, 101*b*, 102*b*, 103*b*, 104*b*, the rotation amounts of the corresponding rollers can be measured, thereby detecting the shifting amount of the sheet original P.

The reverse rotation flapper solenoid 110 serves to rock the reverse rotation flapper 34. When the solenoid is turned OFF, the reverse rotation flapper 34 is in a position shown by the solid line so that the sheet original P passing through the original discharge path (e), (f) is discharged onto the original tray 4, and when the solenoid is turned ON, the flapper reaches a position shown by the broken line so that the sheet original passing through the original discharge path (e), (f) is directed to the original reverse rotation path (l).

The stopper solenoid 108 serves to drive the stopper in the up-and-down direction. When the solenoid is turned OFF, the stopper is protruded as shown (FIG. 6) to prevent the sheet original stack P on the original tray 4 from shifting toward the downstream side, and when the solenoid is turned ON, the stopper 21 is retracted downwardly to open the path for the sheet original P.

The weight solenoid 109 serves to rock the weight 20 in the up-and-down direction. When the solenoid is turned OFF, the weight is in a position as shown, and when the solenoid is turned ON, the weight 20 is lowered to urge the sheet originals P against the sheet supply roller 5, thereby increasing the feeding force of the sheet supply roller 5. The original stopper solenoid 111 serves to rock the original stopper 19. When the solenoid is turned OFF, the original stopper 19 is in the position shown by the solid line, and when the solenoid is turned ON, the original stopper is lifted to the position shown by the phantom line.

Next, the rocking movement of the original tray 4 will be explained.

A tray rock motor 107 is attached to a support member 55 (FIG. 1), and a cam member 49 secured to a motor output shaft of the tray rock motor is connected to a tray rock arm 48. A tray rock shaft 47 is engaged by an under surface of the original tray 4. The tray rock shaft 47 is engaged by a tip end of the tray rock arm 48, and the other end of the tray rock arm 48 is engaged by a tray rock arm shaft 67 so that, when the tray rock arm shaft 67 is rotated, the tray rock arm 48 is rocked between a position shown in FIG. 1 and a position shown in FIG. 2, thereby rocking the original tray 4 around the pivot point 40.

An upper limit switch 51 serves to detect the fact that the original tray 4 reaches the upper limit position, and a lower limit switch 52 serves to detect the fact that the original tray 4 reaches the lower limit position. The rotation of the tray rock motor 107 is controlled by the detection of the upper and lower limit switches 51, 52 actuated by a protruding portion 50 of the cam member 49.

Next, the bundle feeding means on the original tray 4 will be explained.

A stopper slide motor 106 (FIG. 5) serves to shift the stopper 21 in a direction A in FIG. 2. As shown in FIG. 3, the stopper 21 is returned to an original position after it conveys the sheet original stack (bundle) to the second separation portion 14, 15. Further, whenever the sheet original is discharged onto the original tray 4 by the discharge rollers 11, the stopper 21 pushes the trailing end of the discharged sheet original toward the second separation portion, thereby improving the registration of the sheet originals P on the original tray 4 in the feeding direction (FIGS. 12 and 13).

Next, a partition member for the original tray 4 will be explained with reference to FIG. 14.

In FIG. 14, on an output shaft 117 of a partition member motor 105 (FIG. 3), there are arranged a partition flag 119 freely supported in a rotational direction, and a partition lever 120 secured to the output shaft 117 in coaxial with the flag and adapted to rotatingly drive the partition flag 119. As shown, the partition flag 119 has a circumferential cut-out portion, and a partition member 22 made from the flexible material such as a polyester film, leaf spring or the like is secured to the circumference of the flag so that the partition member is rotated together with the partition flag 119 around the output shaft 117.

Further, since the gravity center of the partition flag 119 is near the partition member 22, when the partition flag is not driven by the partition lever 120, the partition flag is stopped, by its own weight, so that the partition member 22 is oriented vertically downwardly. A partition sensor 121 serves to determine the position of the partition member 22 by detecting the partition flag 119.

Figure 14A:
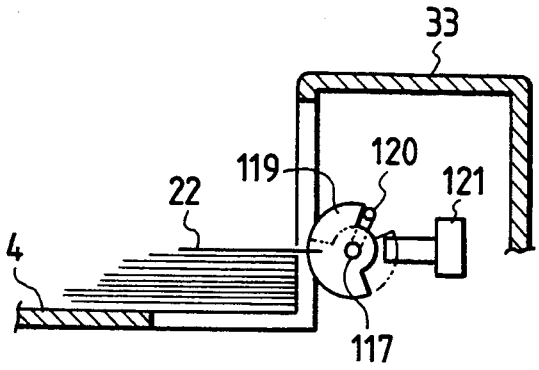
FIGS. 14A and 14B are elevational sectional views of a recycle lever portion.

In FIG. 14A, when the sheet originals P are stacked on the original tray 4 in a full condition, since a distance between an end face of the sheet original stack P and an attachment root of the partition member 22 is short, and the resiliency of the partition member 22 is strong, the partition member 22 does not deform, and, as shown, is kept flat along the sheet original stack P.

Figure 14B:
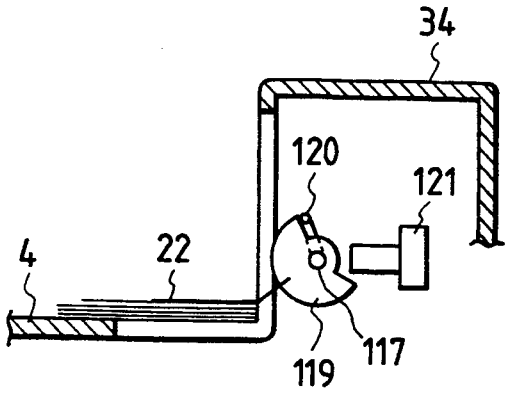

In FIG. 14B, when the number of the sheet originals P stacked on the original tray 4 is few, if a conventional rigid partition member is used, since the partition member is stopped so that the free end of the partition member is contacted with the surface of the sheet original stack P, the partition member will be spaced apart from the surface of the sheet original stack at the end face of the stack. When the sheet original P is re-stacked on the partition member, the trailing end of the sheet original is struck against the partition member, with the result that the sheet original could not be re-stacked on the original tray 4. However, as shown in FIG. 14B, in this invention, since the partition member 22 is flexible, the partition member 22 gets to fit the surface of the original stack P by the driving force of the partition lever 120, with the result that the partition member becomes flat along the surface of the original stack as in the case where the sheet originals are stacked on the original tray in the full condition. Accordingly, since the partition member 22 closedly contacts with the surface of the original stack P even when many sheet originals or ferwer sheet originals are rested on the original tray 4, even if the sheet originals are re-stacked on the partition member 22, the sheet originals are not struck against the partition member 22, with the result that the feeding of the sheet original P is not obstructed, thereby re-stacking the sheet originals P stably.

Figure 15:
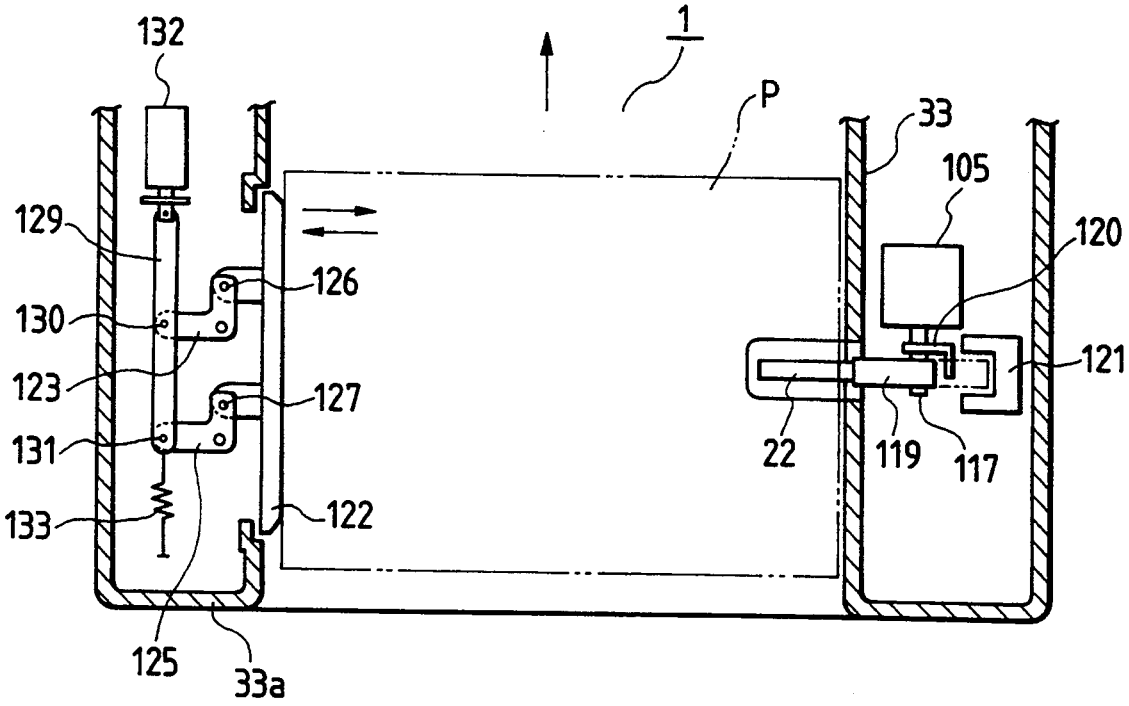
FIG. 15 is a plan view of the recycle lever and a jogging mechanism.

Next, the jogging mechanism will be explained with reference to FIG. 15 which is a plan view of the original tray 4.

A jogging guide 122 forms a part of the widthwise regulating plate **33*a* and is supported extendable and retractable with respect to the widthwise regulating plate 33*a*. On a surface of the jogging guide opposite to the sheet originals, there are formed link pins 126, 127 engaged by one ends of jogging links 123, 125, respectively. The other ends of the jogging links 123, 125 are engaged by a jogging lever 129 via lever pins 130, 131**, respectively.

Further, the jogging lever 129 is connected to a jogging solenoid 132. Accordingly, when the jogging solenoid 132 is turned ON, the jogging guide 122 is actuated to urge the sheet originals P against the original reference guide 33; whereas, when the jogging solenoid 132 is turned OFF, the jogging guide 122 is separated from the end face of the original stack by a return spring 133. That is to say, whenever the sheet original P is re-stacked on the original tray 4 one by one, by repeating the ON/OFF of the jogging solenoid 132, it is possible to urge the sheet original P against the original reference guide 33 surely, thereby improving the registration of the sheet originals P on the original tray 4.

Further, a slide volume (not shown) is engaged by the widthwise regulating plate 33*a*, thereby obtaining the information regarding the widthwise direction of the sheet original rested on the original tray 4 in response to the shifting movement of the widthwise regulating member 33*a*.

In addition, as shown in FIG. 1, a sheet length detection sensor 68 is provided at a rear end of the original tray 4, which sensor (for example, optical sensor of permeable type) 68 serves to discriminate whether the sheet original is greater than a LTR size (216 mm) or not, for example. When it is judged that the sheet original is greater than the LTR size by the sheet length detection sensor 68, the sheet originals stacked on the original tray 4 are fed toward the first separation portion 6, 38. On the other hand, when it is judged that the sheet original is not greater than the LTR size by the sheet length detection sensor 68, then the information regarding the widthwise direction of the sheet original is obtained in response to the movement of the slide volume associated with the widthwise regulating member 33*a*, thereby determining whether the sheet original is A4 size, LTR size or not, for example. If the sheet original is A4 size or LTR size, the original tray 4 is lowered, thereby preparing the condition that the sheet originals can be fed toward the second separation portion 14, 15.

Further, it is judged whether the sheet original is to be fed by the first separation portion or the second separation portion on the basis of an image formation mode inputted to the image forming system.

When the sheet original is other than A4 size or LTR size, the sheet originals are fed from the first separation portion. When the sheet originals are fed from the first separation portion, since the original-stationary scanning mode is used, the optical system 152 is in a position D shown in FIG. 1, So that, when the sheet original is rested on the platen 3, the optical system is shifted to the right to scan the sheet original. On the other hand, when the sheet originals are fed from the second separation portion, since the original-through scanning mode is used, the optical system 152 is shifted to a position D″ in FIG. 1 by a shifting means on the basis of the mode input and is fixed there.

Incidentally, the above-mentioned standard regarding the size of the sheet original is merely an embodiment of the present invention, and, thus, the reference value regarding the size of the sheet original may be appropriately selected.

Next, a second embodiment of the present invention will be explained.

Figure 17:
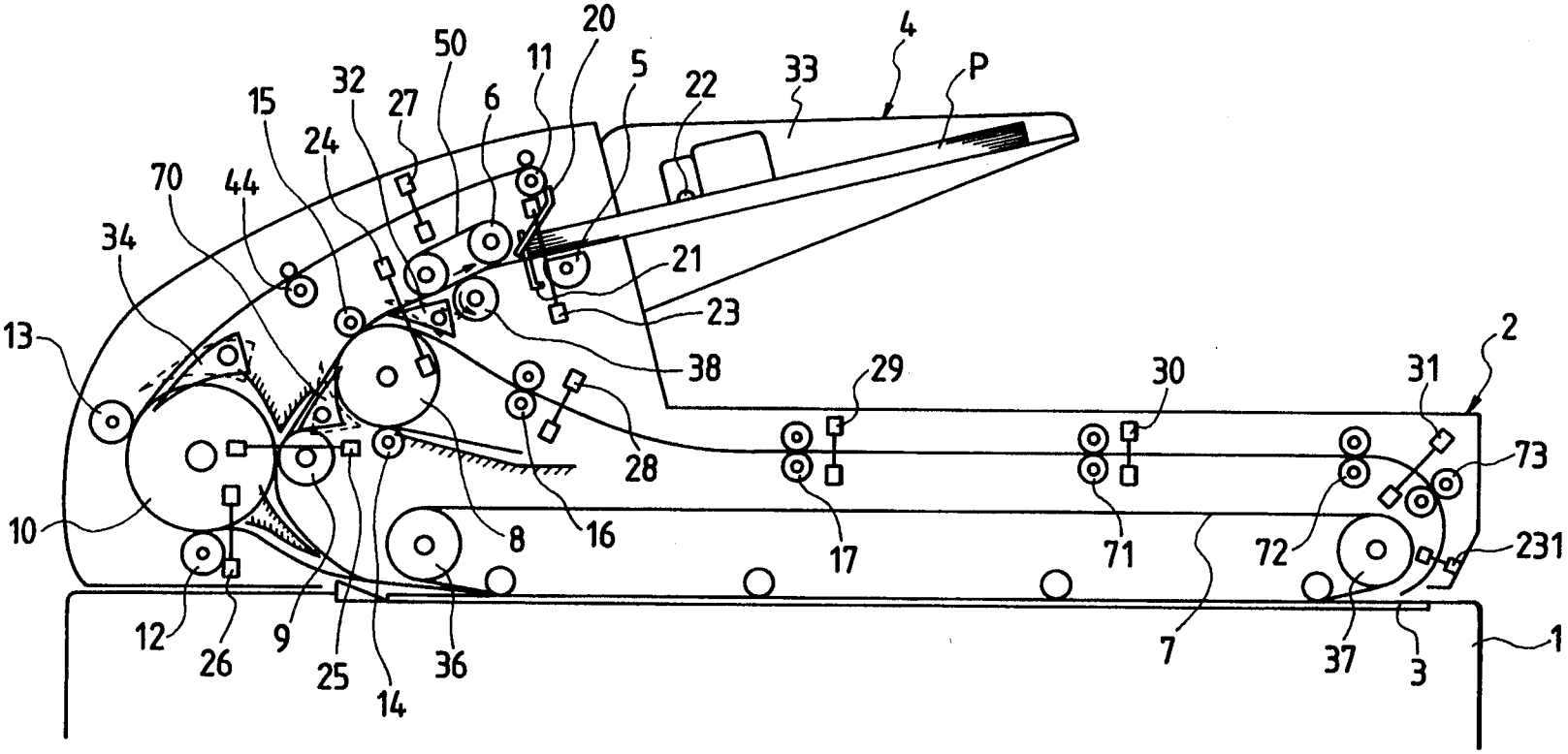
FIG. 17 is an elevational sectional view of an automatic original feeding apparatus according to a second embodiment of the present invention.
Figure 18:
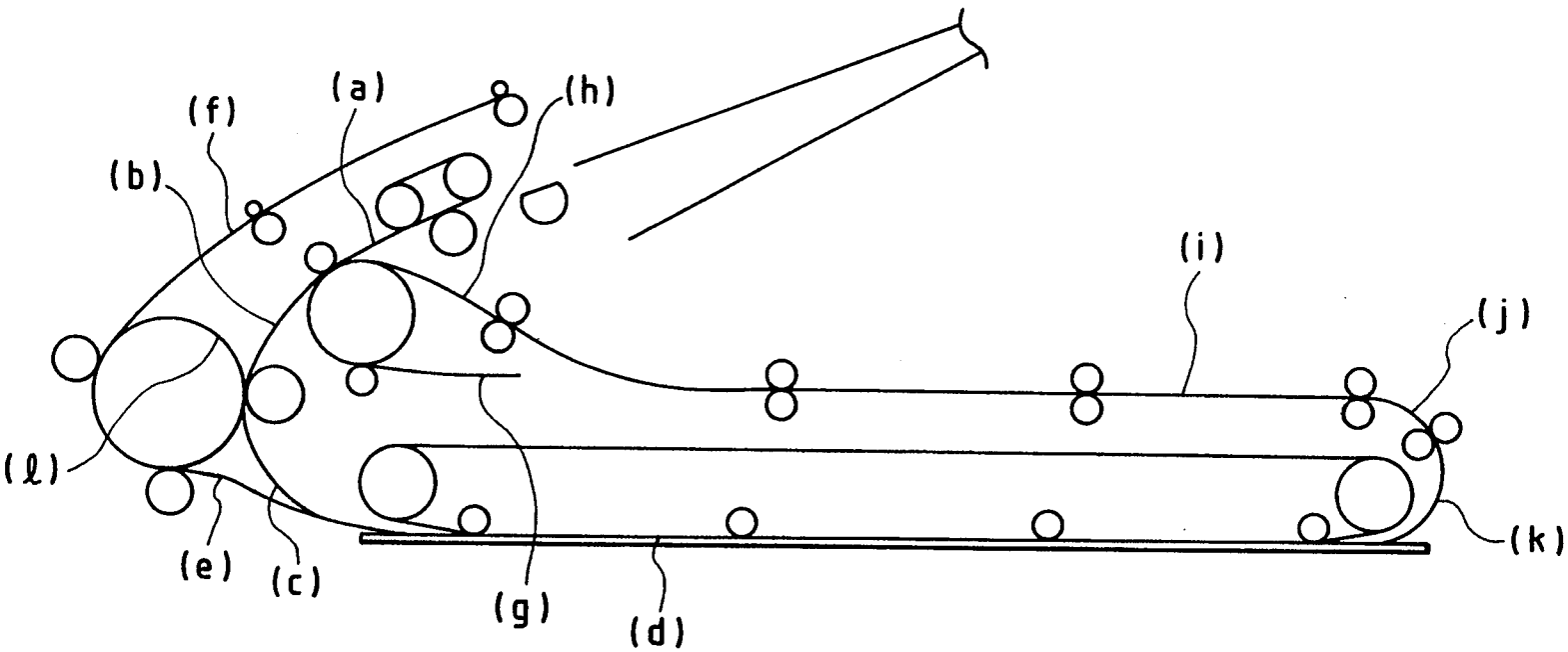
FIG. 18 is an elevational sectional view showing sheet paths.

As shown in FIGS. 17 and 18, in place of the second separation portion 14, 15, in a sheet path (a), (b), (c), (d) between the separation portion and the image reading station, there are provided a reverse rotation path (g), (h) and another sheet path (i), (j), (k) for directing the sheet original to the image reading station from the other end of the glass platen 3. Also in this case, it is possible to obtain the same advantages as those of the first embodiment, and to achieve the high speed operation and low noise.

Explaining in more detail, the sheet originals stacked on the original tray 4 are fed successively from the lowermost one by the separation portion 6, 38. When the normal mode is used (for example, when the sheet original is A3 size), the separated sheet original is passed through the sheet path (b), (c), (d) and is rested on the platen 3 at any position. Thereafter, the optical system of the image forming system is shifted to read the image. After the image reading operation is finished, the sheet original on the platen 3 is passed through the sheet discharge path (e), (f) and is re-stacked on the original tray 4.

When the high speed mode is used (for example, when the sheet original is A4 size and the "1 to 1" image formation is used), the separated sheet original is passed through the sheet paths (a), (g), (h), (i), (j), (k) to reach the image reading station from the other end of the glass platen 3. A reverse rotation portion 8, 14, 15 must inverse the sheet original at high speed to effect the copying operation at the high speed mode. In this case, there is provided a control means for permitting the reading of the sheet original by the original-stationary scanning mode while fixing the optical system of the image forming system.

With this arrangement, it is possible to obtain the advantages as same as those of the first embodiment and to achieve the high speed operation; but, there the following drawbacks:

(1) Since the sheet path is long, the first copy time is slow;

(2) Since the sheet path is long, the reliability of the sheet feeding (jam rate, skew-feed rate, lateral regist rate) is worsened; and (3) Since a distance between the sheet originals must be reduced during the switch-back of the sheet original, the high speed inversion or reverse rotation (switch-back) is required, and, accordingly, the noise is increased and a high speed motor is required, thereby making the image forming system large-sized and expensive.

Figure 19:
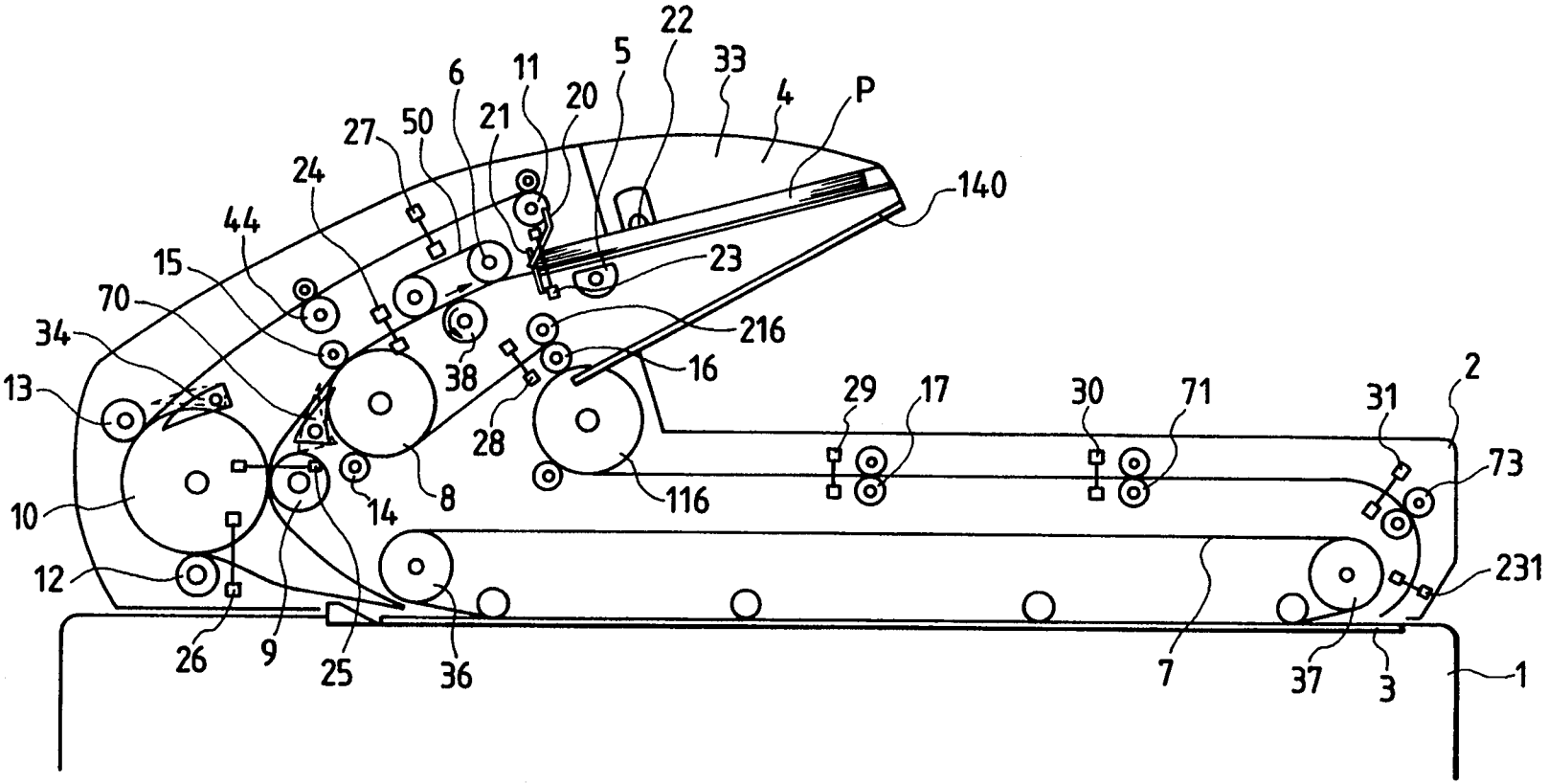
FIG. 19 is an elevational sectional view of an automatic original feeding apparatus according to a third embodiment of the present invention.
Figure 20:
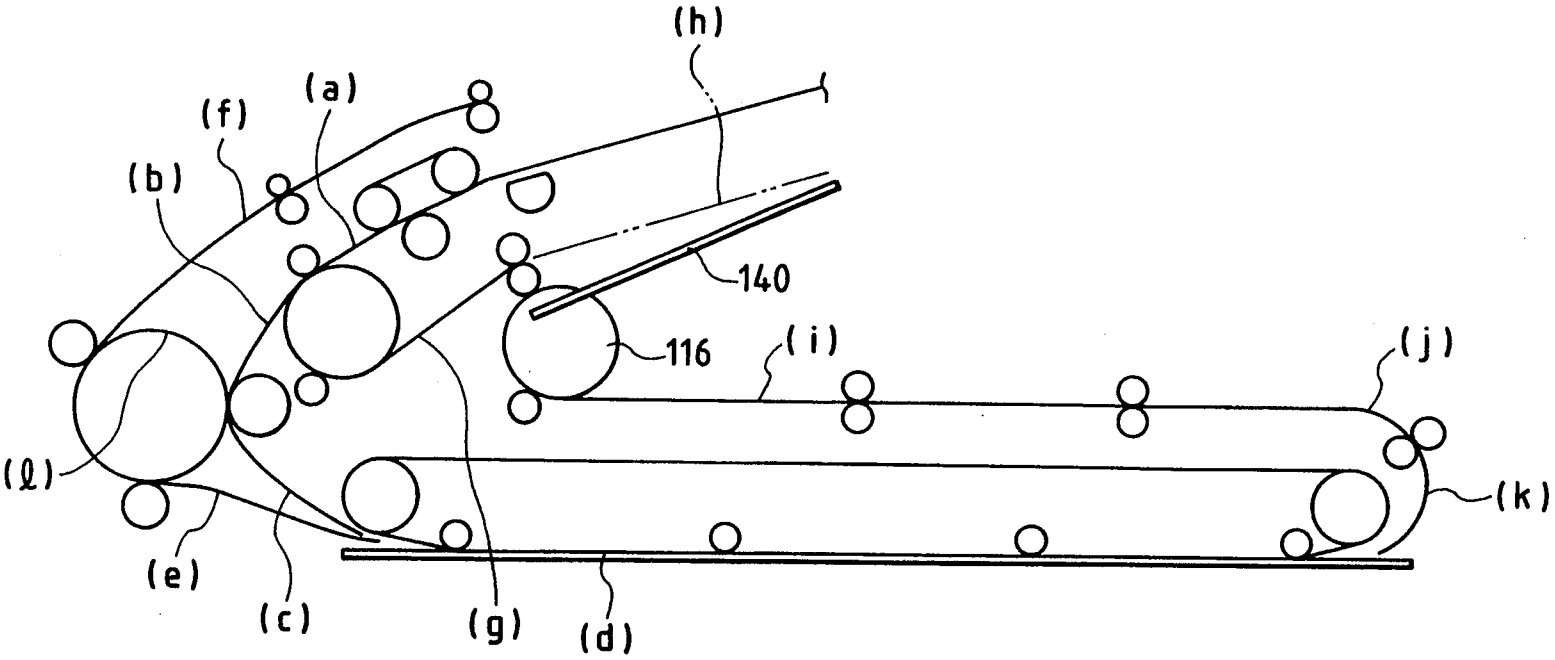
FIG. 20 is an elevational sectional view showing sheet paths.
Figure 21:
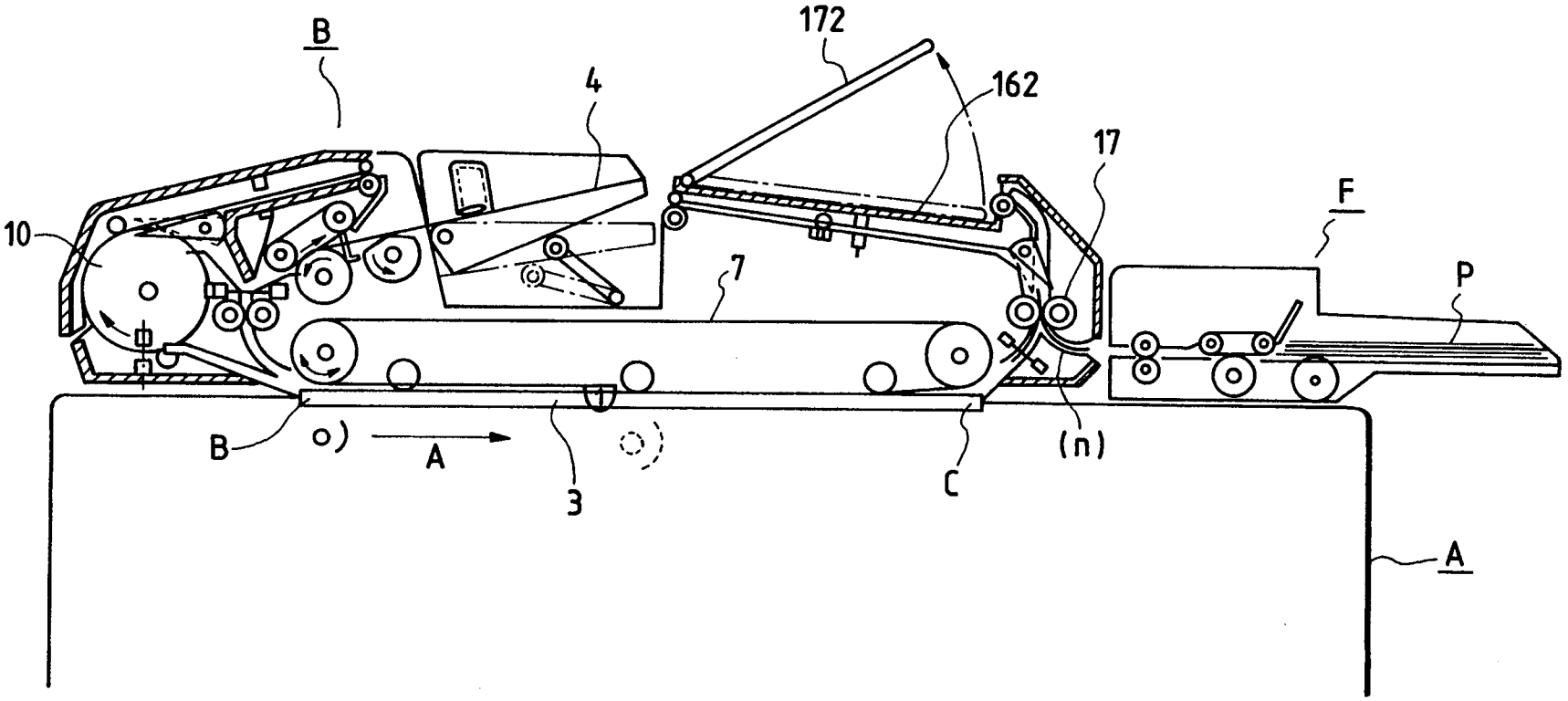
FIG. 21 PRIOR ART
FIGS. 21 and 22 are elevational sectional views of a conventional automatic original feeding apparatus.
Figure 22:
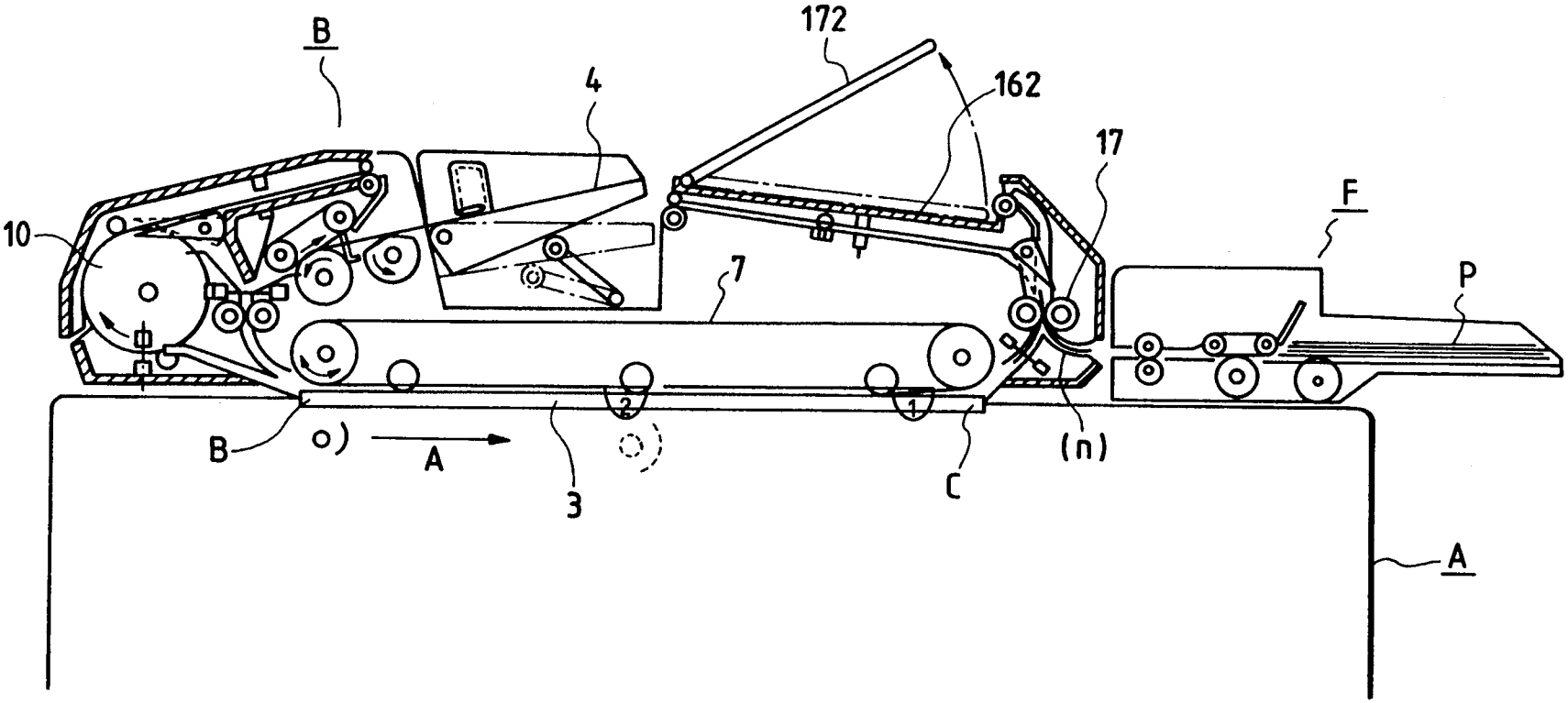
FIG. 22 PRIOR ART

Next, a third embodiment of the present invention will be explained with reference to FIGS. 19 and 20.

This embodiment improves the second embodiment. That is, in order to avoid the high speed switch-back inversion, an intermediate tray 140 is provided. The sheet originals stacked on the original tray 4 are separated one by one from the lowermost one by means of the separation portion. When the high speed mode is used, the separated sheet original is passed through the sheet path (a), (g), (h) to discharge onto the intermediate tray 140. Then, the sheet original is immediately pinched between switch-back rollers 16, 116 and is fed to pass through the sheet path (i), (j), (k), thereby conveying the sheet original to the image reading station. Also with this arrangement, it is possible to obtain the same advantages as those of the first embodiment and to achieve the high speed operation, low noise and compactness of the image forming system.

Unlike to the second embodiment, this arrangement does not require the high speed switch-back inversion. Accordingly, since the trailing end of the sheet original discharged on the intermediate tray is pinched by the switch-back rollers to be fed to the next sheet path, it is possible to feed the sheet original while maintaining the distance between the sheet original and the next sheet original properly. Thus, since the sheet original can always be fed at a constant speed, the high speed motor is not required and the reverse rotation of the motor is also not required, thereby facilitating the control for the system. However, since the sheet path is long in comparison with that of the first embodiment, the reliability of the sheet feeding is worsened and the first copy time is slow, same as in the second embodiment.

Figure 48:
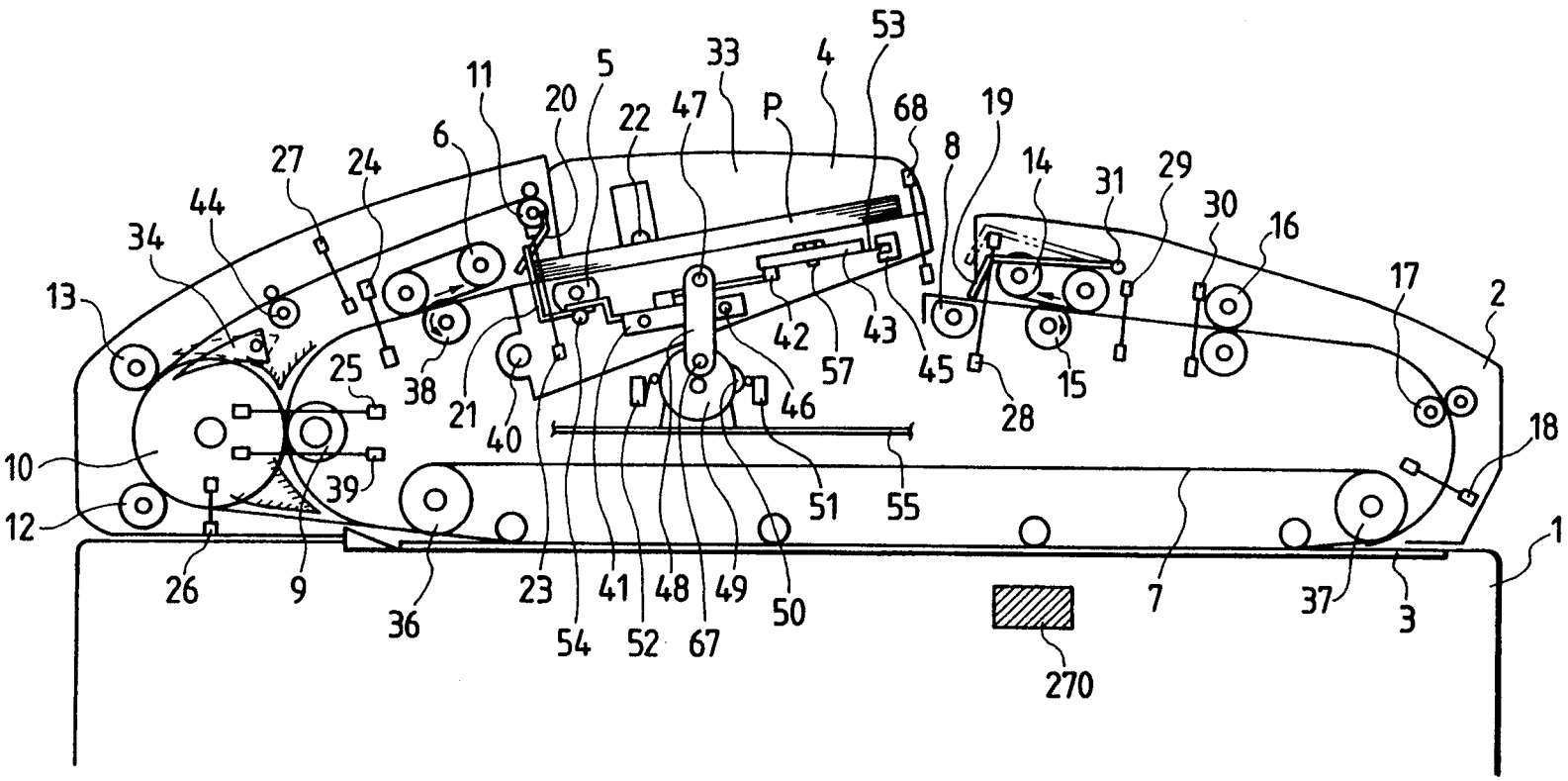
FIG. 48 is an elevational sectional view of an automatic original feeding apparatus according to a sixth embodiment of the present invention.
Figure 49:
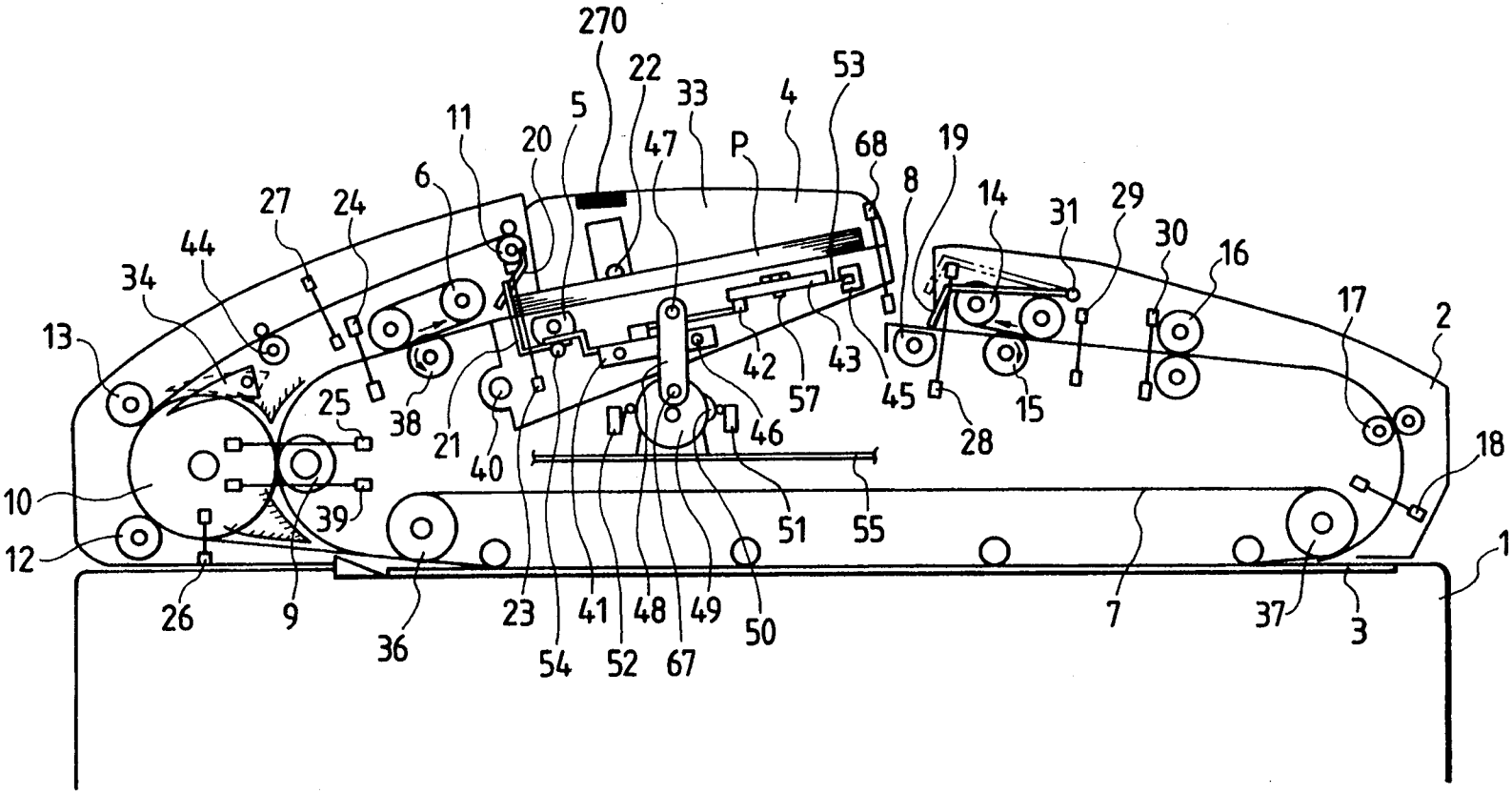
FIG. 49 is an elevational sectional view of an automatic original feeding apparatus according to a seventh embodiment of the present invention.

Next, a fourth embodiment of the present invention will be explained with reference to FIG. 48.

In the aforementioned embodiments, while the exposure mode of the image forming system 1 is switched on the basis of the condition that the sheet originals P are rested on the original tray 4, in this embodiment, the image forming system includes a mode switching means 270 for selecting one of two modes, i.e., an original-stationary exposure mode wherein the sheet original is fixed and the optical system is shifted to expose the original and an original-through exposure (scanning) mode wherein the optical system is fixed at a predetermined position and the sheet original is exposed while shifting the sheet original. The exposure mode is switched by the mode switching means on the basis of the condition of the sheet originals on the original tray (size, both-sided reading or enlargement/contraction or the like). The mode switching means 270 may be a push-button switch or may be a dip switch. Even if the original-through scanning mode is selected, when the size of the sheet original is other than A4 or when the both-sided reading is used or when the enlargement or contraction is selected, the original-stationary scanning mode is preferential.

In the above fourth embodiment, while the mode switching means 270 is arranged on an operation display on the image forming system, for example, such mode switching means may be arranged on an inner surface of a front cover of the image forming system and may be normally set to a predetermined exposure mode (for example, the original-through scanning exposure mode wherein the copy productivity is high and the noise is low), and may be switched to the other mode (for example, the original-stationary scanning exposure mode) when a particular case occurs (for example, one of the modes cannot be operated due to the malfunction). On the basis of the frequency of use, one of the modes is selected.

Further, the exposure mode switching means may be disposed in the vicinity of the sheet original stacking position of the sheet feeding apparatus 2.

Figures 16, 16A:
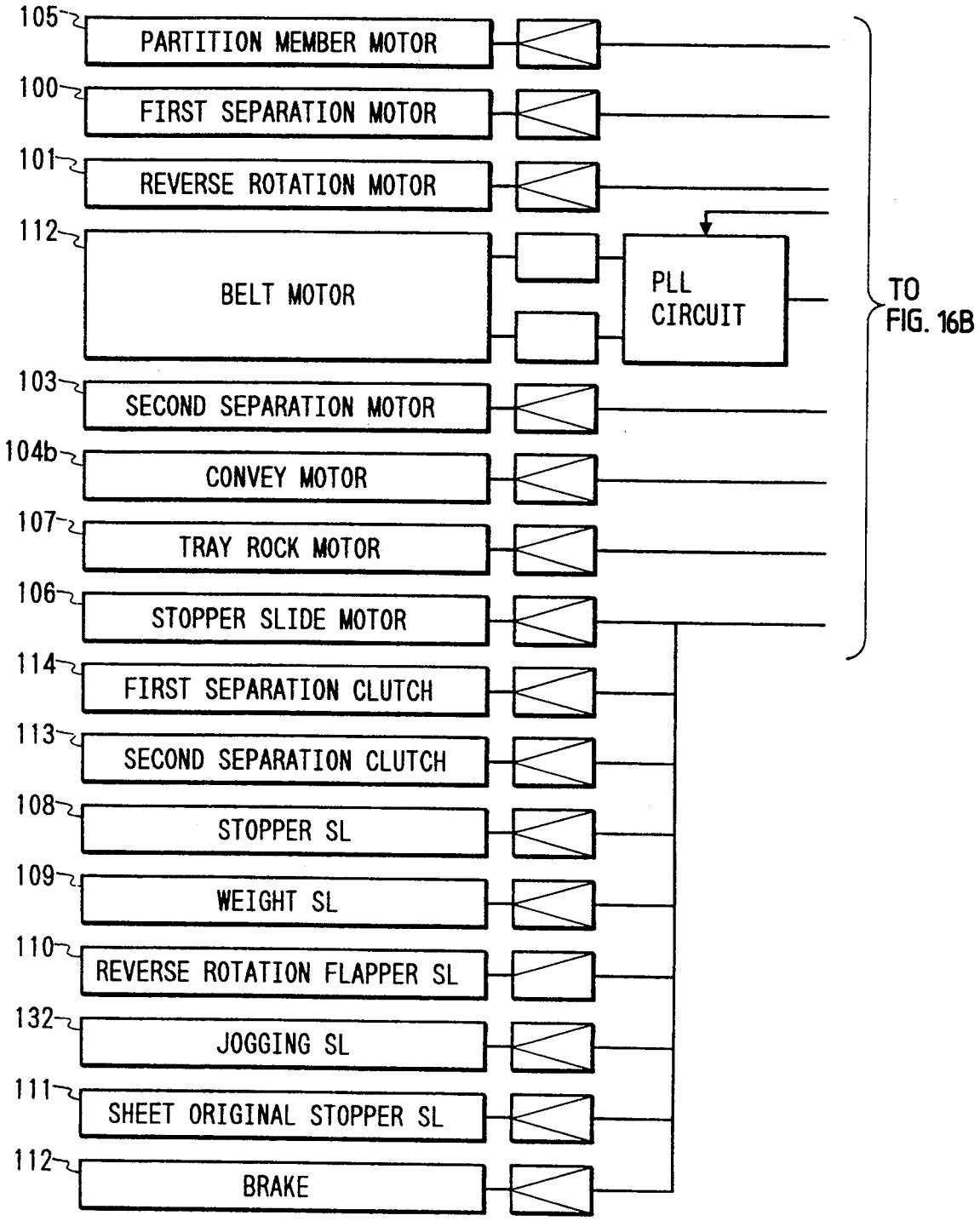
FIG. 16 consisting of FIGS. 16A and 16B is a block diagram of an image forming system.
Figure 16B:
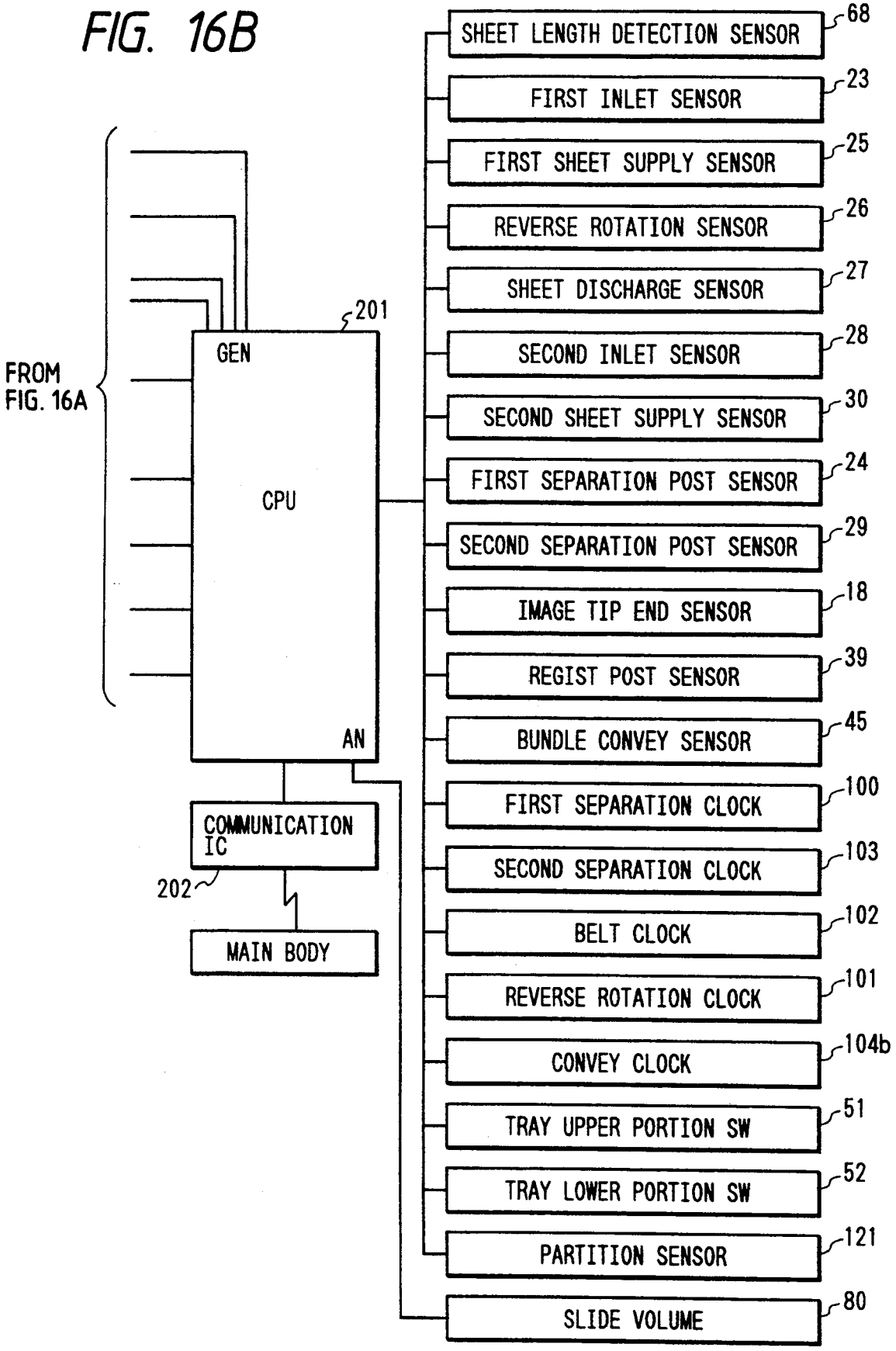

RDF Control System (FIG. 16)

FIG. 16 is a block diagram showing a control system of the recirculating document feeder (original feeding apparatus) according to the present invention. The control system mainly includes a one-chip microcomputer (CPU) 201 incorporating a ROM and a RAM therein, and signals from the various sensors are inputted to input ports of the microcomputer 201. Further, the slide volume for detecting the width of the sheet original is connected to an A/D converter terminal of the microcomputer 201 so that the value of the slide volume can be detected continuously at 255 steps. Further, output ports of the microcomputer 201 are connected to various loads via drivers. Particularly, the belt motor 112 is connected to the microcomputer via a conventional PLL circuit and a reversible driver. A rectangular wave signal having any frequency is inputted from a rectangular wave output terminal GEN of the microcomputer 201 to the PLL circuit, so that the belt motor 112 and accordingly the peripheral speed of the wide belt 7 can be appropriately changed by varying the frequency of the signal.

Figure 23:
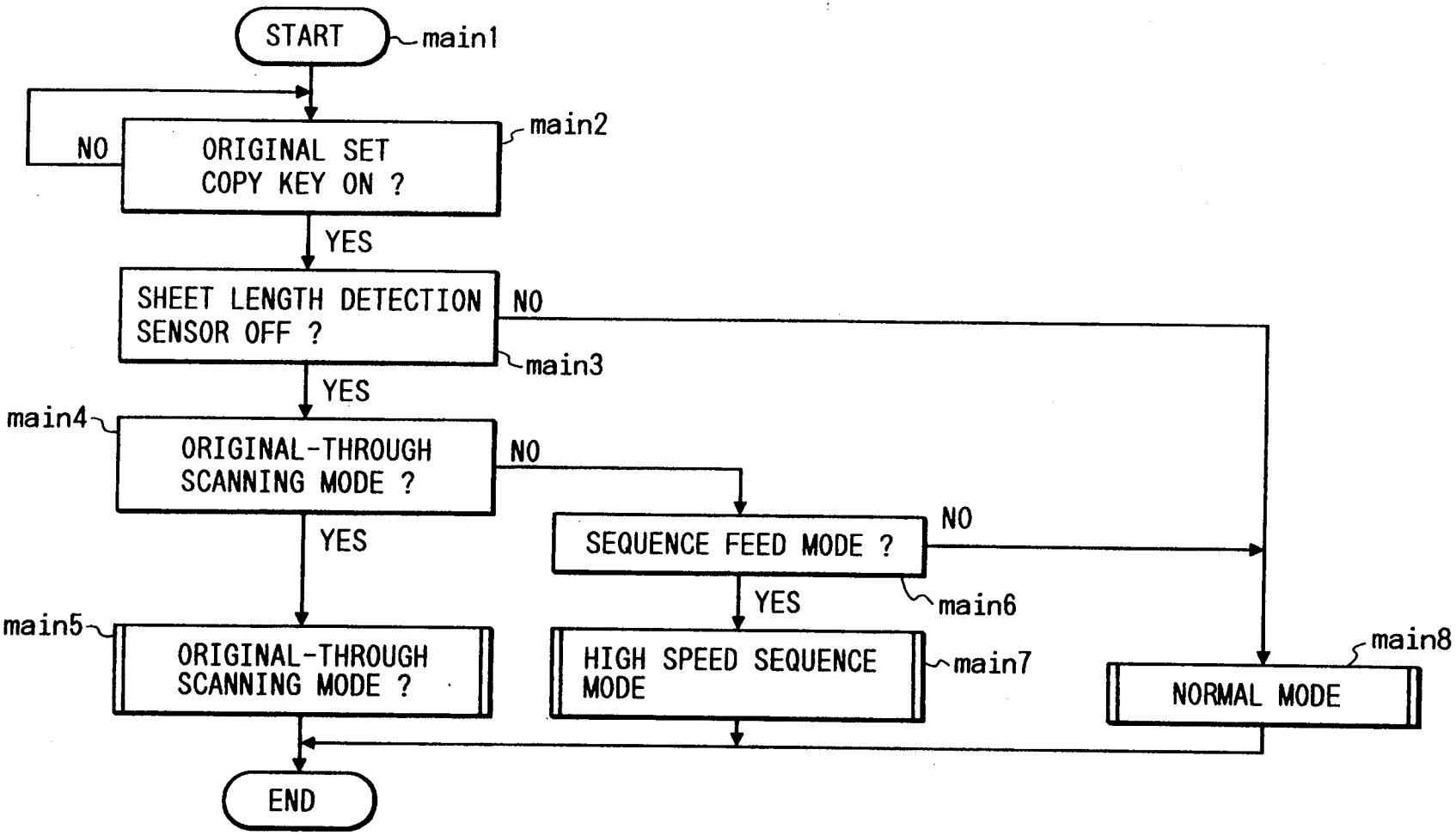
FIG. 23 is a main flow chart according to the automatic original feeding apparatus of the present invention.

Further, the communication of the control data is effected between the microcomputer 201 and the image forming system via a communication IC 202. The data to be received include original-through scanning data (v), original feeding mode data such as one-sided/both-sided/original-through scanning, original supply trigger, original exchange trigger and original discharge trigger, and the data to be sent include operation completion signals for original supply, original exchange and original discharge, detected original size data, last original signal indicating an end of the original stack (bundle), and image tip signal for the original-through scanning. Furthermore, a control sequence (control program) as shown in FIG. 23 and so on is previously stored in the ROM, and the various inputs and outputs are controlled on the basis of the control sequence.

Main Flow

Next, the operation of the original feeding apparatus will be explained with reference to a main flow shown in FIG. 23.

The first inlet sensor 23 detects whether the sheet originals are set or not. When the copy key on the operation portion of the image forming system is depressed (main 2), the operation is started (main 1). In this case, it is judged whether the sheet length sensor 68 is turned OFF (main 3). If affirmative (A4 size or LTR size), the copy mode fed from the image forming system is discriminated (main 4). If the original-through scanning mode is selected, the program goes to a main 5 where a series of copy treatments is effected with the original-through scanning mode which will be described later and the operation is finished.

In the main 3, if the negative is indicated (size other than A4 or LTR size), the program goes to a main 8 where a series of copy treatments are performed with a normal switch-back mode which will be described later. In the main 4, if negative (not original-through scanning mode), the program goes to a main 6 where it is judged whether it is possible to perform a high speed sequence mode wherein two sheet originals are rested on the platen and the copy treatment is effected regarding the two sheet originals simultaneously (in this embodiment, a one-sided original copy mode corresponds to the high speed sequence mode); if affirmative (high speed sequence mode), the program goes to a main 7 where a series of copy treatments is performed with the high speed sequence mode and then the operation is finished. In the main 6, if negative (not high speed sequence mode), the program goes to the main 8.

In this example, while the mode selection on the basis of the original size was regulated in the feeding direction by the ON/OFF of the sheet length detection sensor 68, as mentioned above, the mode selection on the basis of the original size may be regulated in combination with the above sheet length detection sensor and the original width detection means comprised of the slide volume (not shown) attached to the original tray.

Original-through Scanning Mode

Figure 24:
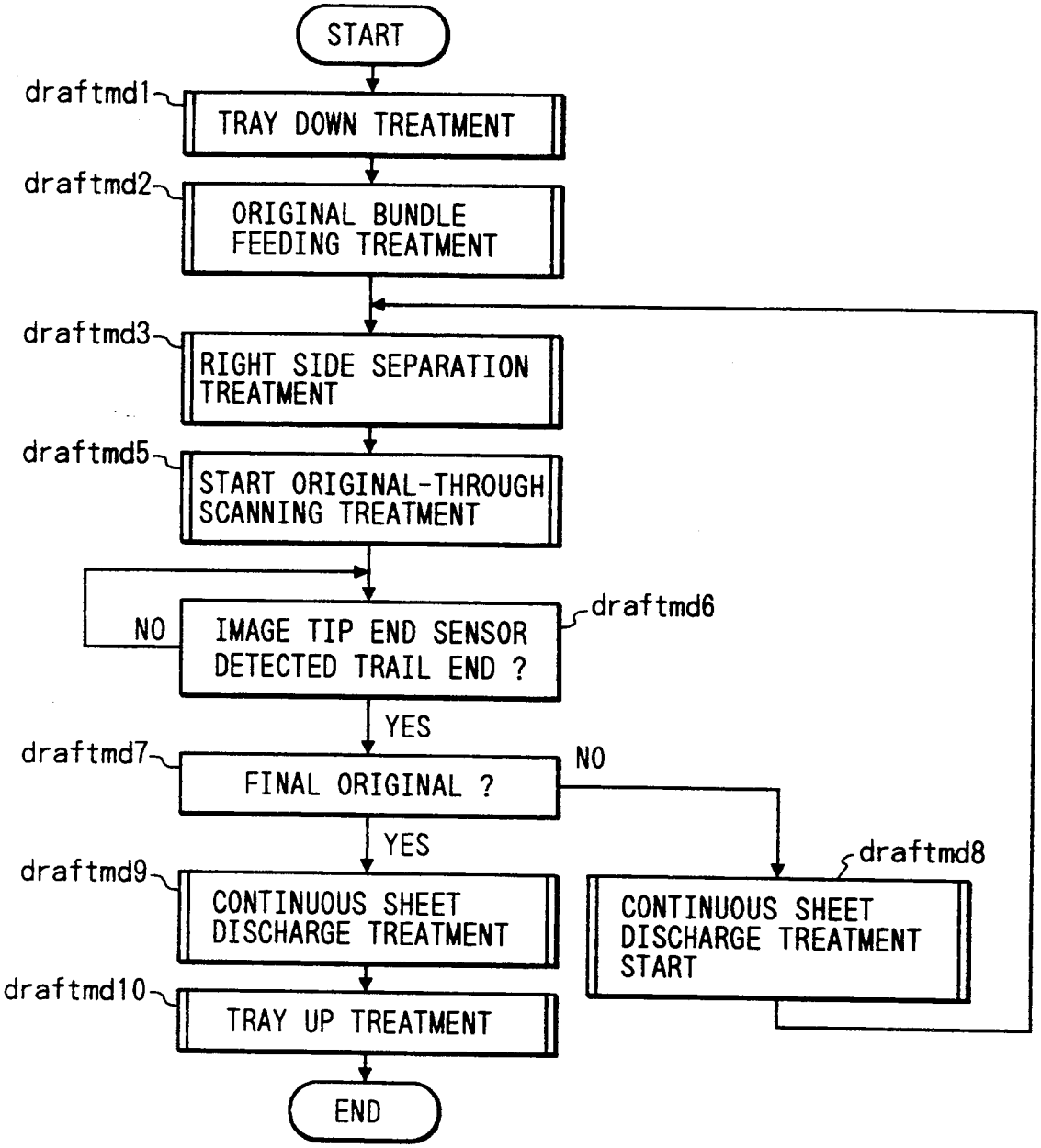
FIG. 24 is a flow chart for an original-through scanning mode.

Next, the original-through scanning mode will be explained with reference to FIG. 24.

A tray down treatment (described later) is effected to shift the original tray to the lower limit position (draftmd 1), and, further, an original bundle feeding treatment (described later) is effected to shift the original bundle (stack) to the right (draftmd 2). Thereafter, a right side separation treatment (described later) is effected to separate only the lowermost sheet original from the bundle (draftmd 3). Then, an original-through scanning treatment wherein the original image is read while fixing the optical system of the image forming system at the predetermined position is started (draftmd 5). Then, when the trailing end of the sheet original is detected by the image tip end sensor 18 (draftmd 6), the end of the original bundle is detected by the original partition sensor 121 (draftmd 7). If not final original, a continuous sheet discharge treatment (described later) is started to return the sheet original to the original tray (draftmd 8) and then the program returns to the draftmd 3, thus repeating the treatments.

On the other hand, in the draftmd 7, if the final original, a continuous sheet discharge treatment is effected (draftmd 9), and then a tray up treatment (described later) is effected to return the original tray to the upper limit position (draftmd 10), and the series of treatments are ended.

Figure 50:
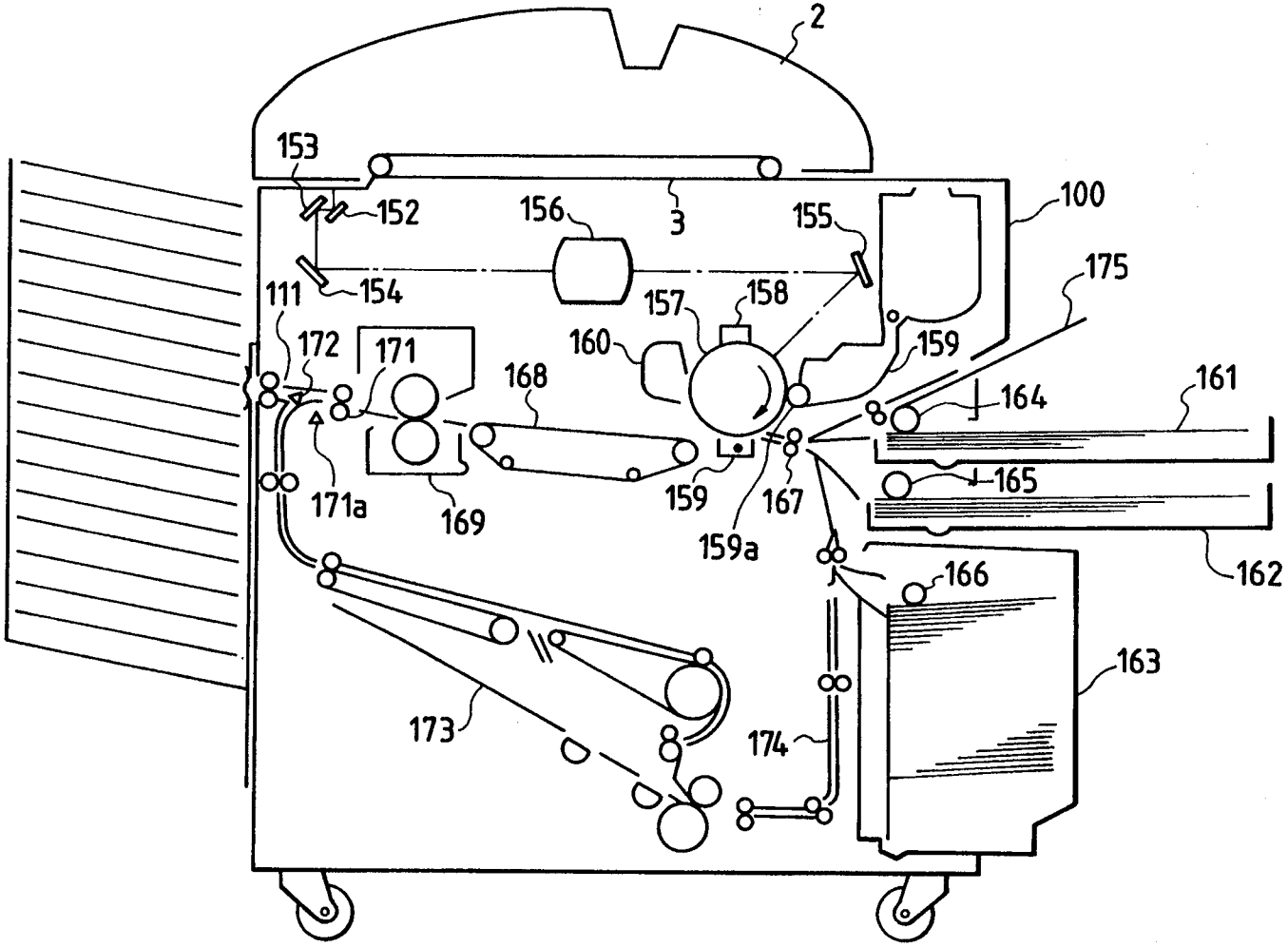
FIG. 50 is a general elevational sectional view of a copying machine to which the present invention is applied.

In this case, when a length of the sheet original in the feeding direction is l (mm), as shown by D″ in FIG. 4, the optical system 152 (which will be described later in more detail in connection with FIG. 50) of the image forming system is disposed at a downstream side (in the clockwise direction) of and separated from the relay rollers 17 by a distance greater than l (mm). The control of the position of the optical system may be effected by a conventional stepping motor or may be effected by a suitable mechanical stopper arrangement. Further, in this mode, the belt motor is always turned ON, thereby eliminating the variation in the belt shifting speed due to the building-up feature of the motor.

In this way, since the sheet original is fed only by the feeding force of the belt conveyor, it is possible to feed or shift the sheet original on the platen always at a constant speed, and, since the motor is always rotating at the steady state, when the image information is read by the optical system, the sheet original being shifted at the constant speed is read, thereby obtaining the good image without the image discrepancy, image elongation and/or image contraction.

High Speed Sequence Mode

Figure 25:
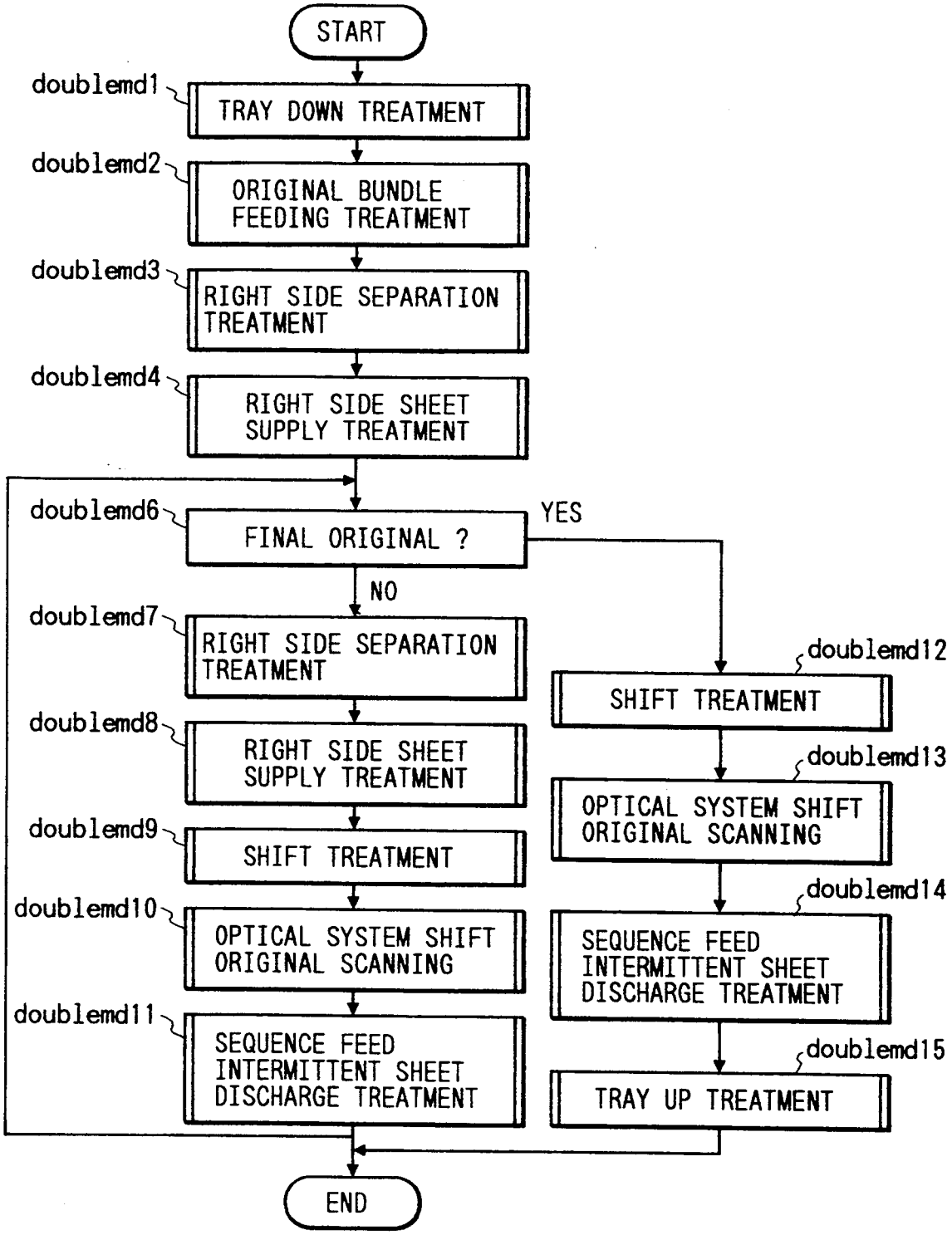
FIG. 25 is a flow chart for a high speed double feed mode.

Next, the high speed sequence mode (high speed double feed mode) will be explained with reference to FIG. 25.

A tray down treatment (described later) is effected to shift the original tray to the lower limit position (doublemd 1), and, further, an original bundle feed treatment (described later) is effected to shift the original bundle P to the right (doublemd 2). Thereafter, a right side separation treatment (described later) is effected to separate only the lowermost sheet original from the bundle (doublemd 3). Then, a right side sheet supply treatment is effected to rest the sheet original on the right end portion of the platen (doublemd 4). Thereafter, the end of the original bundle is detected by the original partition sensor 121 (doublemd 6). If not final original, the right side separation treatment (doublemd 7) and the right side sheet supply treatment (doublemd 8) are effected again, and then an original shift treatment is effected to shift the sheet original on the platen leftwardly and at the same time to rest a next sheet original (waiting in the vicinity of the relay rollers 17) on the right end portion of the platen (doublemd 9). Thereafter, an optical system shift original scanning treatment is effected to read the original image while shifting the optical system of the image forming system (doublemd 10). After this treatment is finished, an intermittent sheet discharge treatment is effected to return the sheet original to the original tray (doublemd 11), and then the program returns to the doublemd 6, thereby repeating the treatments.

On the other hand, in the doublemd 6, if the final original, the shift treatment is effected (doublemd 12) and then the optical system shift original scanning treatment is effected (doublemd 13). Thereafter, the double feed intermittent sheet discharge treatment is effected (doublemd 14), and then a tray up treatment (described later) is effected to return the original tray to the upper limit position (doublemd 15), and the series of treatments are ended.

Normal Switch-back Mode

Figure 26:
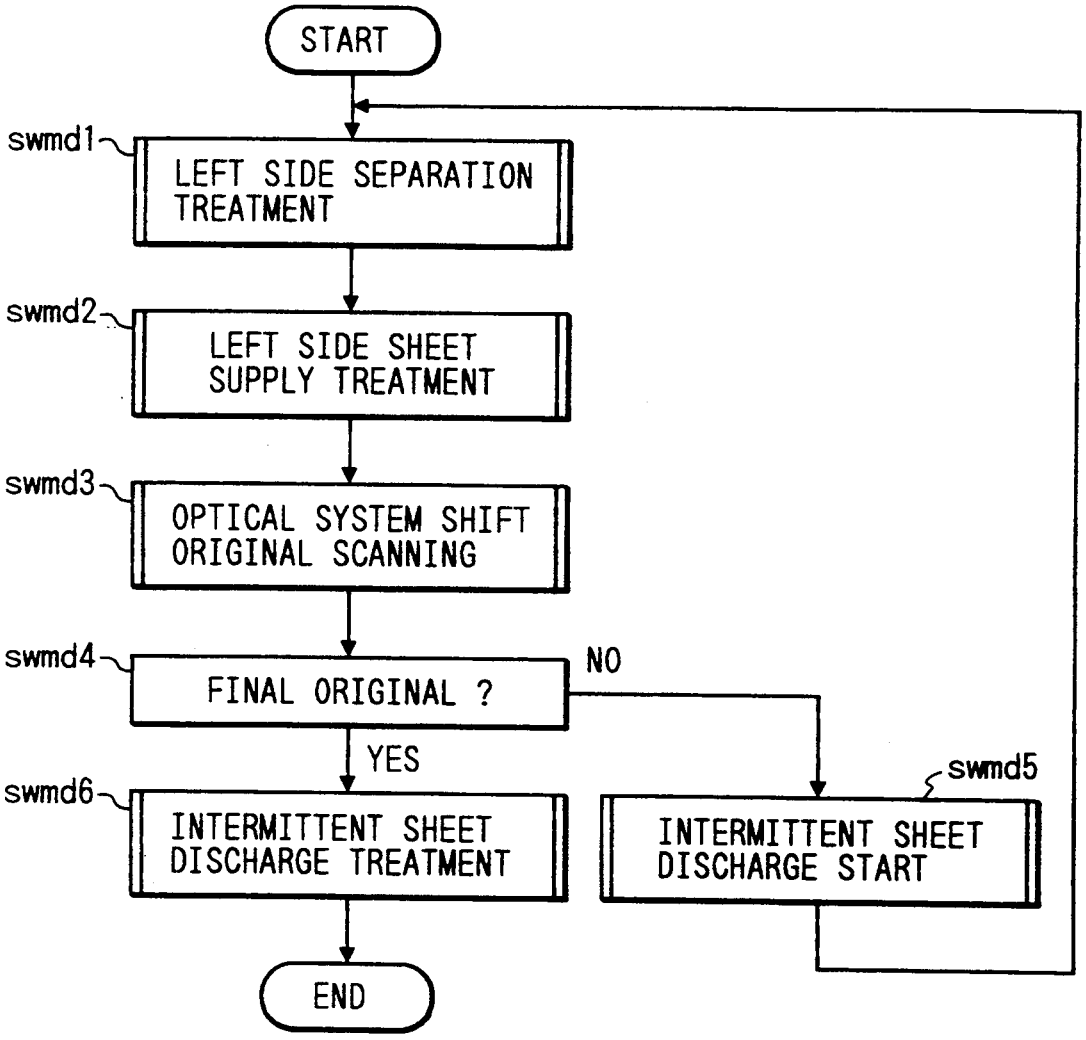
FIG. 26 is a flow chart for a normal switch-back mode.

Next, the normal switch-back mode will be explained with reference to FIG. 26.

A left side separation treatment (described later) is effected to separate the lowermost sheet original from the original bundle P (swmd 1). When this treatment is completed, a left side sheet supply treatment (described later) is effected to rest the sheet original on the platen (swmd 2). Thereafter, an optical system shift original scanning treatment is effected to scan the original image while shifting the optical system of the image forming system (swmd 3). Then, the end of the original bundle is detected by the original partition sensor 121 (swmd 4). If not final original, an intermittent sheet discharge treatment (described later) is started to return the sheet original to the original tray (swmd 5), and then the program returns to the swmd 1, thereby repeating the treatments. On the other hand, in the swmd 4, if the final original, the intermittent sheet discharge treatment is effected (swmd 6), and the series of treatments are ended.

Tray Up Treatment

Figure 27:
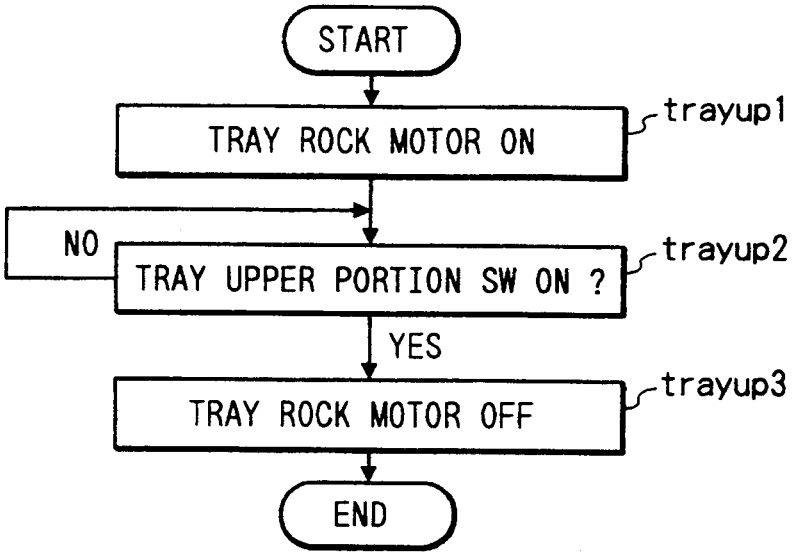
FIG. 27 is a flow chart for a tray UP treatment.

The tray up treatment by means of the RDF will be explained with reference to FIG. 27.

In order to lift the original tray up to the position shown in FIG. 1, the tray rock motor 107 is driven until the upper limit switch 51 is activated. When the upper limit switch 51 is activated, the tray rock motor 107 is stopped.

Tray Down Treatment

Figure 28:
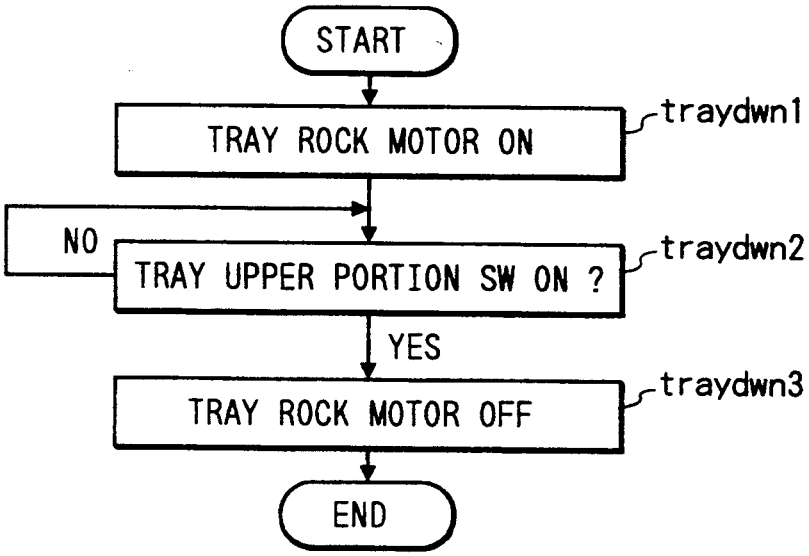
FIG. 28 is a flow chart for a tray DOWN treatment.

The tray down treatment by means of the RDF will be explained with reference to FIG. 28.

In order to lower the original tray up to the position shown in FIG. 2, the tray rock motor 107 is driven until the lower limit switch 52 is activated. When the lower limit switch 52 is activated, the tray rock motor 107 is stopped.

Bundle Feed Treatment

Figure 29:
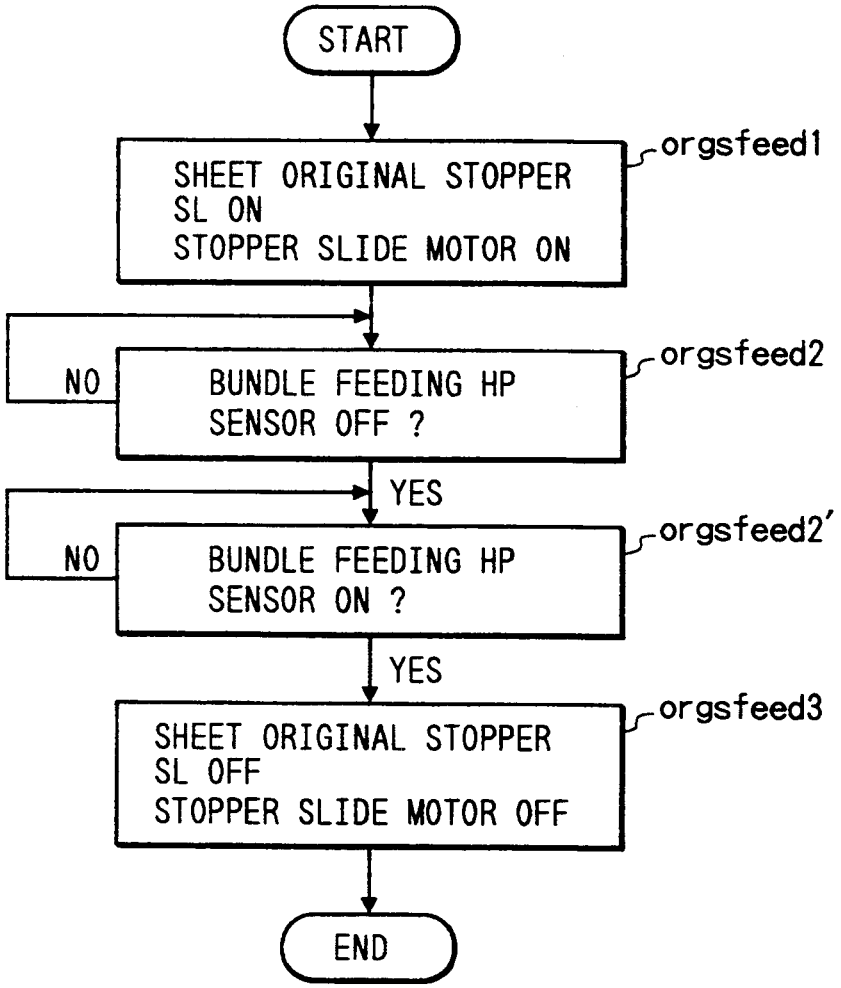
FIG. 29 is a flow chart for a stack shifting (bundle feeding) treatment.

The bundle feed treatment will be explained with reference to FIG. 29.

In the bundle feed treatment, the sheet original stopper solenoid 111 is turned ON to shift the original bundle on the original tray from the first sheet supply side to the second sheet supply side, and the stopper slide motor 106 is also turned ON (orgsfeed 1). Thereafter, as mentioned above, the original bundle is fed by the stopper unit by detecting ON/OFF of the original bundle home position sensor 45 (orgsfeed 2). Then, the sheet original stopper solenoid 111 and the stopper slide motor 106 are turned OFF, thereby finishing the treatment (orgsfeed 3).

Right Side Separation Treatment

Figure 30:
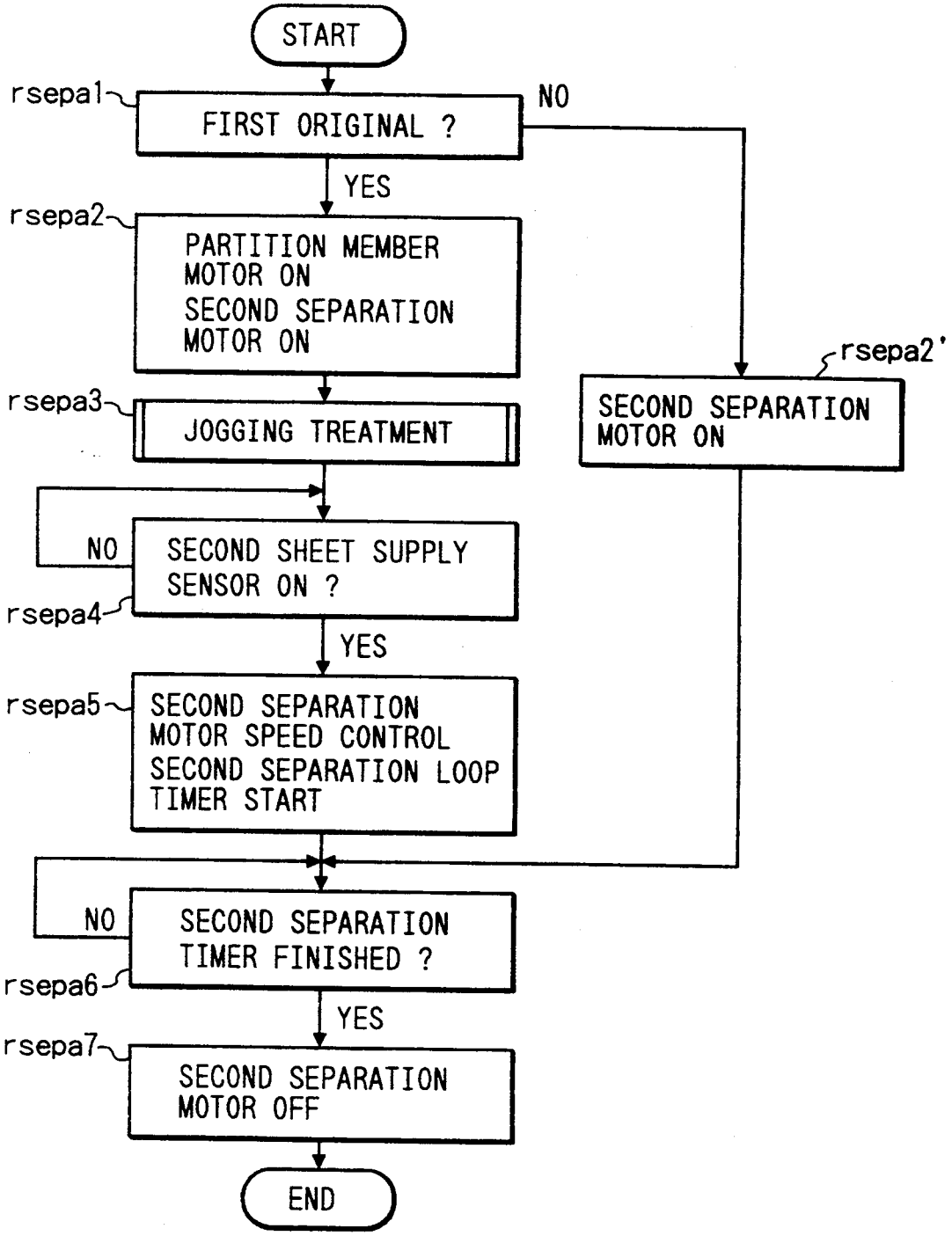
FIG. 30 is a flow chart for a right side separation treatment.

The right side separation treatment will be explained with reference to FIG. 30.

In the right side separation treatment, if the first original (rsepa 1), the partition member motor 105 is turned ON to drive the partition member for detecting the end of the original bundle P, and at the same time, the second separation motor 100 is also turned ON to treat the original bundle P (rsepa 2). Further, a jogging treatment (described later) is effected to effect the registration of the original bundle P in the widthwise direction (rsepa 3). Thereafter, when the jogging treatment is finished, the lowermost sheet original separated from the original bundle is passed through the sheet path (h). When the second sheet supply sensor detects the leading end of the sheet original (rsepa 4), the speed control for reducing the driving speed of the second separation motor 100 is effected, and a separation loop timer is started (rsepa 5). When the time set by the timer is elapsed (rsepa 6), the second separation motor 100 is turned OFF (rsepa 7), with the result that, since the leading end of the sheet original is abutted against the nip between the feed rollers at a low speed, it is possible to prevent the damage of the leading end of the sheet original and to reduce the collision noise. Further, when a predetermined loop is formed in the sheet original, the latter is stopped. In this way, even if the skew-feed of the sheet original occurs in the separation operation, such skew-feed is corrected.

Right Sheet Supply Treatment

Figure 31:
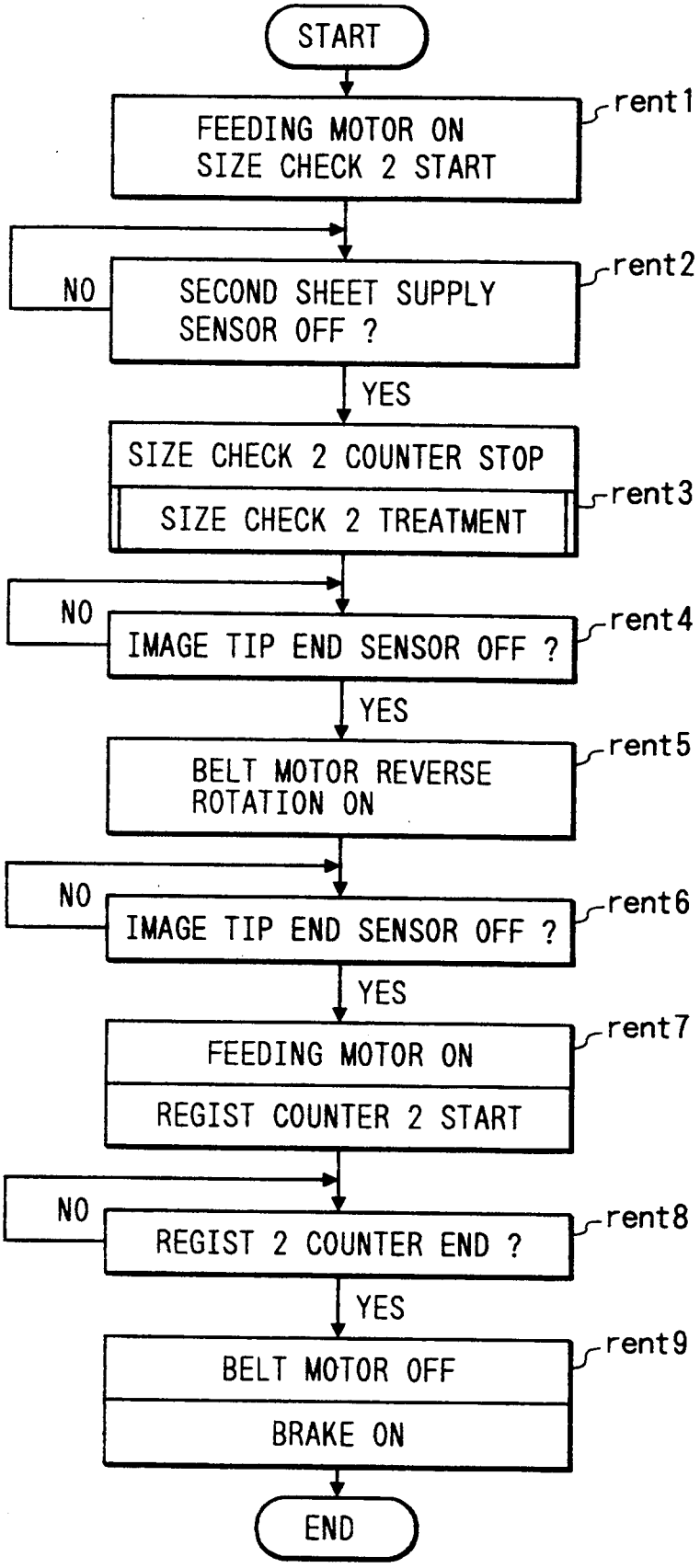
FIG. 31 is a flow chart for a right side sheet supply treatment.

The right sheet supply treatment will be explained with reference to FIG. 31.

In the right sheet supply treatment, the convey motor 104 is turned ON to drive the pair of feed rollers 16 and the pair of relay rollers 17 and to convey the sheet original from the sheet path (h) to the sheet path (i), and at the same time, a size check 2 counter capable of counting on the basis of the clock signals from the convey motor 104 is started (rent 1). At the same time when the trailing end of the conveyed sheet original has passed through the second sheet supply sensor 30 (rent 2), the size 2 check counter is stopped (rent 3). The original size is discriminated by a size check 2 treatment (FIG. 39) on the basis of the data of the counter. Then, when the leading end of the sheet original is detected by the image tip end sensor 18 (rent 4), the belt motor reverse rotation is ON to feed the sheet original to the sheet path (k). When the trailing end of the sheet original is detected by the image tip end sensor 18 (rent 6), a regist 2 counter capable of counting on the basis of belt clock 102 to turn the convey motor 104 OFF and to stop the sheet original at the predetermined position on the platen (where the trailing end of the sheet original coincides with the position D' in FIG. 4) is started (rent 7). When the regist 2 counter is ended (rent 8), the belt motor is turned OFF and the brake is turned ON, thereby stopping the sheet original with high accuracy (rent 9).

Shift Treatment

Figure 32:
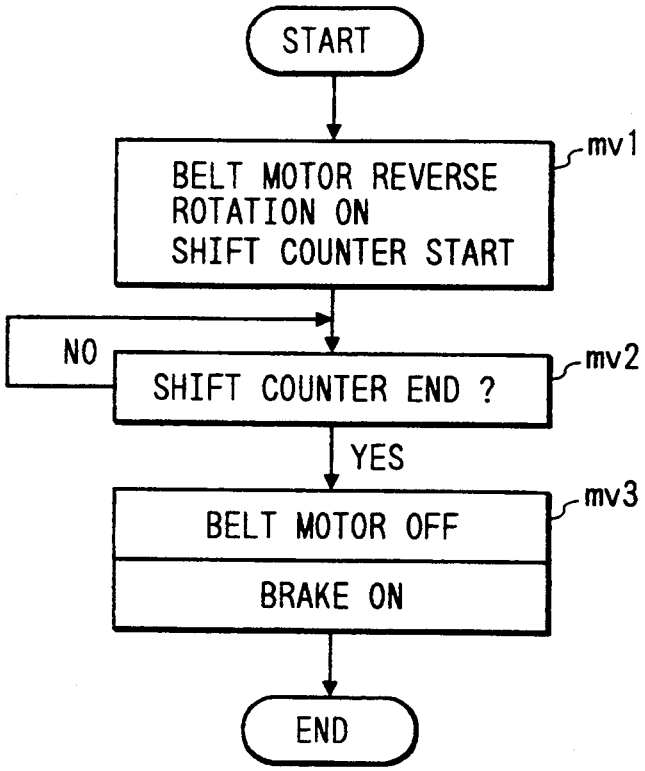
FIG. 32 is a flow chart for a shift treatment.

The shift treatment will be explained with reference to FIG. 32.

In the shift treatment, the belt motor 112 is turned ON reversely to drive the wide belt 7 and to shift the sheet original in the sheet path (k), (d), and a shift counter capable of counting on the basis of the belt clock 102 to stop the sheet original at the predetermined position on the platen is started (mv 1). When the shift counter ended (mv 2), the belt motor is turned OFF and the brake is turned ON, thereby stopping the sheet original with high accuracy (my 3).

In this case, when the length of the sheet original in the feeding direction is l (mm), a distance between the high speed double feed reference rest position (D') and the leading end of the waiting next sheet original is l gap (mm) (FIG. 4) and a distance between the original fixing rest reference position (D) (where the original scanning is effected while stopping the leading end of the sheet original at the position D) and the high speed double feed reference rest position (D') is L (mm) (FIG. 4), the shift amount obtained by the shift counter can be indicated by the following equation:

$$\textit{Shift amount}\ \Delta = L-(2\times l+lgap).$$

The above equation regarding the shift amount of the shift counter will be explained in mode detail. In the original treatment in this mode, the distance between the sheet originals is adjusted by the relay rollers 17 (although not described in detail in the specification, the paled relay rollers serve like as regist rollers). That is to say, when the trailing end of the first sheet original is positioned at the position D' by shifting the first original by the predetermined clocks after the sheet original has been detected by the image tip end sensor 18, the next sheet original is previously shifted until the leading end of the next sheet original reaches the relay rollers 17 (while stopping the first sheet original) (or, the next sheet original is waited at a position where the leading end of the next sheet original is protruded from the nip between the relay rollers by predetermined clocks, but not exceeding the image tip end sensor 18).

In this point, the distance between the leading end of the next sheet original and the position D' is l gap (mm). When the distance l gap between the first sheet original and the next sheet original is adjusted, the sheet originals are shifted with the control for driving the wide belt 7 and the relay rollers 17 at the same peripheral speed, and, when the trailing end of the next sheet original is positioned at the position D', the sheet originals are stopped. In this case, since the distance between the first sheet original and the next sheet original is l gap, a distance between the leading end of the first sheet original and the trailing end of the next sheet original becomes (2×l+l gap).

The sheet originals are shifted by the shift counter amount to slightly shift the sheet originals so that the leading end of the first sheet original coincides with the position D. Accordingly, the shift amount of the shift counter beocmes L−(2×l+l gap).

Thereafter, this operation is repeated regarding any two adjacent sheet originals until the copying operation is finished.

Double Feed Intermittent Sheet Discharge Treatment

Figure 33:
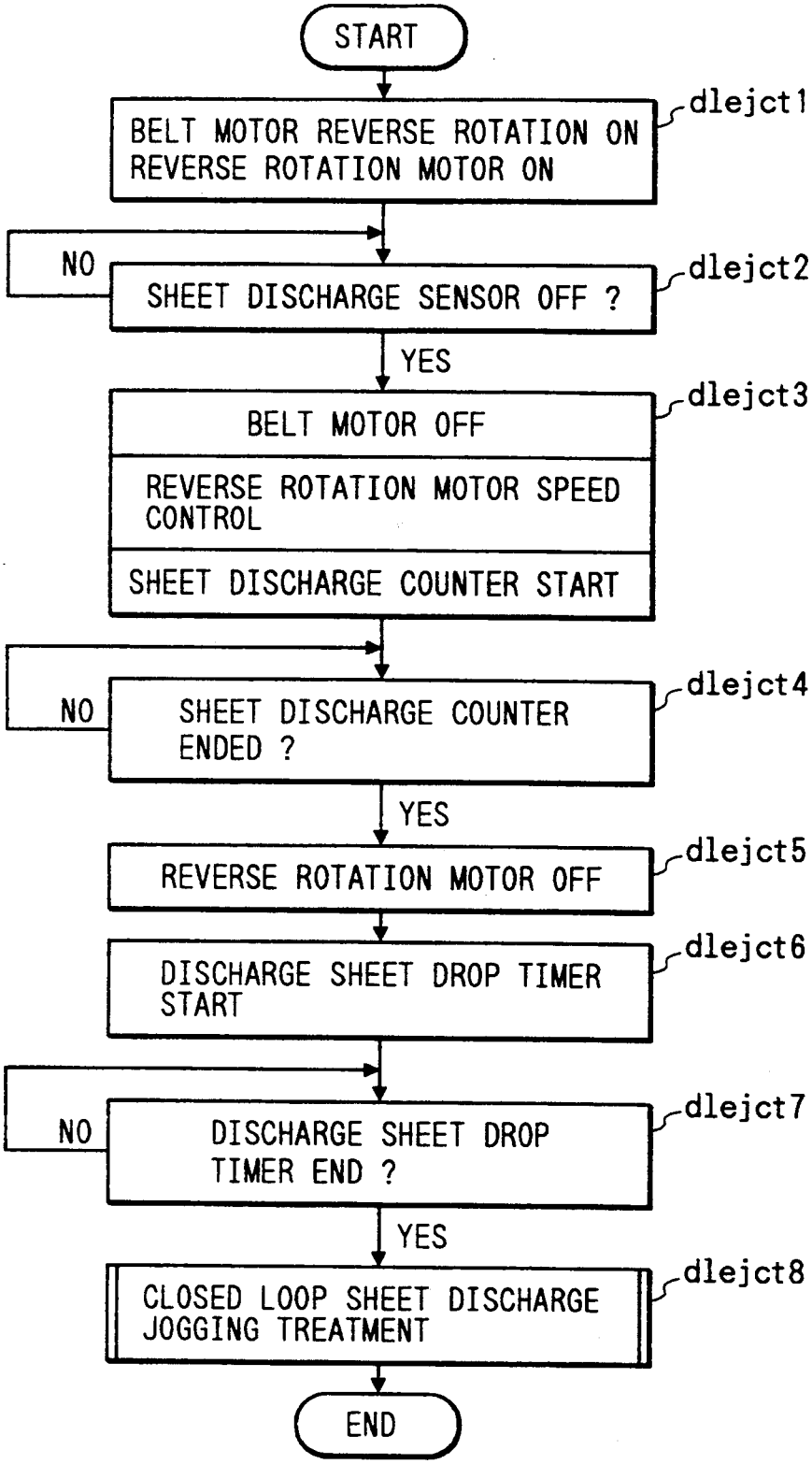
FIG. 33 is a flow chart for a double feed intermittent sheet discharge treatment.

The double feed intermittent sheet discharge treatment will be explained with reference to FIG. 33.

In the double feed intermittent sheet discharge treatment, the belt motor 112 is turned ON reversely to discharge the sheet original from the platen, and the reverse rotation motor is turned ON to convey the sheet original from the sheet path (d) to the sheet path (f) (dlejct 1). When the trailing end of the sheet original is detected by the sheet discharge sensor 27 (dlejct 2), the belt motor is turned OFF, and a sheet discharge counter for determining a distance for discharging the sheet original onto the original tray is started while controlling the speed of the reverse rotation motor 101 to ensure the registration of the discharged sheet original (dlejct 3). When the sheet discharge counter is ended (dlejct 4), the reverse rotation motor 101 is turned OFF (dlejct 5), and a discharge sheet drop timer for ensuring the interval until the sheet original is dropped on the original tray is started (dlejct 6). When the timer is ended (dlejct 7), a closed-loop sheet discharge jogging treatment is effected to effect the registration of the discharged sheet original (dlejct 8), and the double feed intermittent sheet discharge treatment is ended.

Original-through Scanning Treatment

Figure 34:
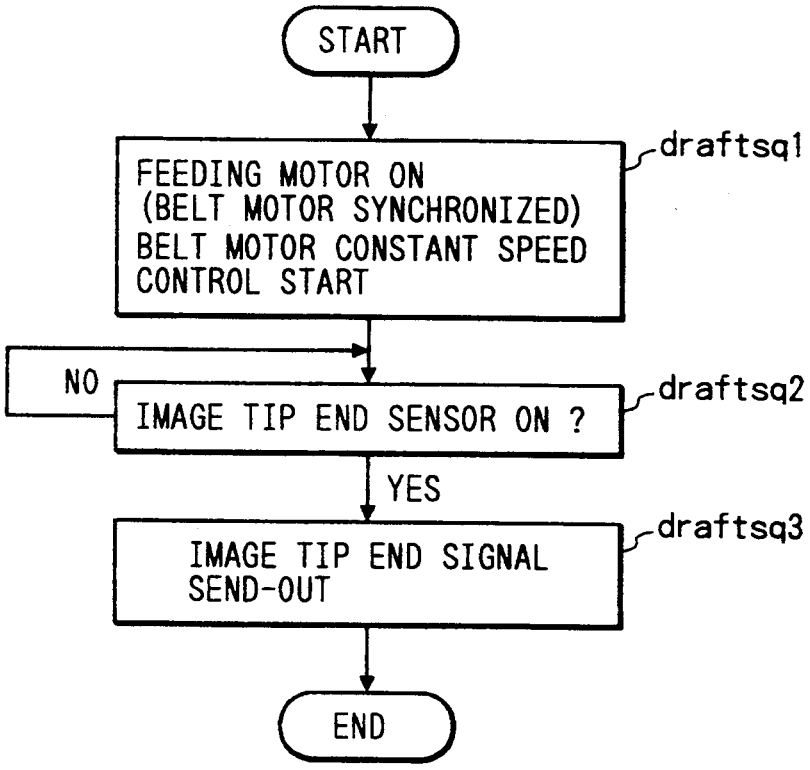
FIG. 34 is a flow chart for an original-through scanning treatment.

The original-through scanning treatment will be explained with reference to FIG. 34.

In the original-through scanning treatment, the convey motor 104 is turned ON in synchronous with the speed of the belt motor 112 (for effecting the original-through scanning) to read image on the sheet original by the fixed optical system of the image forming system, and at the same time, the constant speed control for the belt motor 112 is started by outputting the reference signal on the basis of the original-through scanning speed data (v) sent from the image forming system to the PLL circuit (draftsq 1). Thereafter, at the same time when the leading end of the sheet original is detected by the image tip end sensor 18 (draftsq 2), an image tip end signal is sent to the image forming system (draftsq 3), and the treatment is ended. After the image tip end signal is received, the image forming system performs the operation control for calculating a time until the leading end of the sheet original reaches the fixed optical system, and performs the actual original-through scanning.

Regarding the second original sheet and so on, a control is effected (FIGS. 52A and 52B) so that a copy sheet-to-copy sheet distance (time between the end of the first sheet supply and the start of the second sheet supply) in the original-through scanning becomes smaller than a copy sheet-to-copy sheet distance in the original-stationary scanning in the image forming system and the distance between the sheet originals is determined in registration with the copy sheet-to-copy sheet distance.

Consequently, for example, when the copy sheet-to-copy sheet distance in the original-through scanning is half of the copy sheet-to-copy sheet distance $T_1$ and the copying speed of the image forming system in the "1 to 1" copy formation regarding the A4 size original is Ncpm, the copying speed is increased by $\{(\frac{1}{2})T_1 \times N\}$. Accordingly, the copying machine having Ncpm can be operated at a high copying speed of N'cpm ($N' > N$).

Thus, a copying machine having 100% productivity in the "1 to 1" copy formation regarding the A4 size original will have the productivity more than 100%.

Figure 51:
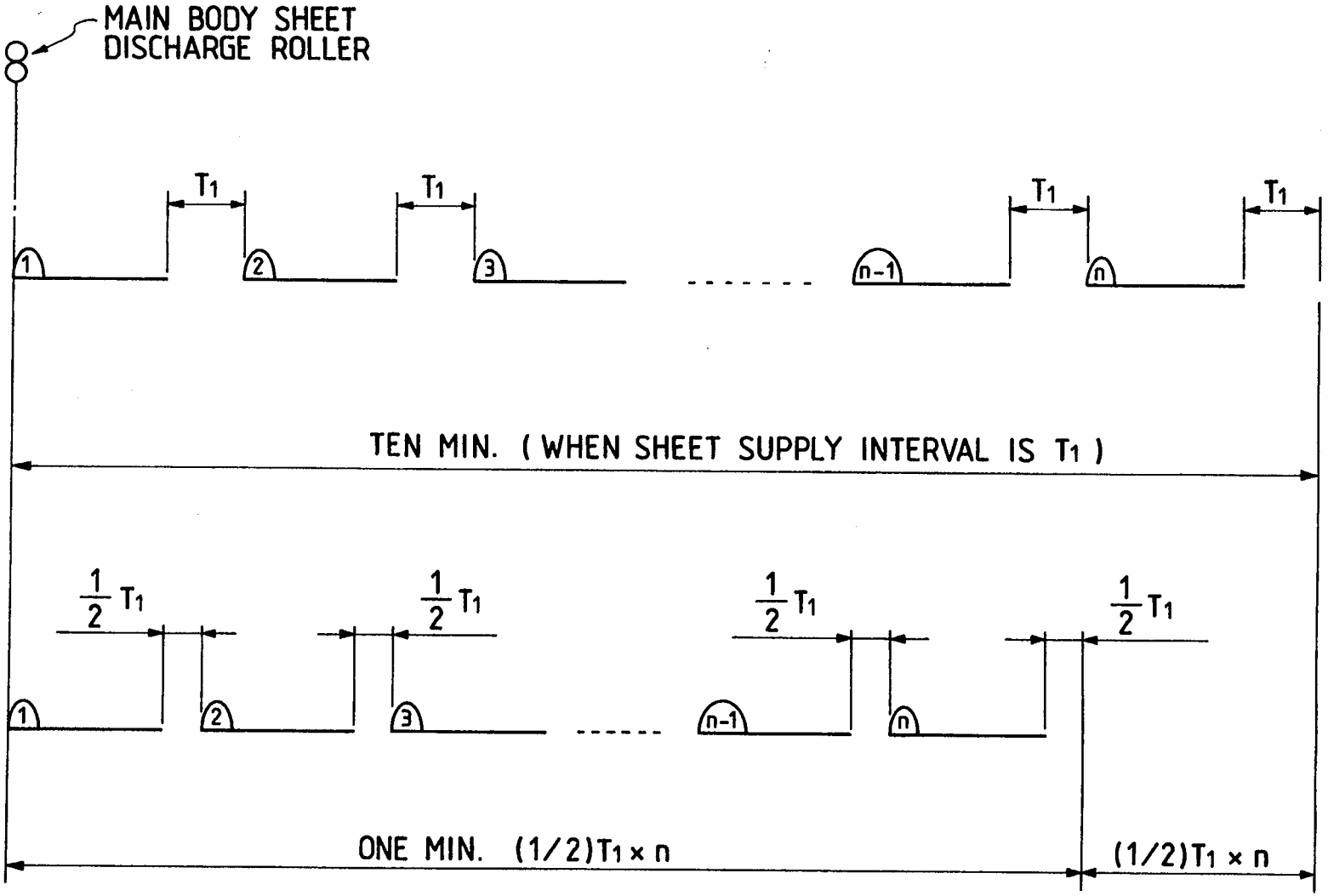
FIG. 51 is a timing chart showing a distance between the sheets to be supplied.

Explaining in more detail, the copying speed Ncpm is defined by the number of copies discharged for one minute after a leading end of the copy sheet (transfer sheet) reaches the discharge rollers. That is to say, as shown in FIG. 51, when the copy sheet-to-copy sheet distance $T_1$ is reduced to $\frac{1}{2}$, since the distance between the transfer sheets is decreased to $\frac{1}{2}$, the time required for discharging N sheets is shortened by the reduction of the distance between the sheets.

Figure 52A:
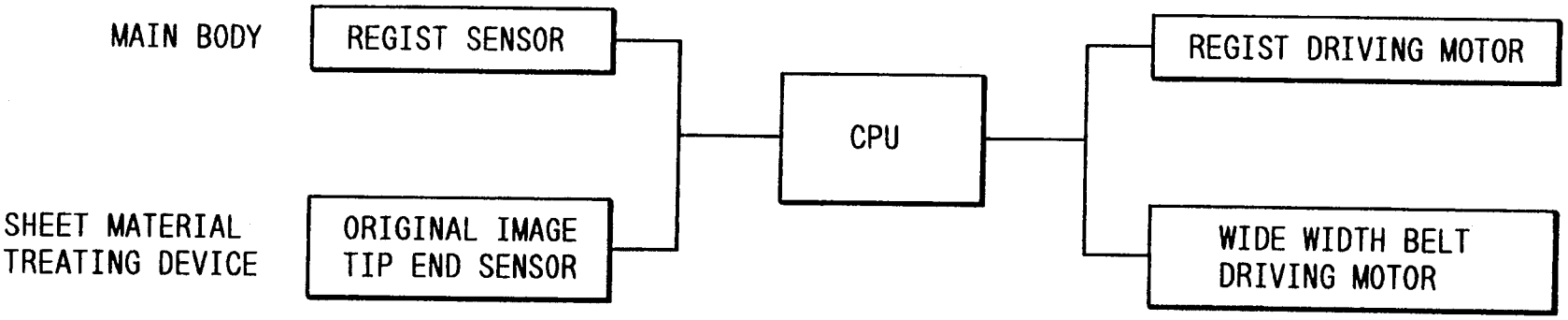
FIGS. 52A and 52B are block diagrams, where
Figure 52B:
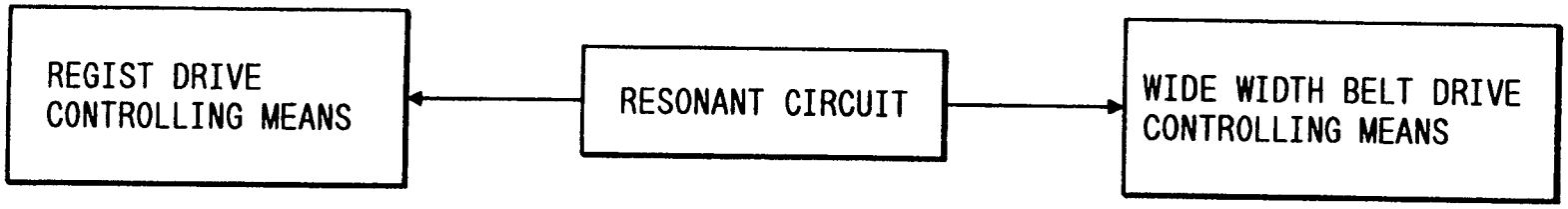
Figure 53A:
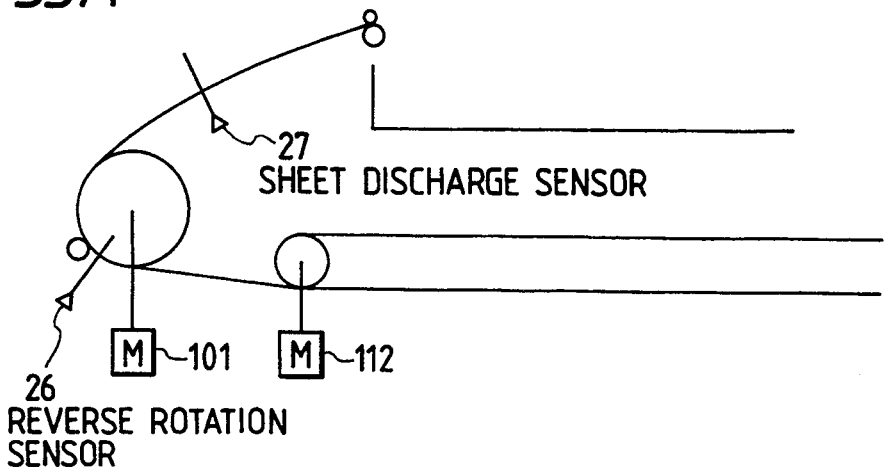
FIGS. 53A to 53E are schematic views showing the movement of the sheet original.
Figure 53B:
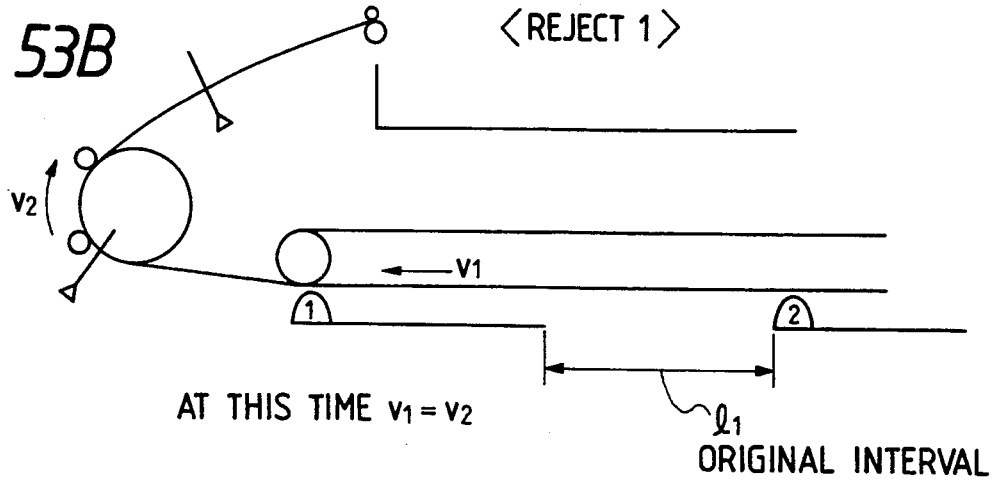
Figure 53C:
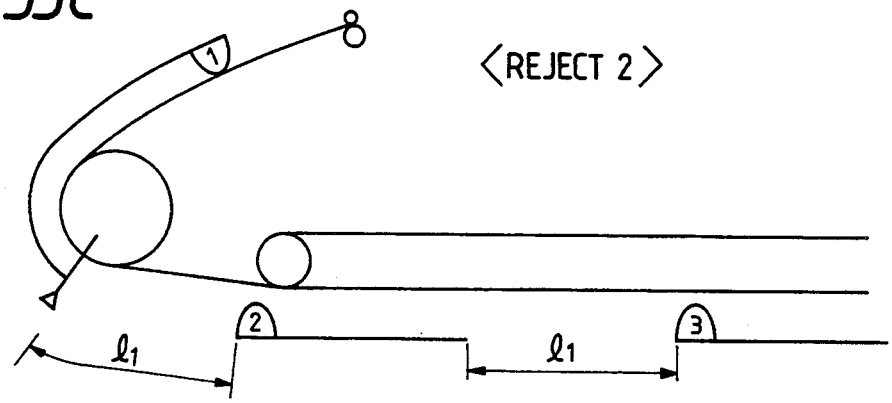
Figure 53D:
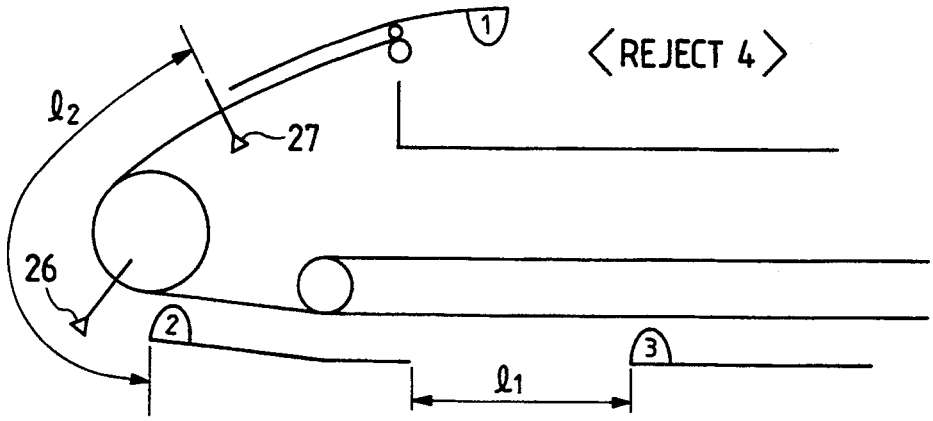
Figure 53E:
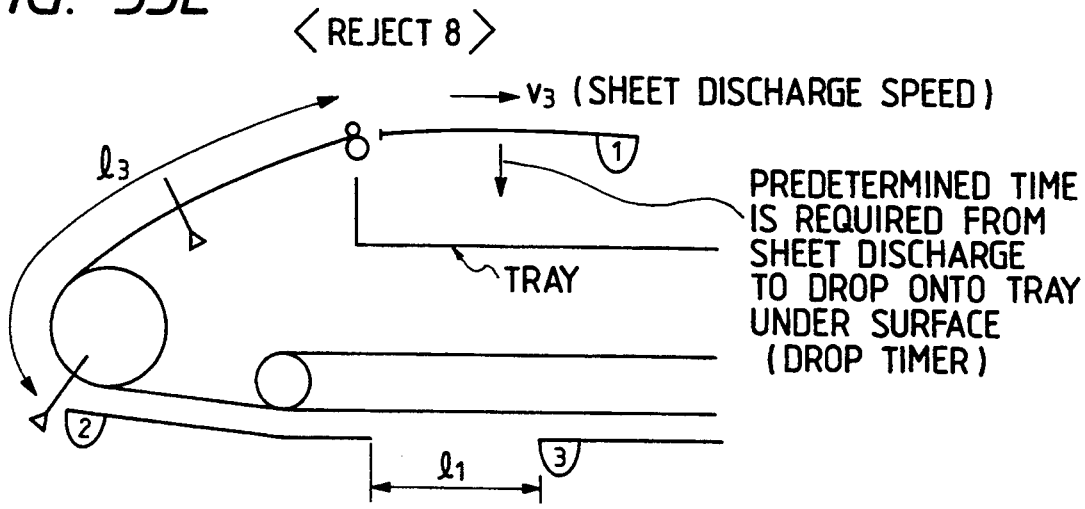

In order to regist the tip end of the image with the end of the transfer sheet, it is required for providing means for coinciding the copy sheet-to-copy sheet distance with the distance between the sheet originals and coinciding the handling speed for the transfer sheet with that for the sheet original (in the same magnification). In the illustrated embodiment, a synchronization circuit is provided so that a regist drive means of the image forming system is controlled in synchronous with the wide belt drive means of the RDF (FIG. 52B). FIG. 52A shows a block diagram of I/O for effecting the synchronization.

Further, the aforementioned original-through scanning data (v) may be equal to or different from the reading speed (v1) of the shifting optical system. Particularly, when it is selected to $v > v1$, since the reading of the original image is finished faster than the normal reading of the shifting optical system, the copying speed is increased by using the original feeding apparatus according to the present invention.

Continuous Sheet Discharge Treatment

Figure 35:
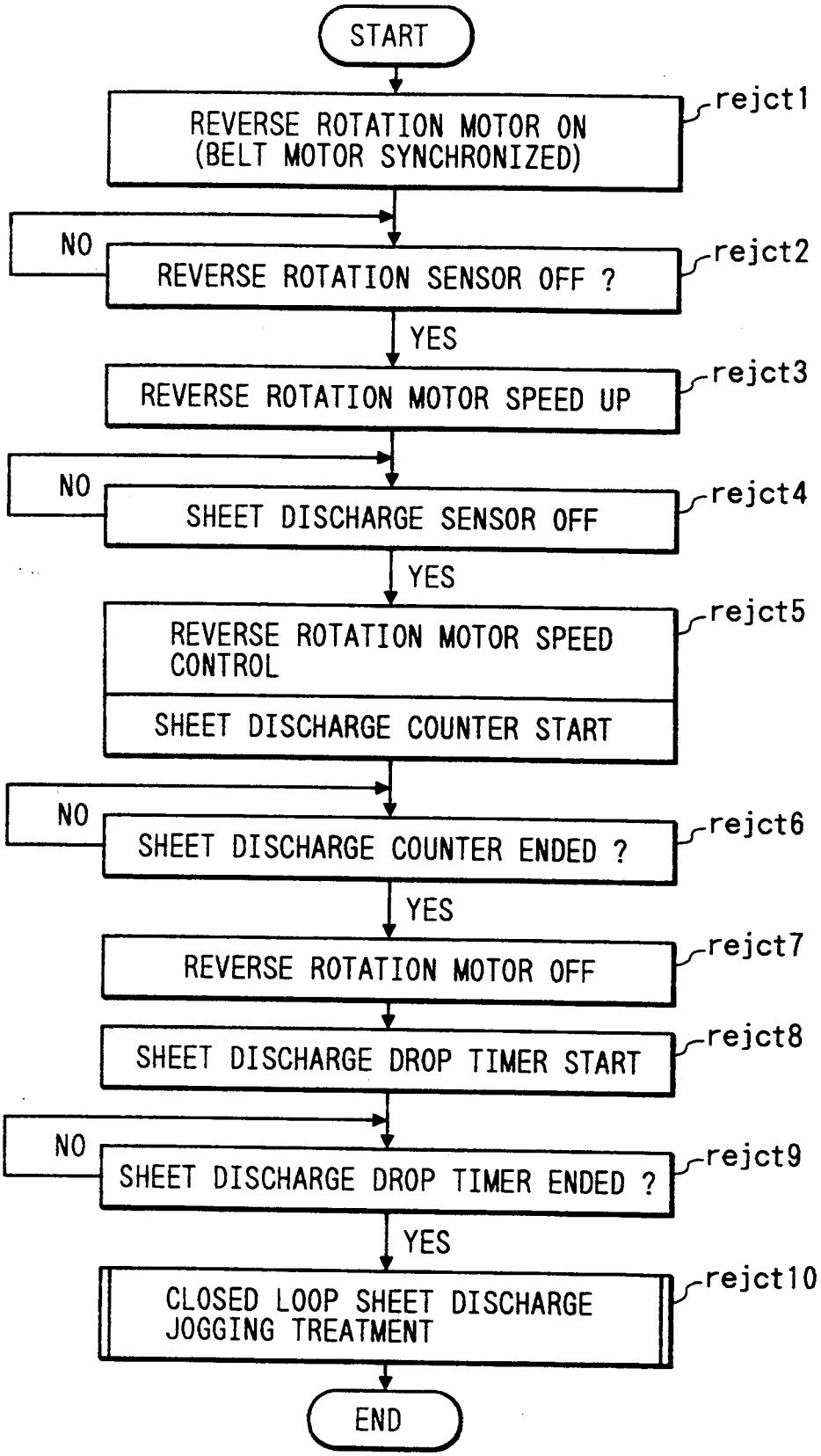
FIG. 35 is a flow chart for a continuous sheet discharge treatment.

The continuous sheet discharge treatment will be explained with reference to FIG. 35.

In the continuous sheet discharge treatment, the reverse rotation motor 101 is turned ON in synchronous with (at the same speed as) the speed of the belt motor 112 effecting the original-through scanning to discharge the sheet original from the platen (rejct 1). Then, when the trailing end of the sheet original is detected by the reverse rotation sensor 26 (rejct 2), the speed of the reverse rotation motor 101 is increased at the maximum to ensure the distance between the sheet original and the next sheet original (rejct 3). When the trailing end of the sheet original conveyed from the sheet path (d) to the sheet path (f) is detected by the sheet discharge sensor 27 (rejct 4), a sheet discharge counter for determining a distance for discharging the sheet original onto the original tray is started (rejct 5), while controlling the speed of the reverse rotation motor to ensure the registration of the discharged sheet original. When the sheet discharge counter is ended (rejct 6), the reverse rotation motor 101 is turned OFF (rejct 7), and a sheet discharge drop timer for providing the interval until the sheet original is dropped on the original tray is started (rejct 8). When the timer is ended (rejct 9), a closed-loop sheet discharge jogging treatment is effected (rejct 10) to effect the registration of the discharged sheet original, and the continuous sheet discharge treatment is ended.

Left Separation Treatment

Figure 36:
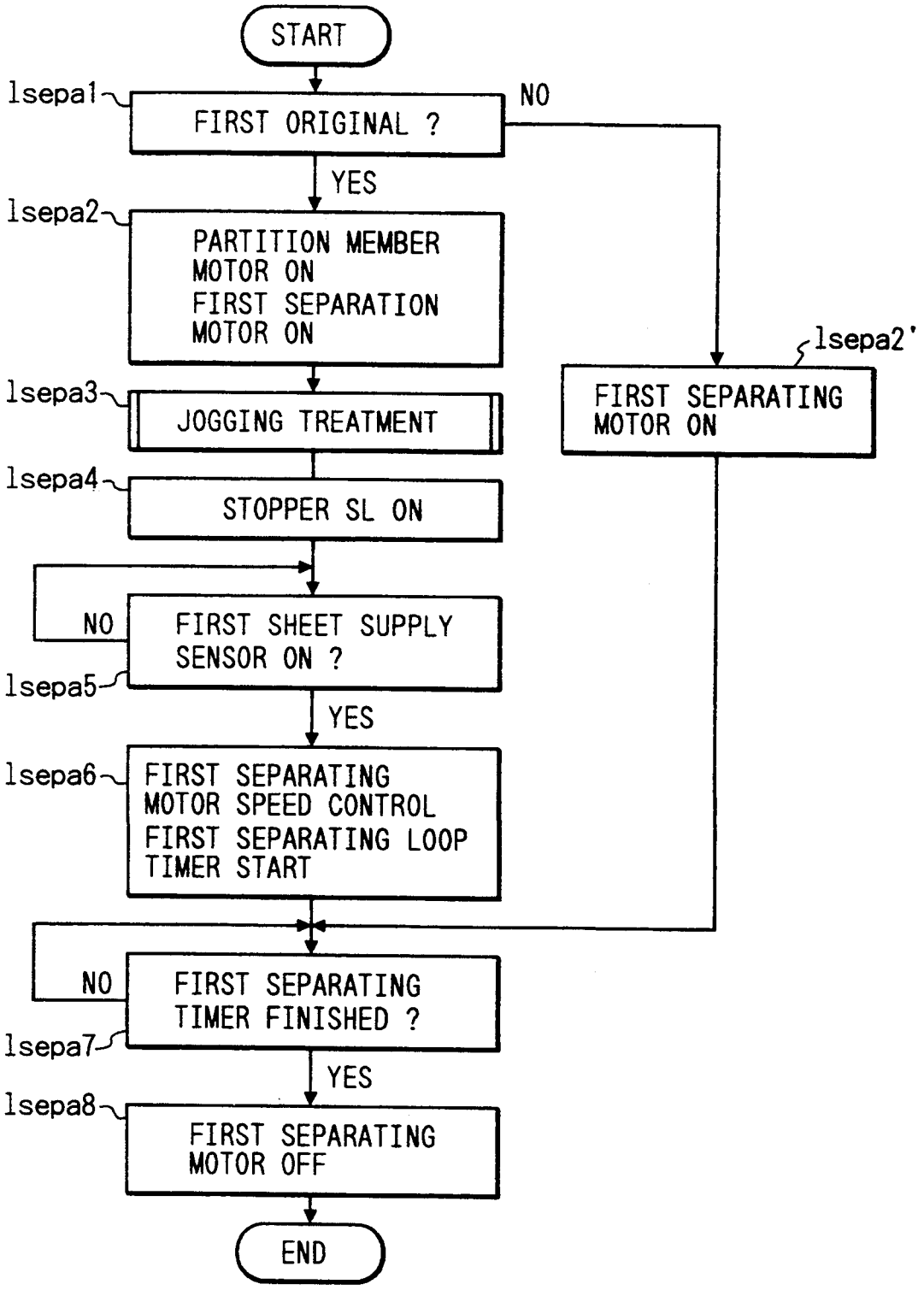
FIG. 36 is a flow chart for a left side separation treatment.

The left separation treatment will be explained with reference to FIG. 36.

In the left separation treatment, if the first original (lsepa 1), the partition member motor 105 is turned ON to drive the partition member for detecting the end of the original bundle P, and at the same time, the first separation motor 100 is turned ON to handle the original bundle P (lsepa 2). Then, a jogging treatment (described later) is effected to effect the registration of the original bundle P in the widthwise direction (lsepa 3). Thereafter, when the jogging treatment is finished, the stopper solenoid 108 is turned ON to lower the sheet supply stopper, thereby permitting the separation of only the lowermost sheet original from the original bundle (lsepa 4). When the leading end of the sheet original passing through the sheet path (a) is detected by the first sheet supply sensor 25 (lsepa 5), the speed control for reducing the speed of the first separation motor 100 is started and a first separation loop timer is started (lsepa 6). When the timer is ended (lsepa 7), the first separation motor 100 is turned OFF (lsepa 8), so that, since the leading end of the sheet original is abutted against the nip between the feed rollers at a low speed, it is possible to prevent the damage of the leading end of the sheet original and to reduce the collision noise. The sheet original is stopped when the predetermined loop is formed therein. In this way, even when the skew-feed occurs in the separation operation, such skew-feed can be corrected.

Left Sheet Supply Treatment

Figure 37:
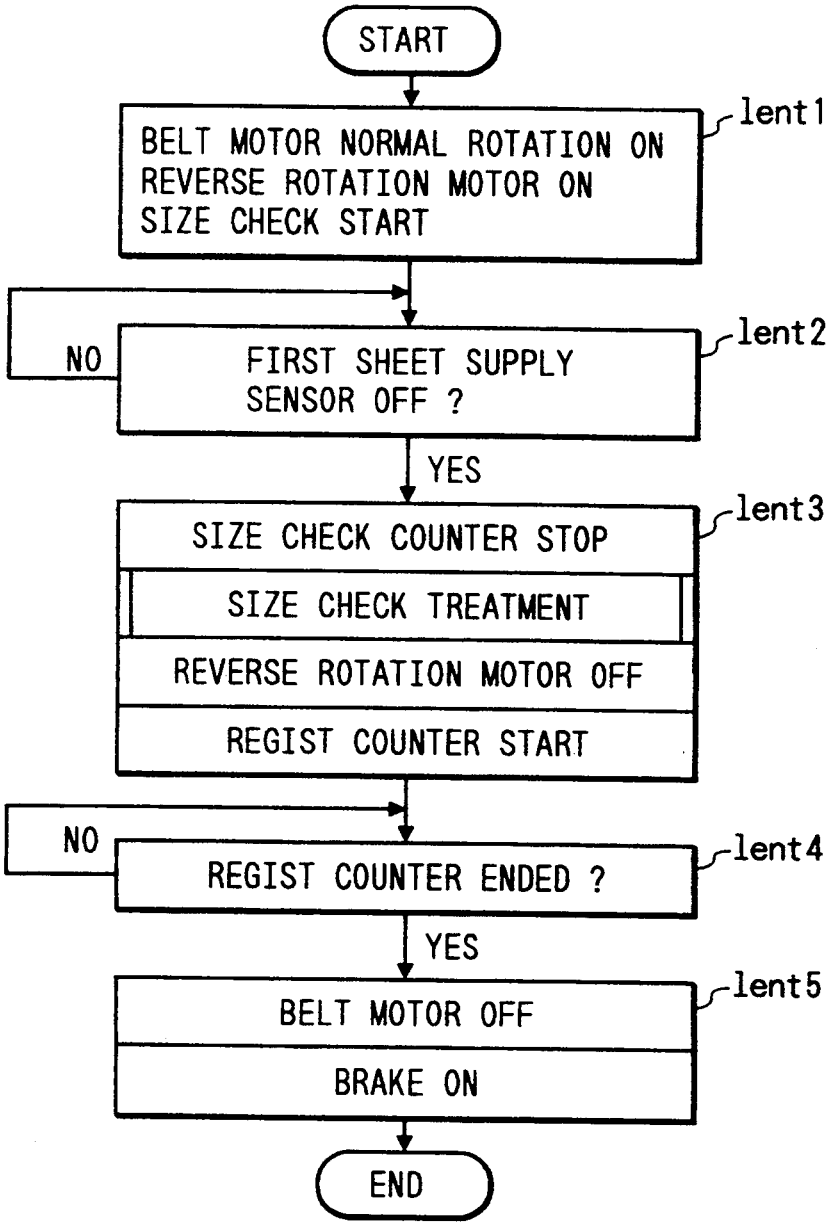
FIG. 37 is a flow chart for a left side sheet supply treatment.

The left sheet supply treatment will be explained with reference to FIG. 37.

In the left sheet supply treatment, the belt motor 112 is turned ON normally to drive the paired feed rollers and the wide belt and to convey the sheet original from the sheet path (a) to the sheet path (c), and the reverse rotation motor is turned ON, and at the same time, a size check counter capable of counting on the basis of clock signals from the reverse rotation clock 101 is started (lent 1). At the same time when the trailing end of the conveyed sheet original has just passed through the first sheet supply sensor 25 (lent 2), the size check counter is stopped (lent 3), and the original size is determined with a size check treatment (FIG. 40) on the basis of the data of the counter, and, further, a regist counter capable of counting on the basis of the belt clock 102 is started to stop the sheet original at the predetermined position on the platen (where the trailing end of the sheet original coincides with the position D in FIG. 4) (lent 3). When the regist counter is ended (lent 4), the belt motor is turned OFF and the brake is turned ON, thereby stopping the sheet original with high accuracy (lent 5).

Intermittent Sheet Discharge Treatment

Figure 38:
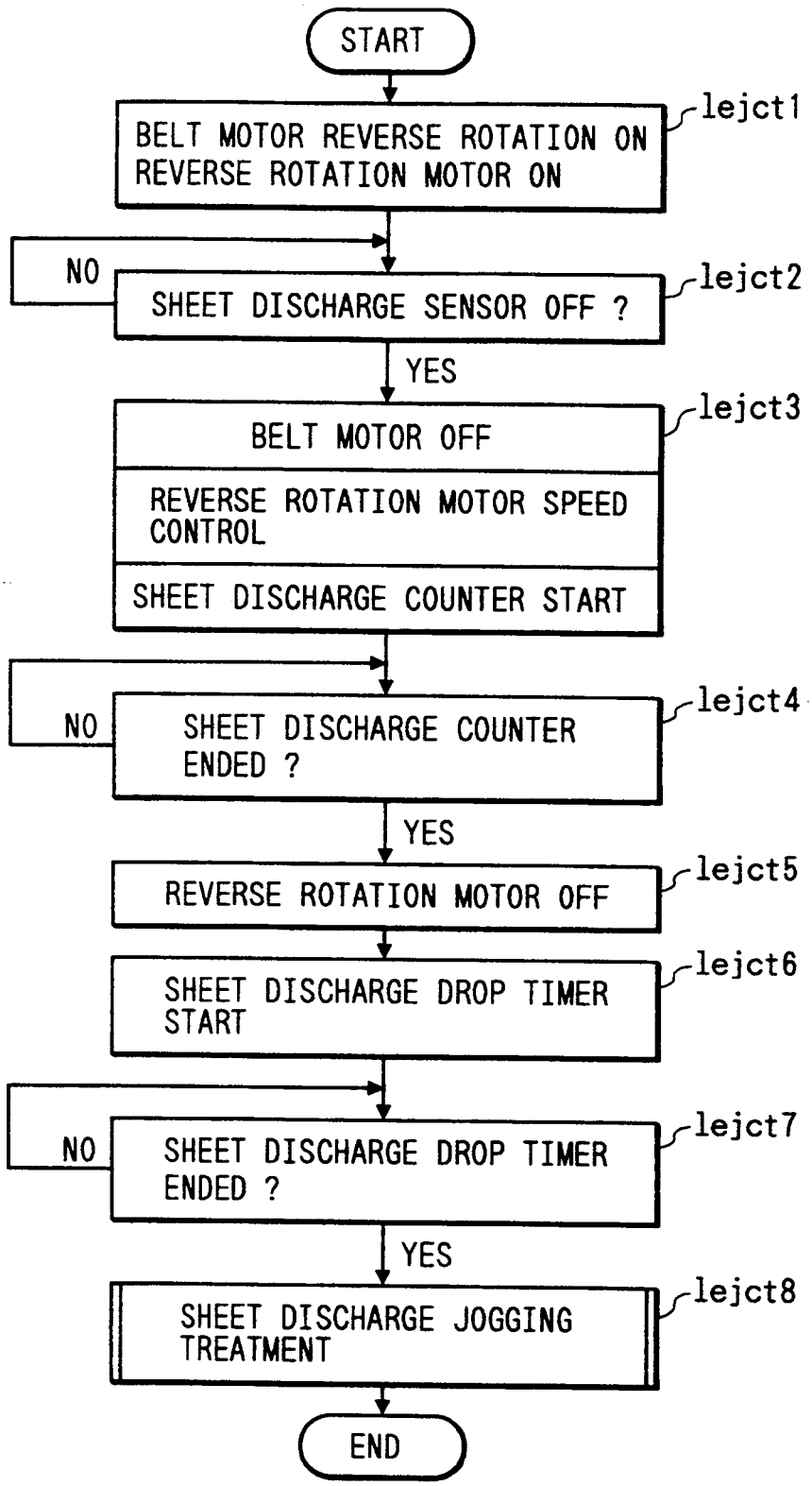
FIG. 38 is a flow chart for an intermittent sheet discharge treatment.

The intermittent sheet discharge treatment will be explained with reference to FIG. 38.

In the intermittent sheet discharge treatment, the belt motor 112 is turned ON reversely to discharge the sheet original from the platen, and the reverse rotation motor is turned ON (lejct 1). When the trailing end of the sheet original conveyed from the sheet path (d) to the sheet path (f) is detected by the sheet discharge sensor 27 (lejct 2), the belt motor is turned OFF, and a sheet discharge counter for determining a distance for discharging the sheet original onto the original tray is started (lejct 3), while controlling the speed of the reverse rotation motor 101 to ensure the registration of the discharged sheet original. When the sheet discharge counter is ended (lejct 4), the reverse rotation motor 101 is turned OFF (lejct 5), and a sheet discharge drop timer for providing the interval until the sheet original is dropped on the original tray is started (lejct 6). When the timer is ended (lejct 7), the sheet discharge jogging treatment is effected to effect the registration of the discharged sheet original (lejct 8), and the intermittent sheet discharge treatment is ended.

Size Check Treatment

Figure 39:
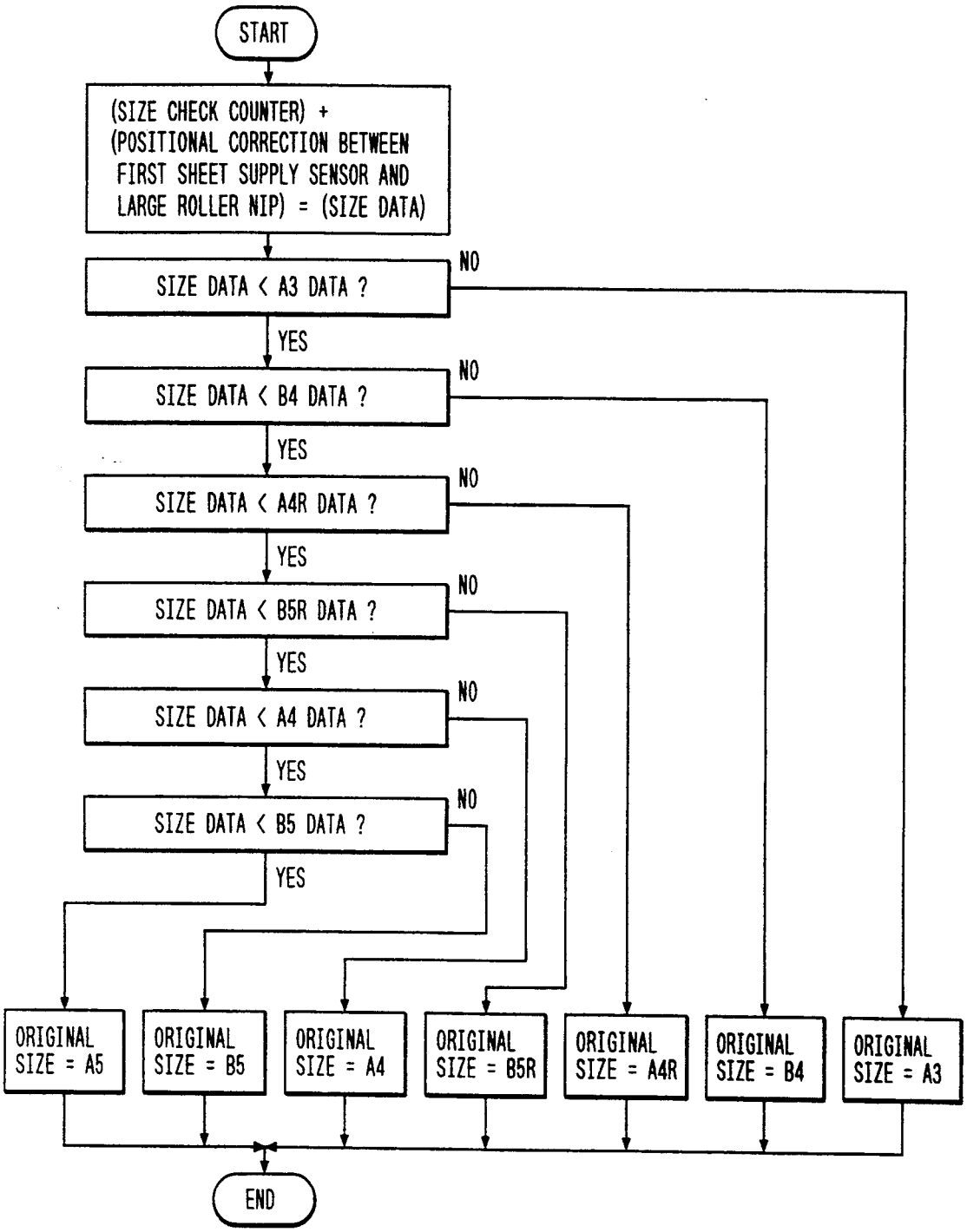
FIGS. 39 and 40 are flow charts for size check subroutines.

A size check sub-routine will be explained with reference to FIG. 39.

In this size check sub-routine, an actual original size is obtained by correcting the data of the size check counter by adding a value corresponding to the distance between the nip of the large roller and the first sheet supply sensor 25 to such data. In this case, the sheet original is fed by the feed rollers and the wide belt, and the feeding amount of the sheet original coincides with the counted value by the belt clock without fail. Thereafter, the original size such as A5, B5, A4, B5R, A4R, B4 and A3 is determined on the basis of the corrected size data.

Size Check 2 Treatment

Figure 40:
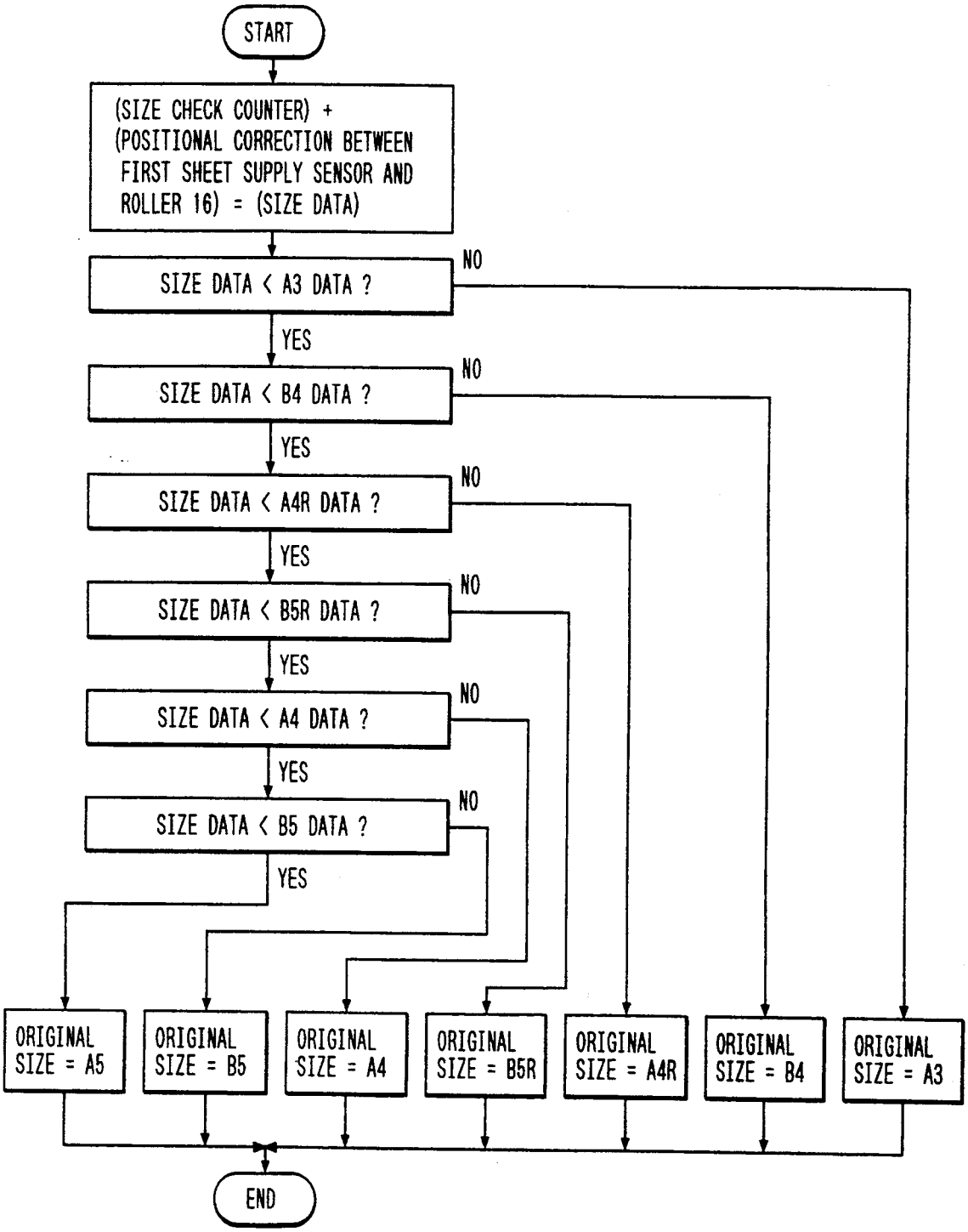

A size check 2 sub-routine will be explained with reference to FIG. 40.

In this size check 2 sub-routine, an actual original size is obtained by correcting the data of the size check counter by adding a value corresponding to the distance between the nip of the rollers 16 and the second sheet supply sensor 30 to such data. In this case, the sheet original is fed by the feed rollers and the wide belt, and the feeding amount of the sheet original coincides with the counted value by the belt clock without fail. Thereafter, the original size such as A4, B5, A4, B5R, A4R, B4 and A3 is determined on the basis of the corrected size data.

Jogging Treatment

Figure 41:
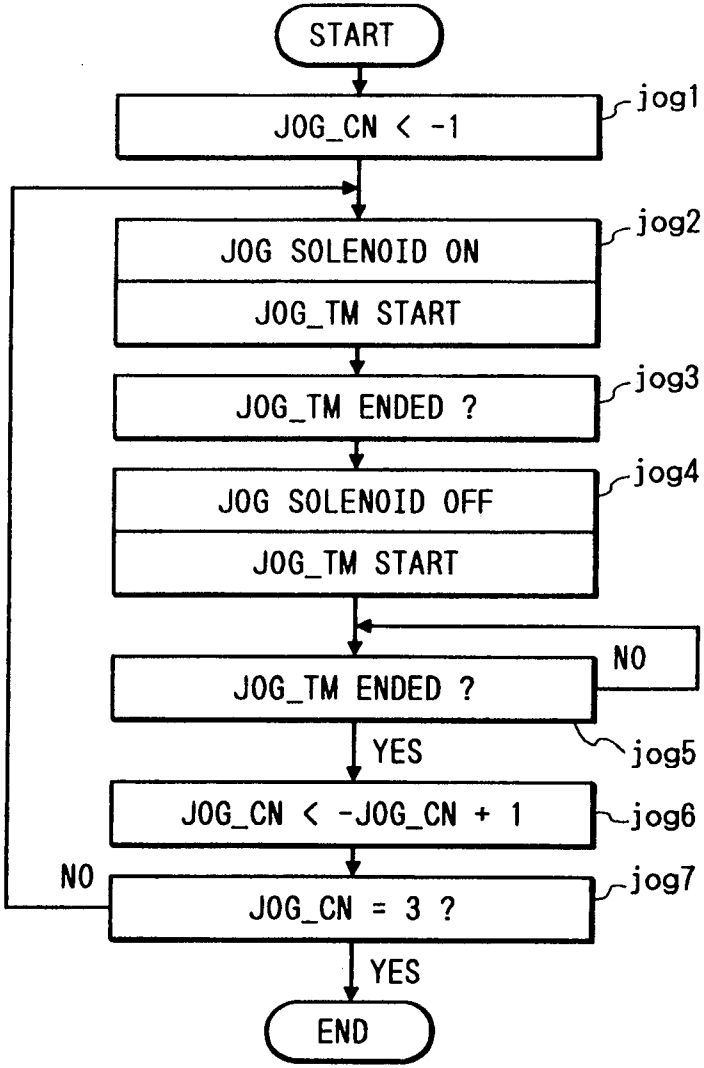
FIG. 41 is a flow chart for a jogging treatment.

A flow of the jogging treatment will be explained with reference to a flow chart shown in FIG. 41. In the jogging treatment, first of all, a JOG_CN for determining the number of the jogging cycles is initialized (jog 1). Then, the jogging solenoid 132 for pushing out the jogging guide of the width regulating member is turned ON and at the same time a timer JOG_TM which can be set by any condition is started (jog 2). When the timer JOG_TM is ended (jog 3), the jogging solenoid 132 is turned OFF to return the jogging guide to the initial position, and the timer JOG_TM is started again (jog 4). When the timer is ended (jog 5), the number of jogging cycles is increased (jog 6). And, until the jogging guide is reciprocated by three times (jog 7), the program returns to the jog 2, thereby repeating the treatment. As a result, the original bundle P is registrated in the widthwise direction, thus preventing the skew-feed and the lateral regist.

Sheet Discharge Jogging Treatment

Figure 42:
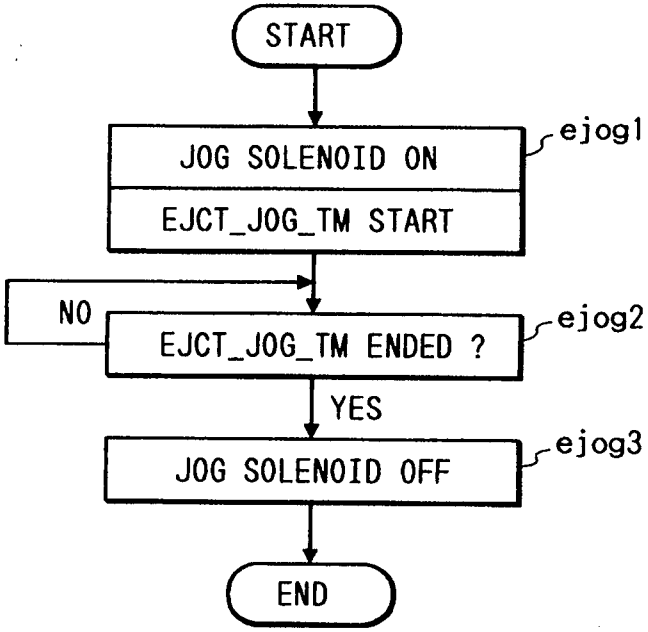
FIG. 42 is a flow chart for a sheet discharge jogging treatment.

A flow of the sheet discharge jogging treatment will be explained with reference to a flow chart shown in FIG. 42.

In the sheet discharge jogging treatment, the jogging solenoid 132 for pushing out the jogging guide of the width regulating member is turned ON and at the same time a timer EJCT_JOG_TM which can be set to any condition is started (ejog 1). When the timer EJCT_JOG_TM is ended (ejog 2), the jogging solenoid 132 is turned OFF to return the jogging guide to the initial position (ejog 3). As a result, the original bundle P is registrated in the widthwise direction, thus preventing the skew-feed and the lateral regist.

Closed-loop Sheet Discharge Jogging Treatment

Figure 43:
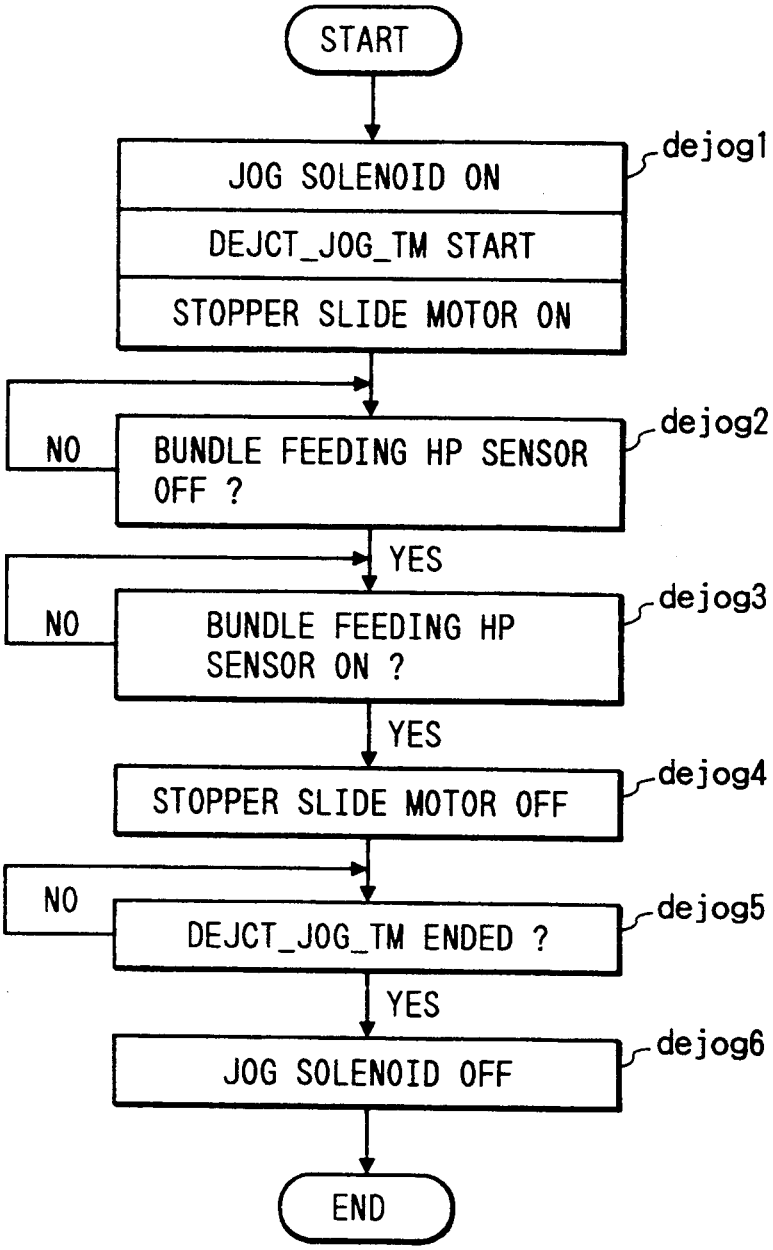
FIG. 43 is a flow chart for a closed-loop sheet discharge jogging treatment.

A flow of the closed-loop sheet discharge jogging treatment will be explained with reference to a flow chart shown in FIG. 43.

In the closed-loop sheet discharge jogging treatment, the jogging solenoid 132 for pushing out the jogging guide of the width regulating member is turned ON, and the stopper slide motor 106 is turned ON to improve the registration in the feeding direction, and at the same time a timer DEJCT_JOG_TM which can be set to any condition is started (dejog 1). A bundle feeding HP sensor 45 is monitored until the timer DEJCT_J-G_TM is ended, and, when the home position is restored, the stopper slide motor 106 is turned OFF (dejog 2, 3, 4). When the timer is ended (dejog 5), the jogging solenoid 132 is turned OFF to return the jogging guide to the initial position (dejog 6). As a result, the original bundle P is registrated in the widthwise direction, thus preventing the skew-feed and the lateral regist. Further, the timer DEJCT_JOG_TM is set to provide a time sufficient to rotate the stopper unit by one revolution.

Next, a sixth embodiment of the present invention will be explained with reference to FIG. 47.

Figure 47:
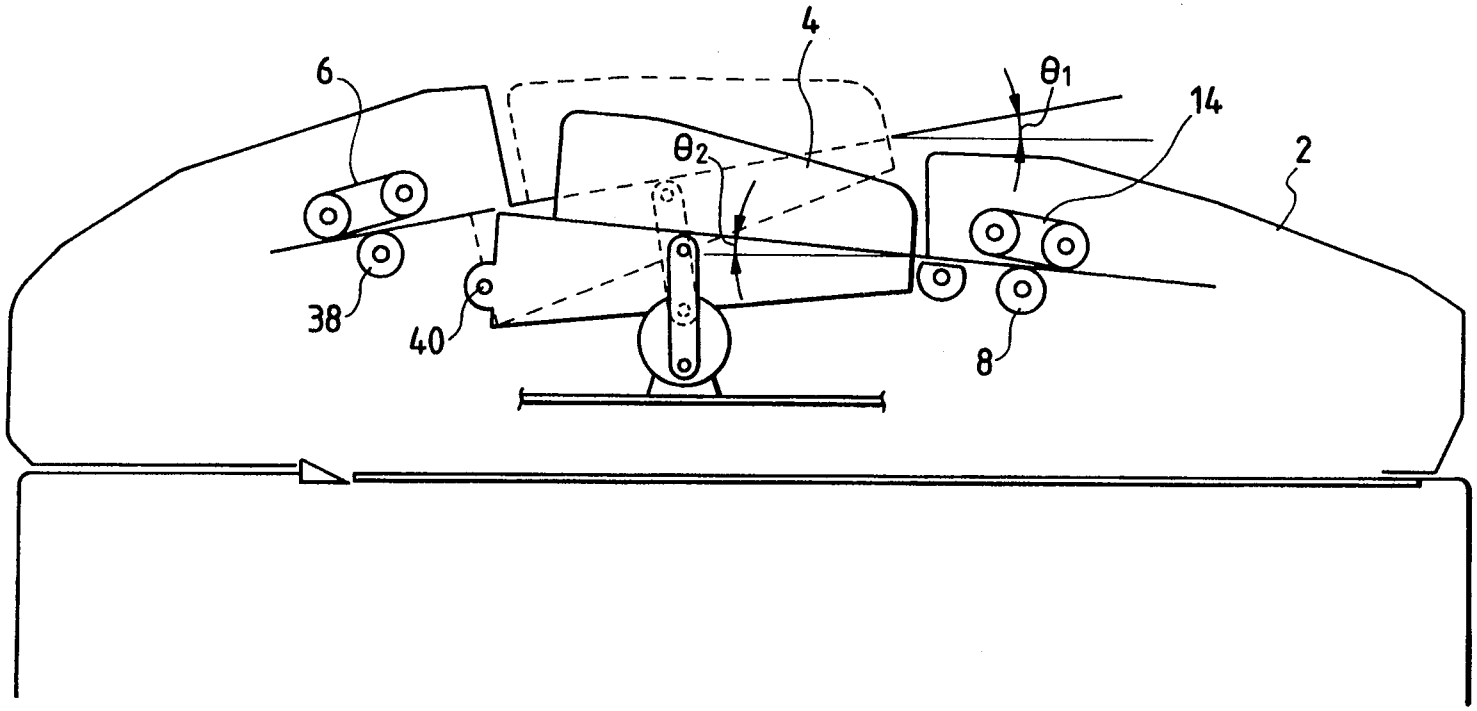
FIG. 47 is an elevational sectional view of an automatic original feeding apparatus according to a fifth embodiment of the present invention.

FIG. 47 shows an upper limit position and a lower limit position of the rockable original tray 4. The upper limit position of the tray is shown by the broken line where the tray is inclined by an angle $\theta_1$ (>0), and the lower limit position is shown by the solid line where the tray is inclined by an angle $\theta_2$ (>0).

With the arrangement as mentioned above, in this embodiment, as shown in FIG. 47, when the sheet original is supplied from the first separation portion, the original tray is shifted to the upper limit position having the inclined angle of $\theta_1$ shown by the broken line. On the other hand, when the sheet original is supplied from the second separation portion, the original tray is shifted to the lower limit position having the inclined angle of $\theta_2$ shown by the solid line. In this way, when the original tray is in the upper limit position, the sheet original is fed from the first separation portion. Even when the sheet original is discharged by the discharge rollers 11 and is re-stacked on the original tray 4 after the image forming operation, since the original tray is inclined by the angle of $\theta_1$, the discharged sheet original can be re-stacked by the weight of the sheet original itself without deteriorating the registration of the originals in the feeding direction. Further, when the original tray is in the lower limit position, the sheet original is fed from the second separation portion. In this case, when the original bundle on the original tray is shifted toward the second separation portion, since the original tray is inclined by the angle of $\theta_2$, the original bundle can be shifted by the weight of the sheet originals themselves without deteriorating the registration of the originals, and, since the load to the motor for driving the stopper 21 for shifting the original bundle can be reduced, it is possible to make the motor small-sized. Further, when the original tray is in the lower limit position, after the image forming operation, since the sheet original is discharged by the discharge rollers 11 and is re-stacked on the original tray, the discharged sheet original can be re-stacked on the original bundle toward the second separation portion.

Figure 44:
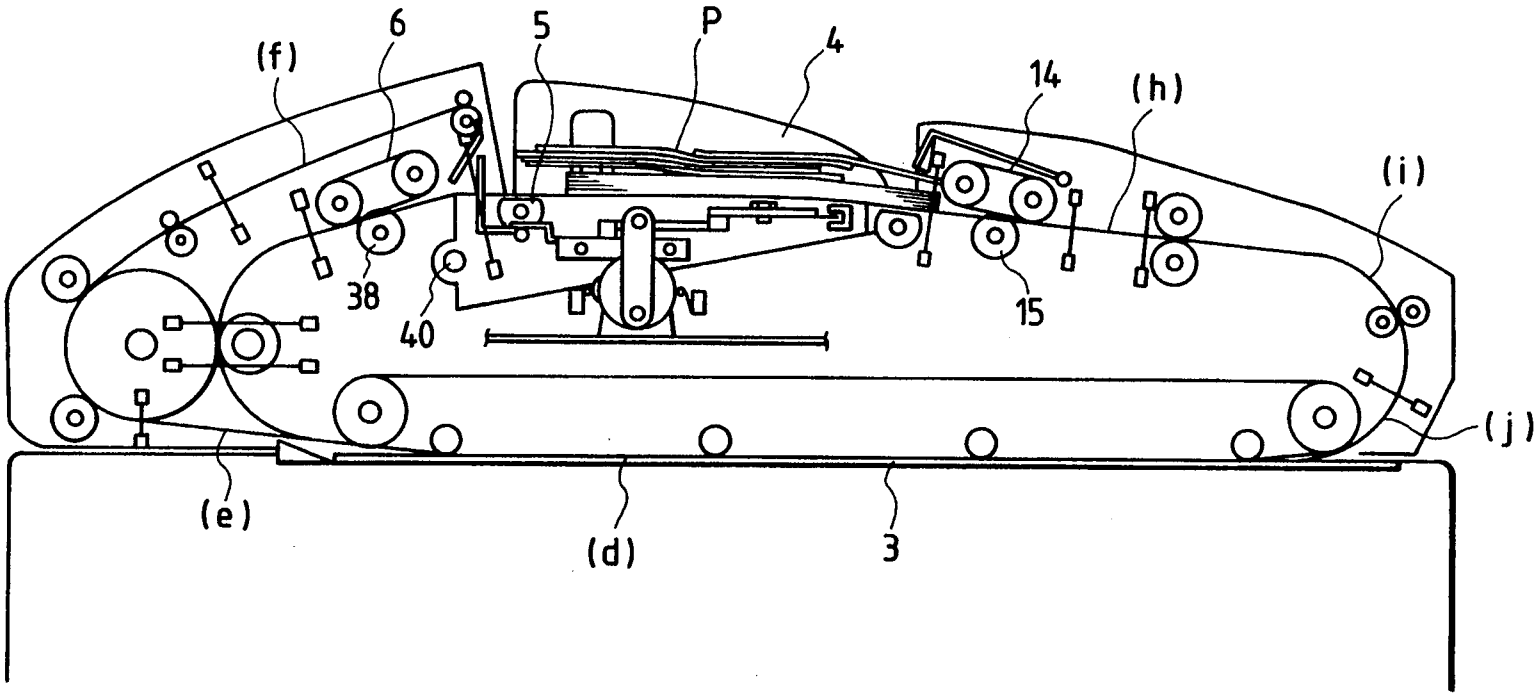
FIG. 44 is an elevational sectional view of an automatic original feeding apparatus according to a fourth embodiment of the present invention.

In an original feeding apparatus according to a fourth embodiment of the present invention shown in FIG. 44, the second separation portion 14, 15 is arranged in opposition to the first separation portion 6, 38, and the sheet original P is fed to pass through the sheet paths (h), (i), (j), (d), (e), (f) and is re-stacked on the original tray 4. In this case, in the conventional techniques, it was feared that the discharged sheet original was re-stacked on the original tray toward the first separation portion or was skipped toward the second separation portion, thus causing the poor re-stacking condition, and, therefore, when the sheet originals were recirculated, the page sequence of the sheet originals was disordered. Further, it was feared that, when the original tray was returned to the original position after the final recirculation has been finished if the sheet original was pinched by the second separation portion during the final recirculation, the condition as shown in FIG. 45 was established, thus damaging or tearing the sheet original.

Further, it is known to provide an arrangement wherein an image reading portion of the image forming system is fixed and the image is read while shifting the sheet original in order to achieve the high speed image formation without utilizing the high speed original feeding. If this arrangement is incorporated into the above-mentioned arrangement, as shown in FIG. 44, there can be provided an apparatus having a switch-back type wherein the first separation portion is disposed at the left of the original tray 4 and the sheet original fed from the first separation portion is conveyed in a switch-back fashion, and a type wherein the second separation portion is disposed in opposition to the first separation portion with respect to the original tray and the sheet original fed from the second separation portion is read while fixing the image reading portion of the image forming system. When the sheet original is fed for the second separation portion, the original bundle on the original tray is bundle-fed from the first separation portion side to the second separation portion side.

However, in such an apparatus, when the sheet original was fed from the second separation portion, since the original tray was shifted to a horizontal position or an upward position from the horizontal position, the sheet originals could not be registered in the bundle feeding out on the original tray, and the discharged sheet originals could also not be registered during the re-stacking of the latter, thereby causing a risk that the sheet originals are not fed in the page sequence.

Figure 45:
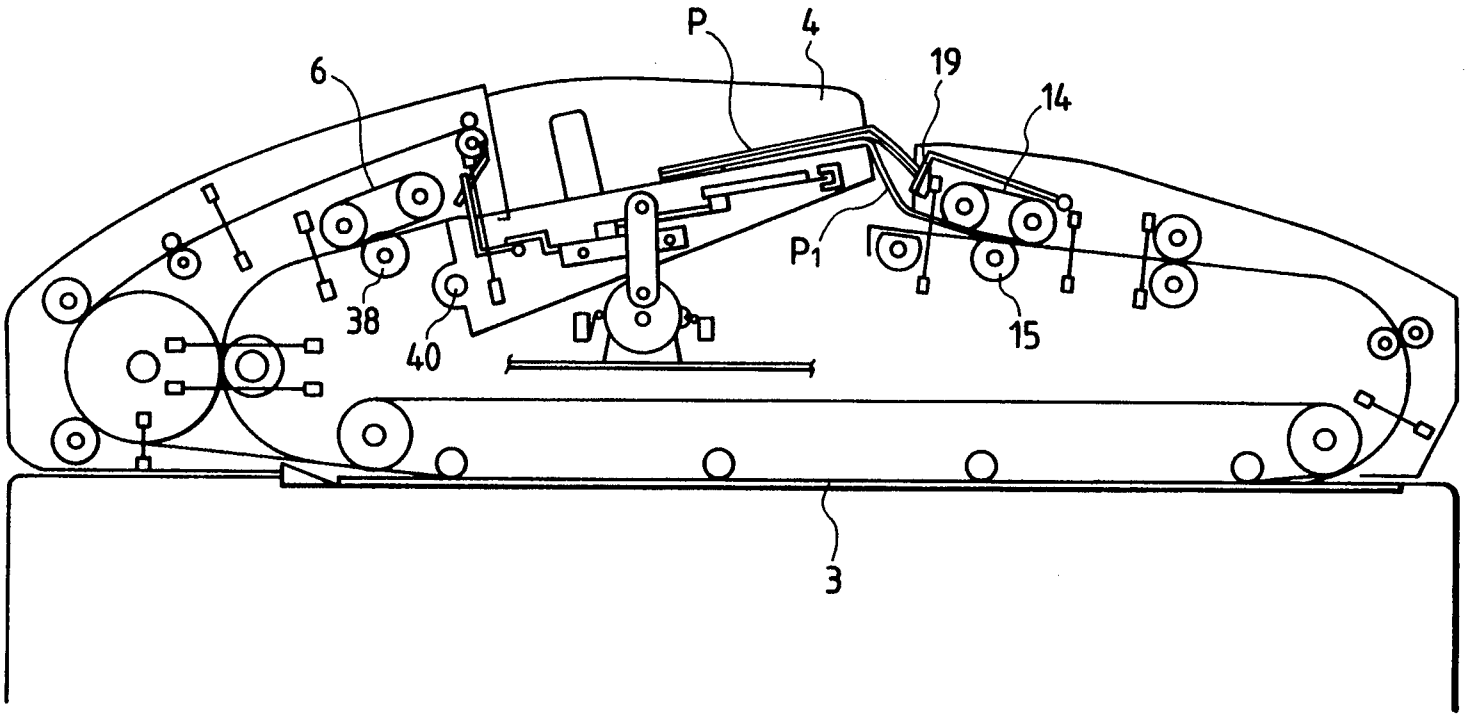
FIG. 45 is an elevational sectional view of the original feeding apparatus showing the function thereof.
Figure 46:
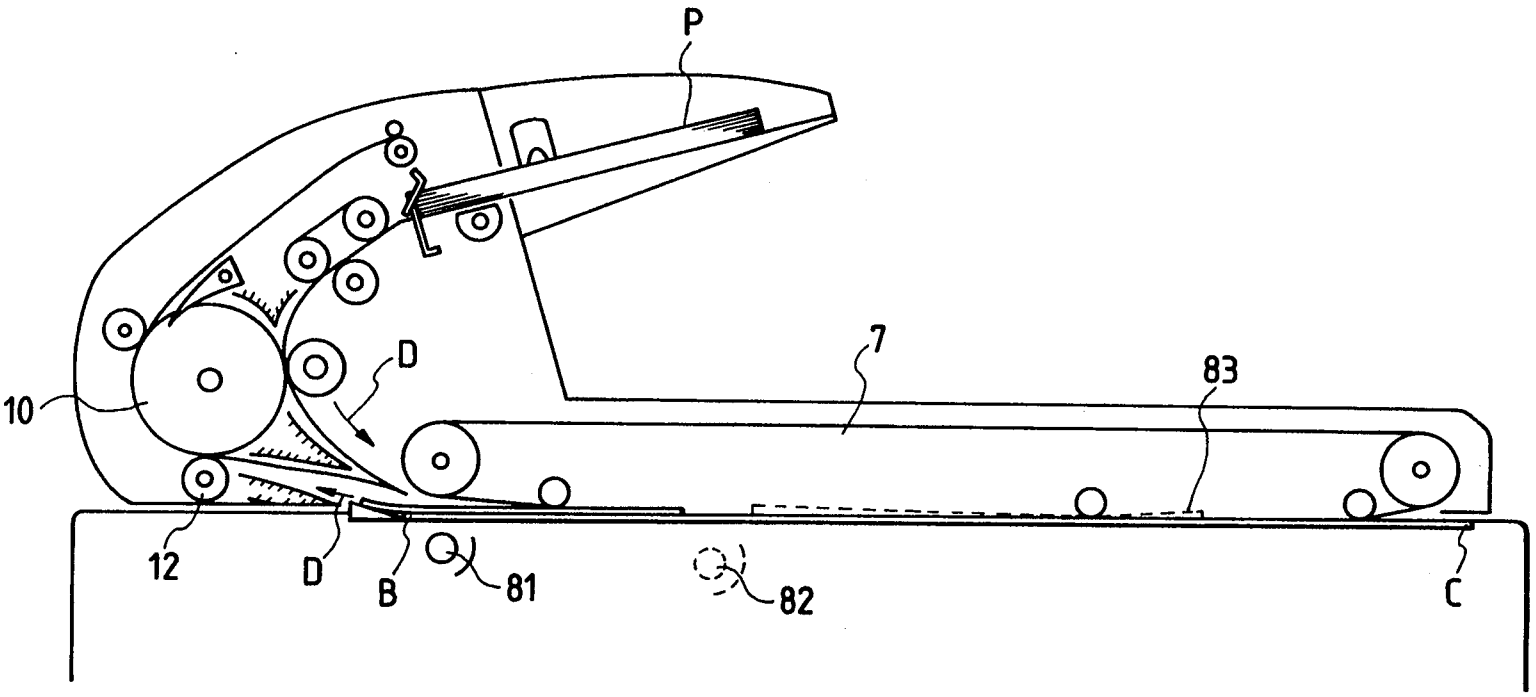
FIG. 46 PRIOR ART
FIG. 46 is an elevational sectional view of a conventional original feeding apparatus.

To the contrary, the embodiment of the present invention shown in FIG. 47 has the above-mentioned advantages in comparison with the apparatus shown in FIGS. 44 and 45.

Lastly, a copying machine to which the present invention can be applied will be explained with reference to FIG. 50.

The copying machine 100 includes a platen glass 3 for supporting an original to be copied, scanning mirrors 152, 153, 154 and 155 for scanning the original on the platen glass and deflecting the light reflected by the original, a lens 156 having a focusing and magnification changing functions. The copying machine 10 further comprises a photo-sensitive drum 157, a high voltage unit 158, a developing device 159, a transfer charger 159 and a cleaning device 160.

For the sheet handling, the copying machine 100 further comprises a lower cassette 162, a sheet feeding deck 163, pickup rollers 164, 165 and 166 and a registration roller 167. If further comprises an image fixing device 169, a conveyor belt 168 for conveying a sheet having an image to the fixing device 169, a conveying roller 171 and a sheet sensor 171*a*.

It includes a deflector 172 for selectively introducing a sheet to a discharge roller 11 or to a reversing tray unit 173. A manual sheet feeding tray 175 is provided to allow an operator to feed manually a recording sheet.

In response to actuation of a copy start key which will be described, the photosensitive drum 157 starts to rotate. Then, the drum 157 is subjected to a predetermined rotation control and a potential control. Then, an original placed on the platen glass is illuminated by an illumination lamp, and the light reflected by the original is directed by way of the scanning mirrors 152, 153, 154 and 155 and through the lens 156 onto a surface of the photosensitive drum 157 where an image is formed. Before the photosensitive drum 157 is exposed to the light image, it has been corona-charged with the aid of the high voltage unit 158. Thereafter, the photosensitive drum 157 is exposed to the light image, so that an electrostatic latent image is formed on the photosensitive drum 157.

The electrostatic latent image thus formed on the photosensitive drum 157 is developed by a developing roller 159*a* of the developing device 159 so that a visualized image is formed with toner, and the toner image is transferred onto a transfer sheet by the transfer charger 159.

On the other hand, the transfer sheet is discharged from the upper cassette 161, the lower cassette 162 or the deck 163 by the pickup roller 164, 165 or 166. The sheet is once stopped by the registration roller 167 so that a loop of the sheet is formed. The registration roller 167 refeeds the once stopped sheet in such a timed relation that the leading edge of the sheet is brought into alignment with the leading edge of the image formed on the photosensitive drum 157 which is rotating. When the sheet passes through between the photosensitive drum 157 and the transfer charger 159, the toner image on the photosensitive drum 157 is transferred onto the sheet. After the image transfer, the sheet is separated from the photosensitive drum 157 and is directed by the conveying belt 168 to the image fixing device 169 where the image is fixed by pressure and heat thereon. Then, the sheet is discharged by the conveying roller 171 and the discharge roller 111. If the sheet is not detected by the sheet sensor 171*a* at the predetermined timing, it is deemed that jam has occurred to require the operator to clear the jam.

When plural image forming operations are to be effected on the same sheet, a duplex mode or superimposing mode is inputted in the operation panel 175 of the copying machine. Then, the sheet is introduced by the deflector 172 to the reversing tray unit 173 and is fed to the photosensitive drum 157 again through the conveying passage 174.

The photosensitive drum 157 surface, after the image has been transferred, is brought to the cleaning device 160 where the surface of the photosensitive drum 157 is cleaned to be prepared for the next image forming operation.

What is claimed is:

1. An original feeding apparatus, comprising:

first original feeding means for directing an original to an original reading station from one side thereof in an original-stationary scanning mode in which the original is read while fixing the original at said original reading station; and second original feeding means for directing the original to said original reading station from the other side thereof in an original-through scanning mode in which the original is read while shifting the original along said original reading station.

2. An original feeding apparatus according to claim 1, wherein said first original feeding means comprises a stacking tray on which the originals are stacked, first separating means for separating and feeding the originals stacked on said stacking tray one by one, and a first path for directing the separated original to said original reading station; and said second original feeding means comprises second separating means for separating and feeding the originals stacked on said stacking tray one by one, and a second path for directing the separated original to said original reading station.

3. An original feeding apparatus according to claim 2, further comprising commanding means for commanding a size of the original, and control means for selectively driving said first separating means or said second separating means in response to the command from said commanding means.

4. An original feeding apparatus according to claim 2, further comprising mode switching command means, and control means for selectively driving said first separating means or said second separating means in response to the command from said mode switching command means.

5. An original feeding apparatus according to claim 2, further comprising means for rockably supporting said stacking tray, and control means for rocking said stacking tray to a first position when said first separating means is selected and for rocking said stacking tray to a second position when said second separating means is selected.

6. An original feeding apparatus according to claim 5, further comprising commanding means for commanding a size of the original, and control means for selectively driving said first separating means or said second separating means in response to the command from said commanding means.

7. An original feeding apparatus according to claim 5, further comprising mode switching command means, and control means for selectively driving said first separating means or said second separating means in response to the command from said mode switching command means.

8. An original feeding apparatus according to claim 2, further comprising bundle feeding means for feeding an original bundle on said stacking tray toward said second separating means.

9. An original feeding apparatus according to claim 8, further comprising a third path for returning the original separated and fed by said second separating means and read to said stacking tray, and control means for driving said bundle feeding means whenever the original was returned to said stacking tray.

10. An original feeding apparatus according to claim 8, further comprising a third path for returning the original separated and fed by said second separating means and read to said stacking tray, and stopper means disposed at an upstream side of said second separating means and adapted to prevent the original returned to said stacking tray from entering into said second separating means.

11. An original feeding apparatus according to claim 2, further comprising a third path for returning the original separated and fed by said second separating means and read to said stacking tray, stopper means disposed at an upstream side of said second separating means and adapted to prevent the original returned to said stacking tray from entering into said second separating means, and control means for retarding said stopper means until (N−1)th recirculation is finished, when the original bundle are to be recirculated by N times.

12. An original feeding apparatus according to claim 2, further comprising means for rockably supporting said stacking tray, and control means for rocking said stacking tray to a first position (where a side of said stacking tray near said first separating means becomes lower than the other side) when said first separating means is selected and for rocking said stacking tray to a second position (where a side of said stacking tray near said second separating means becomes lower than the other side) when said second separating means is selected.

13. An original feeding apparatus according to claim 1, further comprising a convey rotary member opposed to a glass platen which constitutes said original reading station, and a feed rotary member disposed in said second original feeding means and adapted to feed the original to said convey rotary member;

wherein, when the original is fed by said convey rotary member to start the reading operation, a trailing end of the original has already been passed through said feed rotary member completely.

14. An original feeding apparatus according to claim 1, further comprising control means for controlling said second original feeding means so as to rest two originals on said original reading station side by side.

15. An original feeding apparatus according to claim 2, further comprising a third path for returning the original read to said stacking tray.

16. An image forming system, comprising:

an original feeding apparatus including first original feeding means for directing an original to an original reading station from one side thereof in an original-stationary scanning mode in which the original is read while fixing the original at said original reading station, and second original feeding means for directing the original to said original reading station from the other side thereof in an original-through scanning mode in which the original is read while shifting the original along said original reading station.

17. An image forming system according to claim 16, wherein said first original feeding means comprises a stacking tray on which the originals are stacked, first separating mean for separating and feeding the originals stacked on said stacking tray one by one, and a first path for directing the separated original to said original reading station; and said second original feeding means comprises a second separating means for separating and feeding the originals stacked on said stacking tray one by one, and a second path for directing the separated original to said original reading station.

18. An original feeding apparatus, comprising:

an original stacking tray;

separating means for separating and feeding originals stacked on said original stacking tray;

a first path for directing the separated and fed original to an original reading station from one direction; and a second path for directing the separated and fed original to said original reading station from the other direction.

19. An original feeding apparatus according to claim 18, further comprising control means for selecting said first path in an original-stationary scanning mode in which the original is read while fixing the original at said original reading station and for selecting said second path in an original-through scanning mode in which the original is read while shifting the original along said original reading station.

20. An original feeding apparatus according to claim 18, further comprising switch-back means including a reversible rotary member for shifting the original into said second path in a half way of said first path.

21. An original feeding apparatus according to claim 18, further comprising switch-back means adopting a free drop, for shifting the original into said second path in a half way of said first path.

22. An original feeding apparatus according to claim 18, further comprising a third path for returning the original read to said original stacking tray.

23. An image forming system, comprising:

an original feeding apparatus including an original stacking tray, separating means for separating and feeding originals stacked on said original stacking tray, a first path for directing the separated and fed original to an original reading station from one direction, and a second path for directing the separated and fed original to said original reading station from the other direction.

24. An image forming system according to claim 23, further comprising control means for selecting said first path in an original-stationary scanning mode in which the original is read while fixing the original at said original reading station and for selecting said second path in an original-through scanning mode in which the original is read while shifting the original along said original reading station.

25. An original feeding apparatus, comprising:

first original feeding means for directing an original to an original reading station from one side thereof in an original-stationary scanning mode in which the original is read while fixing the original at said original reading station; and second original feeding means for directing the original to said original reading station from the other side thereof in a side-by-side scanning mode in which the originals are read while resting two originals on said original reading station side by side.

26. An original feeding apparatus according to claim 25, wherein said first original feeding means comprises a stacking tray on which the originals are stacked, first separating means for separating and feeding the originals stacked on said stacking tray one by one, and a first path for directing the separated original to said original reading station; and said second original feeding means comprises second separating means for separating and feeding the originals stacked on said stacking tray one by one, and a second path for directing the separated original to said original reading station.

27. An image forming system, comprising:

an original feeding apparatus including first original feeding means for directing an original to an original reading station from one side thereof in an original-stationary scanning mode in which the original is read while fixing the original at said original reading station, and a second original feeding means for directing the original to said original reading station from the other side thereof in a side-by-side scanning mode in which the originals are read while resting two originals on said original reading station side by side.

28. An image forming system according to claim 27, wherein said first original feeding means comprises a stacking tray on which the originals are stacked, first separating means for separating and feeding the originals stacked on said stacking tray one by one, and a first path for directing the separated original to said original reading station; and said second original feeding means comprises second separating means for separating and feeding the originals stacked on said stacking tray one by one, and a second path for directing the separated original to said original reading station.

29. An original feeding apparatus, comprising:

an original stacking tray;

first separating means provided at one end of said original stacking tray and adapted to separate and feed originals one by one;

a first path for directing the separated and fed original to an original reading station from one direction;

second separating means provided at the other end of said original stacking tray and adapted to separate and feed the originals one by one; and a second path for directing the separated and fed original to said original reading station from the other direction.

30. An original feeding apparatus according to claim 29, further comprising third path for returning the original read to said original stacking tray.

31. An image forming system, comprising:

an original feeding apparatus including an original stacking tray, first separating means provided at one end of said original stacking tray and adapted to separate and feed originals one by one, a first path for directing the separated and fed original to an original reading station from one direction, second separating means provided at the other end of said original stacking tray and adapted to separate and feed the originals one by one, and a second path for directing the separated and fed original to said original reading station from the other direction.

32. An image forming system according to claim 31, further comprising a third path for returning the original read to said original stacking tray.

33. An original feeding apparatus according to claim 9, wherein said bundle feeding means does not operate in the last recirculation so that the originals are stacked on a position spaced apart from said second separating means.

34. An original feeding apparatus according to claim 4, wherein, even when said second separating means is selected by said mode switching commanding means, in a case where the size of the original is other than a predetermined size, said first separating means is selected.

* * * * *

UNITED STATES PATENT AND TRADEMARK OFFICE

CERTIFICATE OF CORRECTION

PATENT NO. : 5,351,112
DATED : September 27, 1994
INVENTOR(S) : MASATAKA NAITO, ET AL.

It is certified that error appears in the above-indentified patent and that said Letters Patent is hereby corrected as shown below:

Column 7
Line 18, "would" should read --wound--.
Column 9
Line 37, "stopped" should read --stopper--.
Column 12
Line 39, "ferwer" should read --fewer--.
Column 14
Line 22, "there" should read --there are--; and
Line 54, "to" should be deleted.
Column 20
Line 25, "paled" and "like" should be deleted.
Column 26
Line 56, "If" should read--It--.
Column 28
Line 64, "are" should read --is--.
Column 29
Line 40, "mean" should read --means--.

Signed and Sealed this

Twenty-first Day of February, 1995

Bruce Lehman

*Attest:*

BRUCE LEHMAN

*Attesting Officer*

*Commissioner of Patents and Trademarks*